US009984693B2

(12) United States Patent
Kim et al.

(10) Patent No.: US 9,984,693 B2
(45) Date of Patent: May 29, 2018

(54) SIGNALING CHANNELS FOR SCALABLE CODING OF HIGHER ORDER AMBISONIC AUDIO DATA

(71) Applicant: QUALCOMM Incorporated, San Diego, CA (US)

(72) Inventors: Moo Young Kim, San Diego, CA (US); Nils Günther Peters, San Diego, CA (US); Dipanjan Sen, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 204 days.

(21) Appl. No.: 14/878,729

(22) Filed: Oct. 8, 2015

(65) Prior Publication Data

US 2016/0104494 A1 Apr. 14, 2016

Related U.S. Application Data

(60) Provisional application No. 62/062,584, filed on Oct. 10, 2014, provisional application No. 62/084,461, filed on Nov. 25, 2014, provisional application No. 62/087,209, filed on Dec. 3, 2014, provisional application No. 62/088,445, filed on Dec. 5, 2014,
(Continued)

(51) Int. Cl.
*G10L 19/008* (2013.01)
*H04S 7/00* (2006.01)
*G10L 19/16* (2013.01)

(52) U.S. Cl.
CPC ..... *G10L 19/008* (2013.01); *G10L 19/167* (2013.01); *H04S 7/30* (2013.01); *H04S 2420/11* (2013.01)

(58) Field of Classification Search
None
See application file for complete search history.

(56) References Cited

U.S. PATENT DOCUMENTS 8,326,639 B2 12/2012 Wuebbolt et al.
2011/0249821 A1 10/2011 Jaillet
(Continued)

FOREIGN PATENT DOCUMENTS

TW 201537562 A 10/2015
WO 2013079663 A2 6/2013
(Continued)

OTHER PUBLICATIONS

Response to Written Opinion dated Jan. 27, 2016, from International Application No. PCT/US2015/054951, filed on Aug. 9, 2016, 24 pp.
(Continued)

*Primary Examiner* — Paul Huber
(74) *Attorney, Agent, or Firm* — Shumaker & Sieffert, P.A.

(57) ABSTRACT

In general, techniques are described for signaling channels for scalable coding of higher order ambisonic audio data. A device comprising a memory and a processor may be configured to perform the techniques. The memory may be configured to store the bitstream. The processor may be configured to obtain, from the bitstream, an indication of a number of channels specified in one or more layers in the bitstream, and obtain the channels specified in the one or more layers in the bitstream based on the indication of the number of channels.

28 Claims, 30 Drawing Sheets

Related U.S. Application Data provisional application No. 62/145,960, filed on Apr. 10, 2015, provisional application No. 62/175,185, filed on Jun. 12, 2015, provisional application No. 62/187,799, filed on Jul. 1, 2015, provisional application No. 62/209,764, filed on Aug. 25, 2015.

(56) References Cited

U.S. PATENT DOCUMENTS

| | | | | |
|---|---|---|---|---|
| 2012/0155653 | A1* | 6/2012 | Jax | H04H 20/89 381/22 |
| 2014/0219460 | A1 | 8/2014 | McGrath | |
| 2014/0288940 | A1 | 9/2014 | Grant et al. | |
| 2015/0078594 | A1 | 3/2015 | McGrath et al. | |
| 2015/0154971 | A1 | 6/2015 | Boehm et al. | |
| 2015/0213803 | A1 | 7/2015 | Peters | |
| 2015/0221313 | A1 | 8/2015 | Purnhagen et al. | |
| 2015/0244869 | A1 | 8/2015 | Cartwright et al. | |
| 2016/0104493 | A1 | 4/2016 | Kim et al. | |

FOREIGN PATENT DOCUMENTS

| | | | |
|---|---|---|---|
| WO | 2014194099 | A1 | 12/2014 |
| WO | 2015140291 | A1 | 9/2015 |
| WO | 2015140292 | A1 | 9/2015 |
| WO | 2015140293 | A1 | 9/2015 |

OTHER PUBLICATIONS

Second Written Opinion from International Application No. PCT/US2015/054951, dated Sep. 5, 2016, 7 pp.

Response to Second Written Opinion dated Sep. 5, 2016, from International Application No. PCT/US2015/054951, filed on Nov. 4, 2016, 6 pp.

International Preliminary Report on Patentability from International Application No. PCT/US2015/054951, dated Feb. 7, 2017, 8 pp.

Communication from International Application No. PCT/US2015/054951, dated Dec. 5, 2016, 1 pp.

Response to Communication dated Dec. 5, 2016, from International Application No. PCT/US2015/054951, filed on Dec. 15, 2016, 16 pp.

Boehm, et al., "Scalable Decoding Mode for MPEG-H 3D Audio HOA," MPEG Meeting; Mar. 31-Apr. 4, 2014; Valencia; (Motion Picture Expert Group or ISO/IEC JTC1/SC29/WG11), No. m33195, Mar. 26, 2014, XP030061647, 12 pp.

Boehm, et al., "HOA Decoder—changes and proposed modification," Technicolor, MPEG Meeting; Mar. 31-Apr. 4, 2014; Valencia; (Motion Picture Expert Group or ISO/IEC JTC1/SC29/WG11), No. m33196, Mar. 26, 2014, XP030061648, 16 pp.

DVB Organization: "ISO-IEC_23008-3_(E)_(DIS of 3DA).docx", DVB, Digital Video Broadcasting, C/0 EBU-17A Ancienne Route-CH-1218 Grand Saconnex, Geneva-Switzerland, Jul. 25, 2014 , 431 pp., XP017845569.

International Search Report and Written Opinion from International Application No. PCT/US2015/054951, dated Jan. 27, 2016, 13 pp.

"Call for Proposals for 3D Audio," ISO/IEC JTC1/SC29/WG11/N13411, Jan. 2013, 20 pp.

Herre, et al., "MPEG-H 3D Audio—The New Standard for Coding of Immersive Spatial Audio," IEEE Journal of Selected Topics in Signal Processing, vol. 9, No. 5, Aug. 2015, pp. 770-779.

Poletti, "Three-Dimensional Surround Sound Systems Based on Spherical Harmonics," J. Audio Eng. Soc., vol. 53, No. 11, Nov. 2005, pp. 1004-1025.

"Information technology—High efficiency coding and media delivery in heterogeneous environments—Part 3: Part 3: 3D Audio, Amendment 3: MPEG-H 3D Audio Phase 2," ISO/IEC JTC 1/SC 29N, Jul. 25, 2015, 208 pp.

"Information technology—High efficiency coding and media delivery in heterogeneous environments—Part 3: 3D Audio," ISO/IEC JTC 1/SC 29N, Apr. 4, 2014, 337 pp.

"Information technology—High efficiency coding and media delivery in heterogeneous environments—Part 3: 3D Audio," ISO/IEC JTC 1/SC 29, Jul. 25, 2014, 311 pp.

Non-Final Office Action dated Jun. 9, 2017, from U.S. Appl. No. 14/878,691 15 pp.

Office Action from U.S. Appl. No. 14/878,691, dated Jun. 9, 2017, 16 pp.

Response to Office Action dated Jun. 9, 2017, from U.S. Appl. No. 14/878,691, filed Sep. 11, 2017, 22 pp.

Final Office Action from U.S. Appl. No. 14/878,691, dated Nov. 9, 2017, 10 pp.

Response to Final Office Action dated Nov. 9, 2017, from U.S. Appl. No. 14/878,691, filed Jan. 9, 2018, 23 pp.

Advisory Action from U.S. Appl. No. 14/878,691, dated Jan. 23, 2018, 3 pp.

* cited by examiner

SIGNALING CHANNELS FOR SCALABLE CODING OF HIGHER ORDER AMBISONIC AUDIO DATA

This application claims the benefit of the following:

U.S. Provisional Application No. 62/062,584, entitled "SCALABLE CODING OF HIGHER ORDER AMBISONIC AUDIO DATA," filed Oct. 10, 2014;

U.S. Provisional Application No. 62/084,461, entitled "SCALABLE CODING OF HIGHER ORDER AMBISONIC AUDIO DATA," filed Nov. 25, 2014;

U.S. Provisional Application No. 62/087,209, entitled "SCALABLE CODING OF HIGHER ORDER AMBISONIC AUDIO DATA," filed Dec. 3, 2014;

U.S. Provisional Application No. 62/088,445, entitled "SCALABLE CODING OF HIGHER ORDER AMBISONIC AUDIO DATA," filed Dec. 5, 2014;

U.S. Provisional Application No. 62/145,960, entitled "SCALABLE CODING OF HIGHER ORDER AMBISONIC AUDIO DATA," filed Apr. 10, 2015;

U.S. Provisional Application No. 62/175,185, entitled "SCALABLE CODING OF HIGHER ORDER AMBISONIC AUDIO DATA," filed Jun. 12, 2015;

U.S. Provisional Application No. 62/187,799, entitled "REDUCING CORRELATION BETWEEN HIGHER ORDER AMBISONIC (HOA) BACKGROUND CHANNELS," filed Jul. 1, 2015, and U.S. Provisional Application No. 62/209,764, entitled "TRANSPORTING CODED SCALABLE AUDIO DATA," filed Aug. 25, 2015, the entire content of each of which is incorporated herein by reference.

TECHNICAL FIELD

This disclosure relates to audio data and, more specifically, scalable coding of higher-order ambisonic audio data.

BACKGROUND

A higher-order ambisonics (HOA) signal (often represented by a plurality of spherical harmonic coefficients (SHC) or other hierarchical elements) is a three-dimensional representation of a soundfield. The HOA or SHC representation may represent the soundfield in a manner that is independent of the local speaker geometry used to playback a multi-channel audio signal rendered from the SHC signal. The SHC signal may also facilitate backwards compatibility as the SHC signal may be rendered to well-known and highly adopted multi-channel formats, such as a 5.1 audio channel format or a 7.1 audio channel format. The SHC representation may therefore enable a better representation of a soundfield that also accommodates backward compatibility.

SUMMARY

In general, techniques are described for scalable coding of higher-order ambisonics audio data. Higher-order ambisonics audio data may comprise at least one higher-order ambisonic (HOA) coefficient corresponding to a spherical harmonic basis function having an order greater than one. The techniques may provide for scalable coding of the HOA coefficients by coding the HOA coefficients using multiple layers, such as a base layer and one or more enhancement layers. The base layer may allow for reproduction of a soundfield represented by the HOA coefficients that may be enhanced by the one or more enhancement layers. In other words, the enhancement layers (in combination with the base layer) may provide additional resolution that allows for a fuller (or, more accurate) reproduction of the soundfield in comparison to the base layer alone.

In one aspect, a device is configured to decode a bitstream representative of a higher order ambisonic audio signal. The device comprises a memory configured to store the bitstream, and one or more processors configured to obtain, from the bitstream, an indication of a number of layers specified in the bitstream, and obtain the layers of the bitstream based on the indication of the number of layers.

In another aspect, a method of decoding a bitstream representative of a higher order ambisonic audio signal, the method comprises obtaining, from the bitstream, an indication of a number of layers specified in the bitstream, and obtaining the layers of the bitstream based on the indication of the number of layers.

In another aspect, an apparatus is configured to decode a bitstream representative of a higher order ambisonic audio signal. The apparatus comprises means for storing the bitstream, means for obtaining, from the bitstream, an indication of a number of layers specified in the bitstream, and means for obtaining the layers of the bitstream based on the indication of the number of layers.

In another aspect, a non-transitory computer-readable storage medium having stored thereon instructions that, when executed, cause one or more processors to obtain, from the bitstream, an indication of a number of layers specified in the bitstream, and obtain the layers of the bitstream based on the indication of the number of layers.

In another aspect, a device is configured to encode a higher order ambisonic audio signal to generate a bitstream. The device comprises a memory configured to store the bitstream, and one or more processors configured to specify an indication of a number of layers in the bitstream, and output the bitstream that includes the indicated number of the layers.

In another aspect, a method of generating a bitstream representative of a higher order ambisonic audio signal, the method comprises specifying an indication of a number of layers in the bitstream, and outputting the bitstream that includes the indicated number of the layers.

In another aspect, a device is configured to decode a bitstream representative of a higher order ambisonic audio signal. The device comprises a memory configured to store the bitstream, and one or more processors configured to obtain, from the bitstream, an indication of a number of channels specified in one or more layers in the bitstream, and obtain the channels specified in the one or more layers in the bitstream based on the indication of the number of channels.

In another aspect, a method of decoding a bitstream representative of a higher order ambisonic audio signal, the method comprises obtaining, from the bitstream, an indication of a number of channels specified in one or more layers in the bitstream, and obtaining the channels specified in the one or more layers in the bitstream based on the indication of the number of channels.

In another aspect, a device is configured to decode a bitstream representative of a higher order ambisonic audio signal. The device comprises means for obtaining, from the bitstream, an indication of a number of channels specified in one or more layers of the bitstream, and means for obtaining the channels specified in the one or more layers in the bitstream based on the indication of the number of channels.

In another aspect, a non-transitory computer-readable storage medium having stored thereon instructions that, when executed, cause one or more processors to obtain, from a bitstream representative of a higher order ambisonic audio signal, an indication of a number of channels specified in one or more layers of the bitstream, and obtain the channels specified in the one or more layers of the bitstream based on the indication of the number of channels.

In another aspect, a device is configured to encode a higher order ambisonic audio signal to generate a bitstream. The device comprises one or more processors configured to specify, in the bitstream, an indication of a number of channels specified in one or more layers of the bitstream, and specify the indicated number of the channels in the one or more layers of the bitstream, and a memory configured to store the bitstream.

In another aspect, a method of encoding a higher order ambisonic audio signal to generate a bitstream, the method comprises specifying, in the bitstream, an indication of a number of channels specified in one or more layers of the bitstream, and specifying the indicated number of the channels in the one or more layers of the bitstream.

The details of one or more aspects of the techniques are set forth in the accompanying drawings and the description below. Other features, objects, and advantages of the techniques will be apparent from the description and drawings, and from the claims.

DETAILED DESCRIPTION

Figure 1:
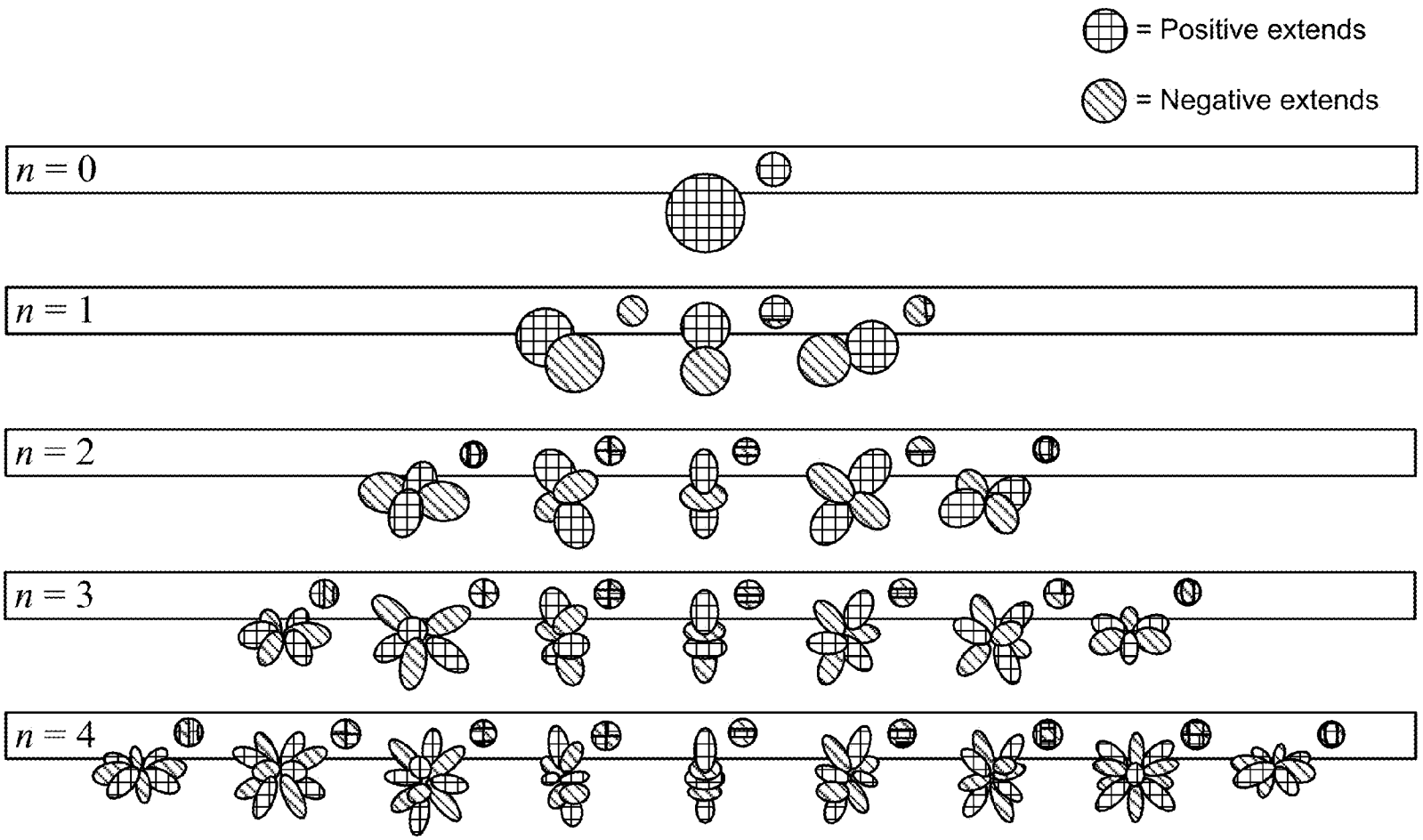
FIG. 1 is a diagram illustrating spherical harmonic basis functions of various orders and sub-orders.

The evolution of surround sound has made available many output formats for entertainment nowadays. Examples of such consumer surround sound formats are mostly 'channel' based in that they implicitly specify feeds to loudspeakers in certain geometrical coordinates. The consumer surround sound formats include the popular 5.1 format (which includes the following six channels: front left (FL), front right (FR), center or front center, back left or surround left, back right or surround right, and low frequency effects (LFE)), the growing 7.1 format, various formats that includes height speakers such as the 7.1.4 format and the 22.2 format (e.g., for use with the Ultra High Definition Television standard). Non-consumer formats can span any number of speakers (in symmetric and non-symmetric geometries) often termed 'surround arrays'. One example of such an array includes 32 loudspeakers positioned on coordinates on the corners of a truncated icosahedron.

The input to a future MPEG encoder is optionally one of three possible formats: (i) traditional channel-based audio (as discussed above), which is meant to be played through loudspeakers at pre-specified positions; (ii) object-based audio, which involves discrete pulse-code-modulation (PCM) data for single audio objects with associated metadata containing their location coordinates (amongst other information); and (iii) scene-based audio, which involves representing the soundfield using coefficients of spherical harmonic basis functions (also called "spherical harmonic coefficients" or SHC, "Higher-order Ambisonics" or HOA, and "HOA coefficients"). The future MPEG encoder may be described in more detail in a document entitled "Call for Proposals for 3D Audio," by the International Organization for Standardization/International Electrotechnical Commission (ISO)/(IEC) JTC1/SC29/WG11/N13411, released January 2013 in Geneva, Switzerland, and available at http://mpeg.chiariglione.org/sites/default/files/files/standards/parts/docs/w13411.zip.

There are various 'surround-sound' channel-based formats in the market. They range, for example, from the 5.1 home theatre system (which has been the most successful in terms of making inroads into living rooms beyond stereo) to the 22.2 system developed by NHK (Nippon Hoso Kyokai or Japan Broadcasting Corporation). Content creators (e.g., Hollywood studios) would like to produce the soundtrack for a movie once, and not spend effort to remix it for each speaker configuration. Recently, Standards Developing Organizations have been considering ways in which to provide an encoding into a standardized bitstream and a subsequent decoding that is adaptable and agnostic to the speaker geometry (and number) and acoustic conditions at the location of the playback (involving a renderer).

To provide such flexibility for content creators, a hierarchical set of elements may be used to represent a soundfield. The hierarchical set of elements may refer to a set of elements in which the elements are ordered such that a basic set of lower-ordered elements provides a full representation of the modeled soundfield. As the set is extended to include higher-order elements, the representation becomes more detailed, increasing resolution.

One example of a hierarchical set of elements is a set of spherical harmonic coefficients (SHC). The following expression demonstrates a description or representation of a soundfield using SHC:

$$p_i(t, r_r, \theta_r, \varphi_r] = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t},$$

The expression shows that the pressure $p_i$ at any point $\{r_r, \theta_r, \varphi_r\}$ of the soundfield, at time t, can be represented uniquely by the SHC, $A_n^m(k)$. Here, $$k = \frac{\omega}{c},$$

c is the speed of sound (~343 m/s), $\{r_r, \theta_r, \varphi_r\}$ is a point of reference (or observation point), $j_n(\cdot)$ is the spherical Bessel function of order n, and $Y_n^m(\theta_r, \varphi_r)$ are the spherical harmonic basis functions of order n and suborder m. It can be recognized that the term in square brackets is a frequency-domain representation of the signal (i.e., $S(\omega, r_r, \theta_r, \varphi_r)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions.

FIG. 1 is a diagram illustrating spherical harmonic basis functions from the zero order (n=0) to the fourth order (n=4). As can be seen, for each order, there is an expansion of suborders m which are shown but not explicitly noted in the example of FIG. 1 for ease of illustration purposes.

The SHC $A_n^m(k)$ can either be physically acquired (e.g., recorded) by various microphone array configurations or, alternatively, they can be derived from channel-based or object-based descriptions of the soundfield. The SHC represent scene-based audio, where the SHC may be input to an audio encoder to obtain encoded SHC that may promote more efficient transmission or storage. For example, a fourth-order representation involving $(1+4)^2$ (25, and hence fourth order) coefficients may be used.

As noted above, the SHC may be derived from a microphone recording using a microphone array. Various examples of how SHC may be derived from microphone arrays are described in Poletti, M., "Three-Dimensional Surround Sound Systems Based on Spherical Harmonics," J. Audio Eng. Soc., Vol. 53, No. 11, 2005 November, pp. 1004-1025.

To illustrate how the SHCs may be derived from an object-based description, consider the following equation. The coefficients $A_n^m(k)$ for the soundfield corresponding to an individual audio object may be expressed as:

$$A_n^m(k)=g(\omega)(-4\pi ik)h_n^{(2)}(kr_s)Y_n^{m*}(\theta_s,\varphi_s),$$

where i is $\sqrt{-1}$, $h_n^{(2)}(\cdot)$ is the spherical Hankel function (of the second kind) of order n, and $\{r_s, \theta_s, \varphi_s\}$ is the location of the object. Knowing the object source energy $g(\omega)$ as a function of frequency (e.g., using time-frequency analysis techniques, such as performing a fast Fourier transform on the PCM stream) allows us to convert each PCM object and the corresponding location into the SHC $A_n^m(k)$. Further, it can be shown (since the above is a linear and orthogonal decomposition) that the $A_n^m(k)$ coefficients for each object are additive. In this manner, a multitude of PCM objects can be represented by the $A_n^m(k)$ coefficients (e.g., as a sum of the coefficient vectors for the individual objects). Essentially, the coefficients contain information about the soundfield (the pressure as a function of 3D coordinates), and the above represents the transformation from individual objects to a representation of the overall soundfield, in the vicinity of the observation point $\{r_r, \theta_r, \varphi_r\}$. The remaining figures are described below in the context of object-based and SHC-based audio coding.

Figure 2:
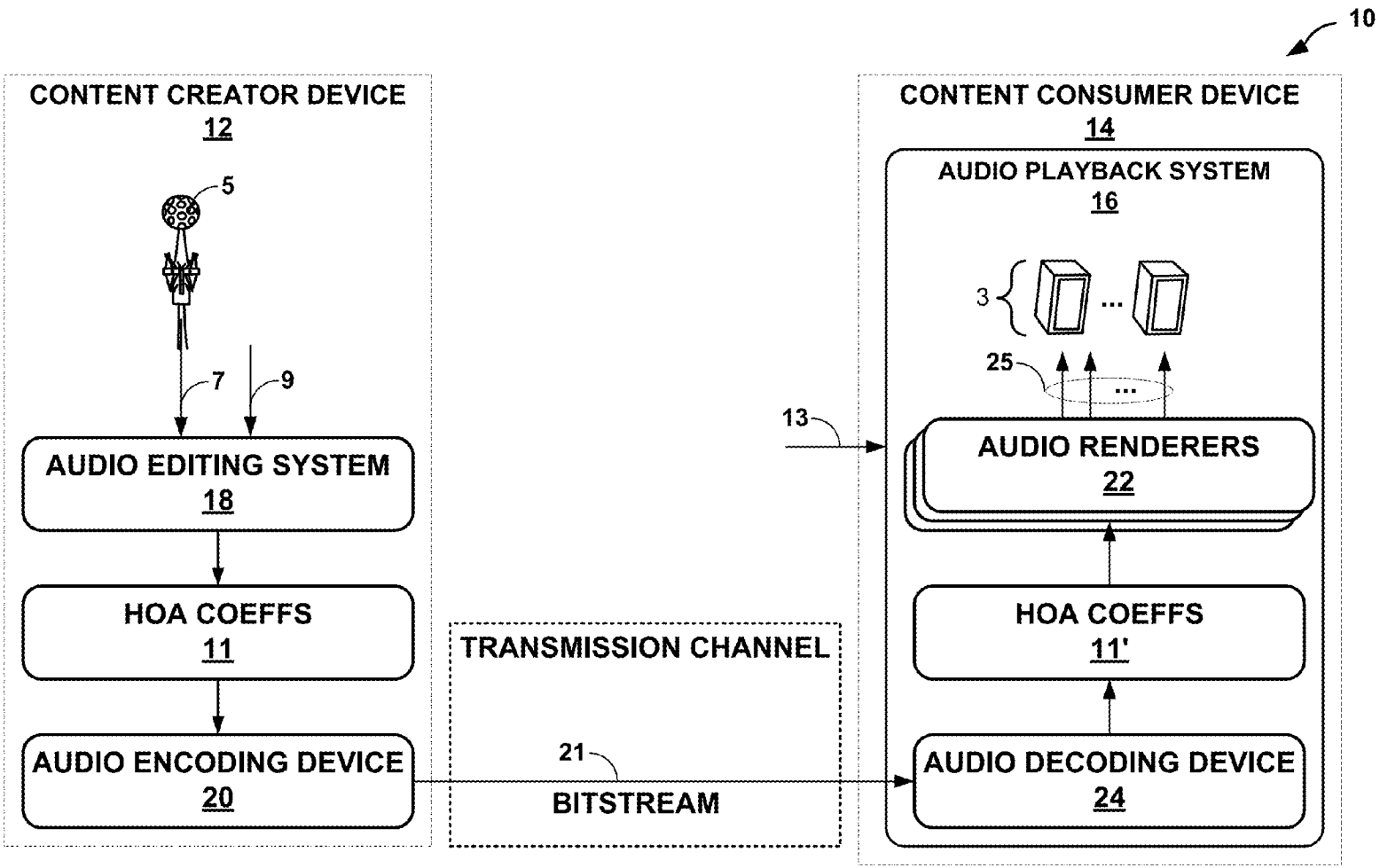
FIG. 2 is a diagram illustrating a system that may perform various aspects of the techniques described in this disclosure.

FIG. 2 is a diagram illustrating a system 10 that may perform various aspects of the techniques described in this disclosure. As shown in the example of FIG. 2, the system 10 includes a content creator device 12 and a content consumer device 14. While described in the context of the content creator device 12 and the content consumer device 14, the techniques may be implemented in any context in which SHCs (which may also be referred to as HOA coefficients) or any other hierarchical representation of a soundfield are encoded to form a bitstream representative of the audio data. Moreover, the content creator device 12 may represent any form of computing device capable of implementing the techniques described in this disclosure, including a handset (or cellular phone), a tablet computer, a smart phone, or a desktop computer to provide a few examples. Likewise, the content consumer device 14 may represent any form of computing device capable of implementing the techniques described in this disclosure, including a handset (or cellular phone), a tablet computer, a smart phone, a set-top box, or a desktop computer to provide a few examples.

The content creator device 12 may be operated by a movie studio or other entity that may generate multi-channel audio content for consumption by operators of content consumer devices, such as the content consumer device 14. In some examples, the content creator device 12 may be operated by an individual user who would like to compress HOA coefficients 11. Often, the content creator generates audio content in conjunction with video content. The content consumer device 14 may be operated by an individual. The content consumer device 14 may include an audio playback system 16, which may refer to any form of audio playback system capable of rendering SHC for play back as multi-channel audio content.

The content creator device 12 includes an audio editing system 18. The content creator device 12 obtain live recordings 7 in various formats (including directly as HOA coefficients) and audio objects 9, which the content creator device 12 may edit using audio editing system 18. A microphone 5 may capture the live recordings 7. The content creator may, during the editing process, render HOA coefficients 11 from audio objects 9, listening to the rendered speaker feeds in an attempt to identify various aspects of the soundfield that require further editing. The content creator device 12 may then edit HOA coefficients 11 (potentially indirectly through manipulation of different ones of the audio objects 9 from which the source HOA coefficients may be derived in the manner described above). The content creator device 12 may employ the audio editing system 18 to generate the HOA coefficients 11. The audio editing system 18 represents any system capable of editing audio data and outputting the audio data as one or more source spherical harmonic coefficients.

When the editing process is complete, the content creator device 12 may generate a bitstream 21 based on the HOA coefficients 11. That is, the content creator device 12 includes an audio encoding device 20 that represents a device configured to encode or otherwise compress HOA coefficients 11 in accordance with various aspects of the techniques described in this disclosure to generate the bitstream 21. The audio encoding device 20 may generate the bitstream 21 for transmission, as one example, across a transmission channel, which may be a wired or wireless channel, a data storage device, or the like. The bitstream 21 may represent an encoded version of the HOA coefficients 11 and may include a primary bitstream and another side bitstream, which may be referred to as side channel information.

While shown in FIG. 2 as being directly transmitted to the content consumer device 14, the content creator device 12 may output the bitstream 21 to an intermediate device positioned between the content creator device 12 and the content consumer device 14. The intermediate device may store the bitstream 21 for later delivery to the content consumer device 14, which may request the bitstream. The intermediate device may comprise a file server, a web server, a desktop computer, a laptop computer, a tablet computer, a mobile phone, a smart phone, or any other device capable of storing the bitstream 21 for later retrieval by an audio decoder. The intermediate device may reside in a content delivery network capable of streaming the bitstream 21 (and possibly in conjunction with transmitting a corresponding video data bitstream) to subscribers, such as the content consumer device 14, requesting the bitstream 21.

Alternatively, the content creator device 12 may store the bitstream 21 to a storage medium, such as a compact disc, a digital video disc, a high definition video disc or other storage media, most of which are capable of being read by a computer and therefore may be referred to as computer-readable storage media or non-transitory computer-readable storage media. In this context, the transmission channel may refer to the channels by which content stored to the mediums are transmitted (and may include retail stores and other store-based delivery mechanism). In any event, the techniques of this disclosure should not therefore be limited in this respect to the example of FIG. 2.

As further shown in the example of FIG. 2, the content consumer device 14 includes the audio playback system 16. The audio playback system 16 may represent any audio playback system capable of playing back multi-channel audio data. The audio playback system 16 may include a number of different renderers 22. The renderers 22 may each provide for a different form of rendering, where the different forms of rendering may include one or more of the various ways of performing vector-base amplitude panning (VBAP), and/or one or more of the various ways of performing soundfield synthesis. As used herein, "A and/or B" means "A or B", or both "A and B".

The audio playback system 16 may further include an audio decoding device 24. The audio decoding device 24 may represent a device configured to decode HOA coefficients 11' from the bitstream 21, where the HOA coefficients 11' may be similar to the HOA coefficients 11 but differ due to lossy operations (e.g., quantization) and/or transmission via the transmission channel. The audio playback system 16 may, after decoding the bitstream 21 to obtain the HOA coefficients 11' and render the HOA coefficients 11' to output loudspeaker feeds 25. The loudspeaker feeds 25 may drive one or more loudspeakers (which are not shown in the example of FIG. 2 for ease of illustration purposes).

To select the appropriate renderer or, in some instances, generate an appropriate renderer, the audio playback system 16 may obtain loudspeaker information 13 indicative of a number of loudspeakers and/or a spatial geometry of the loudspeakers. In some instances, the audio playback system 16 may obtain the loudspeaker information 13 using a reference microphone and driving the loudspeakers in such a manner as to dynamically determine the loudspeaker information 13. In other instances or in conjunction with the dynamic determination of the loudspeaker information 13, the audio playback system 16 may prompt a user to interface with the audio playback system 16 and input the loudspeaker information 13.

The audio playback system 16 may then select one of the audio renderers 22 based on the loudspeaker information 13. In some instances, the audio playback system 16 may, when none of the audio renderers 22 are within some threshold similarity measure (in terms of the loudspeaker geometry) to the loudspeaker geometry specified in the loudspeaker information 13, generate the one of audio renderers 22 based on the loudspeaker information 13. The audio playback system 16 may, in some instances, generate one of the audio renderers 22 based on the loudspeaker information 13 without first attempting to select an existing one of the audio renderers 22. One or more speakers 3 may then playback the rendered loudspeaker feeds 25. In other words, the speakers 3 may be configured to reproduce a soundfield based on higher order ambisonic audio data.

Figure 3:
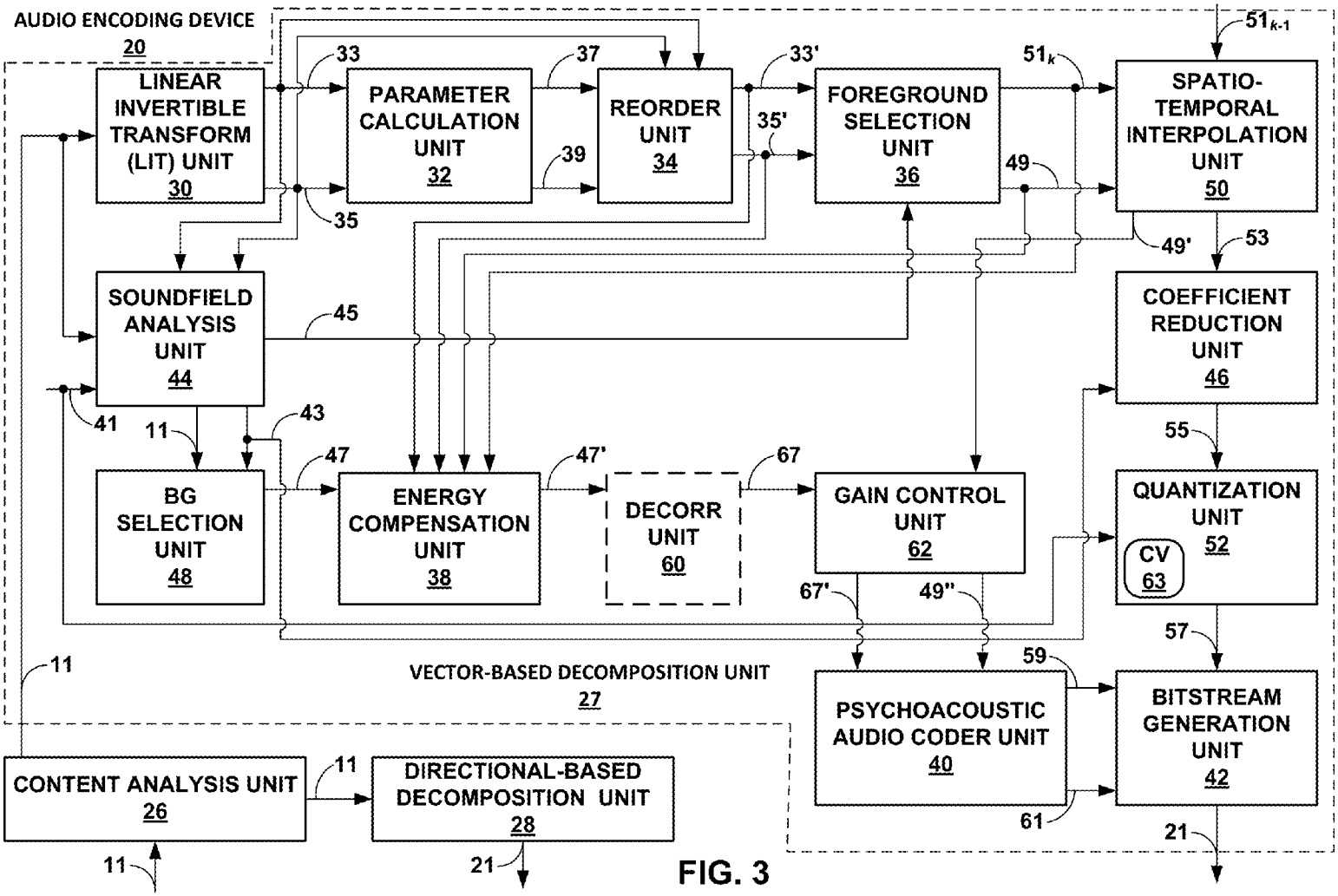
FIG. 3 is a block diagram illustrating, in more detail, one example of the audio encoding device shown in the example of FIG. 2 that may perform various aspects of the techniques described in this disclosure.

FIG. 3 is a block diagram illustrating, in more detail, one example of the audio encoding device 20 shown in the example of FIG. 2 that may perform various aspects of the techniques described in this disclosure. The audio encoding device 20 includes a content analysis unit 26, a vector-based decomposition unit 27 and a directional-based decomposition unit 28.

Although described briefly below, more information regarding the vector-based decomposition unit 27 and the various aspects of compressing HOA coefficients is available in International Patent Application Publication No. WO 2014/194099, entitled "INTERPOLATION FOR DECOMPOSED REPRESENTATIONS OF A SOUND FIELD," filed 29 May, 2014. In addition, more details of various aspects of the compression of the HOA coefficients in accordance with the MPEG-H 3D audio standard, including a discussion of the vector-based decomposition summarized below, can be found in:

ISO/IEC DIS 23008-3 document, entitled "Information technology—High efficiency coding and media delivery in heterogeneous environments—Part 3: 3D audio," by ISO/IEC JTC 1/SC 29/WG 11, dated 2014 Jul. 25 (available at: http://mpeg.chiariglione.org/standards/mpeg-h/3d-audio/dis-mpeg-h-3d-audio, hereinafter referred to as "phase I of the MPEG-H 3D audio standard");

ISO/IEC DIS 23008-3:2015/PDAM 3 document, entitled "Information technology—High efficiency coding and media delivery in heterogeneous environments—Part 3: 3D audio, AMENDMENT 3: MPEG-H 3D Audio Phase 2," by ISO/IEC JTC 1/SC 29/WG 11, dated 2015 Jul. 25 (available at: http://mpeg.chiariglione.org/standards/mpcg-h/3d-audio/text-isoiec-23008-3201xpdam-3-mpeg-h-3d-audio-phase-2, and hereinafter referred to as "phase II of the MPEG-H 3D audio standard"); and Jürgen Herre, et al., entitled "MPEG-H 3D Audio—The New Standard for Coding of Immersive Spatial Audio," dated August 2015 and published in Vol. 9, No. 5 of the IEEE Journal of Selected Topics in Signal Processing.

The content analysis unit 26 represents a unit configured to analyze the content of the HOA coefficients 11 to identify whether the HOA coefficients 11 represent content generated from a live recording or an audio object. The content analysis unit 26 may determine whether the HOA coefficients 11 were generated from a recording of an actual soundfield or from an artificial audio object. In some instances, when the framed HOA coefficients 11 were generated from a recording, the content analysis unit 26 passes the HOA coefficients 11 to the vector-based decomposition unit 27. In some instances, when the framed HOA coefficients 11 were generated from a synthetic audio object, the content analysis unit 26 passes the HOA coefficients 11 to the directional-based synthesis unit 28. The directional-based synthesis unit 28 may represent a unit configured to perform a directional-based synthesis of the HOA coefficients 11 to generate a directional-based bitstream 21.

As shown in the example of FIG. 3, the vector-based decomposition unit 27 may include a linear invertible transform (LIT) unit 30, a parameter calculation unit 32, a reorder unit 34, a foreground selection unit 36, an energy compensation unit 38, a decorrelation unit 60 (shown as "decorr unit 60"), a gain control unit 62, a psychoacoustic audio coder unit 40, a bitstream generation unit 42, a soundfield analysis unit 44, a coefficient reduction unit 46, a background (BG) selection unit 48, a spatio-temporal interpolation unit 50, and a quantization unit 52.

The linear invertible transform (LIT) unit 30 receives the HOA coefficients 11 in the form of HOA channels, each channel representative of a block or frame of a coefficient associated with a given order, sub-order of the spherical basis functions (which may be denoted as HOA[k], where k may denote the current frame or block of samples). The matrix of HOA coefficients 11 may have dimensions D: $M\times(N+1)^2$.

The LIT unit 30 may represent a unit configured to perform a form of analysis referred to as singular value decomposition. While described with respect to SVD, the techniques described in this disclosure may be performed with respect to any similar transformation or decomposition that provides for sets of linearly uncorrelated, energy compacted output. Also, reference to "sets" in this disclosure is generally intended to refer to non-zero sets unless specifically stated to the contrary and is not intended to refer to the classical mathematical definition of sets that includes the so-called "empty set." An alternative transformation may comprise a principal component analysis, which is often referred to as "PCA." Depending on the context, PCA may be referred to by a number of different names, such as discrete Karhunen-Loeve transform, the Hotelling transform, proper orthogonal decomposition (POD), and eigenvalue decomposition (EVD) to name a few examples. Properties of such operations that are conducive to one of the potential underlying goal of compressing audio data may include one or more of 'energy compaction' and 'decorrelation' of the multichannel audio data.

In any event, assuming the LIT unit 30 performs a singular value decomposition (which, again, may be referred to as "SVD") for purposes of example, the LIT unit 30 may transform the HOA coefficients 11 into two or more sets of transformed HOA coefficients. The "sets" of transformed HOA coefficients may include vectors of transformed HOA coefficients. In the example of FIG. 3, the LIT unit 30 may perform the SVD with respect to the HOA coefficients 11 to generate a so-called V matrix, an S matrix, and a U matrix. SVD, in linear algebra, may represent a factorization of a y-by-z real or complex matrix X (where X may represent multi-channel audio data, such as the HOA coefficients 11) in the following form:

$$X=USV^*$$

U may represent a y-by-y real or complex unitary matrix, where the y columns of U are known as the left-singular vectors of the multi-channel audio data. S may represent a y-by-z rectangular diagonal matrix with non-negative real numbers on the diagonal, where the diagonal values of S are known as the singular values of the multi-channel audio data. V* (which may denote a conjugate transpose of V) may represent a z-by-z real or complex unitary matrix, where the z columns of V* are known as the right-singular vectors of the multi-channel audio data.

In some examples, the V* matrix in the SVD mathematical expression referenced above is denoted as the conjugate transpose of the V matrix to reflect that SVD may be applied to matrices comprising complex numbers. When applied to matrices comprising only real-numbers, the complex conjugate of the V matrix (or, in other words, the V* matrix) may be considered to be the transpose of the V matrix. Below it is assumed, for ease of illustration purposes, that the HOA coefficients 11 comprise real-numbers with the result that the V matrix is output through SVD rather than the V* matrix. Moreover, while denoted as the V matrix in this disclosure, reference to the V matrix should be understood to refer to the transpose of the V matrix where appropriate. While assumed to be the V matrix, the techniques may be applied in a similar fashion to HOA coefficients 11 having complex coefficients, where the output of the SVD is the V* matrix. Accordingly, the techniques should not be limited in this respect to only provide for application of SVD to generate a V matrix, but may include application of SVD to HOA coefficients 11 having complex components to generate a V* matrix.

In this way, the LIT unit 30 may perform SVD with respect to the HOA coefficients 11 to output US[k] vectors 33 (which may represent a combined version of the S vectors and the U vectors) having dimensions D: $M\times(N+1)^2$, and V[k] vectors 35 having dimensions D: $(N+1)^2\times(N+1)^2$. Individual vector elements in the US[k] matrix may also be termed $X_{PS}(k)$ while individual vectors of the V[k] matrix may also be termed v(k).

An analysis of the U, S and V matrices may reveal that the matrices carry or represent spatial and temporal characteristics of the underlying soundfield represented above by X. Each of the N vectors in U (of length M samples) may represent normalized separated audio signals as a function of time (for the time period represented by M samples), that are orthogonal to each other and that have been decoupled from any spatial characteristics (which may also be referred to as directional information). The spatial characteristics, representing spatial shape and position (r, theta, phi) may instead be represented by individual $i^{th}$ vectors, $v^{(i)}(k)$, in the V matrix (each of length $(N+1)^2$).

The individual elements of each of $v^{(i)}(k)$ vectors may represent an HOA coefficient describing the shape (including width) and position of the soundfield for an associated audio object. Both the vectors in the U matrix and the V matrix are normalized such that their root-mean-square energies are equal to unity. The energy of the audio signals in U are thus represented by the diagonal elements in S. Multiplying U and S to form US[k] (with individual vector elements $X_{PS}(k)$), thus represent the audio signal with energies. The ability of the SVD decomposition to decouple the audio time-signals (in U), their energies (in S) and their spatial characteristics (in V) may support various aspects of the techniques described in this disclosure. Further, the model of synthesizing the underlying HOA[k] coefficients, X, by a vector multiplication of US[k] and V[k] gives rise the term "vector-based decomposition," which is used throughout this document.

Although described as being performed directly with respect to the HOA coefficients 11, the LIT unit 30 may apply the linear invertible transform to derivatives of the HOA coefficients 11. For example, the LIT unit 30 may apply SVD with respect to a power spectral density matrix derived from the HOA coefficients 11. By performing SVD with respect to the power spectral density (PSD) of the HOA coefficients rather than the coefficients themselves, the LIT unit 30 may potentially reduce the computational complexity of performing the SVD in terms of one or more of processor cycles and storage space, while achieving the same source audio encoding efficiency as if the SVD were applied directly to the HOA coefficients.

The parameter calculation unit 32 represents a unit configured to calculate various parameters, such as a correlation parameter (R), directional properties parameters (θ, φ, r), and an energy property (e). Each of the parameters for the current frame may be denoted as R[k], θ[k], φ[k], r[k] and e[k]. The parameter calculation unit 32 may perform an energy analysis and/or correlation (or so-called cross-correlation) with respect to the US[k] vectors 33 to identify the parameters. The parameter calculation unit 32 may also determine the parameters for the previous frame, where the previous frame parameters may be denoted R[k−1], θ[k−1], φ[k−1], r[k−1] and e[k−1], based on the previous frame of US[k−1] vector and V[k−1] vectors. The parameter calculation unit 32 may output the current parameters 37 and the previous parameters 39 to reorder unit 34.

The parameters calculated by the parameter calculation unit 32 may be used by the reorder unit 34 to re-order the audio objects to represent their natural evaluation or continuity over time. The reorder unit 34 may compare each of the parameters 37 from the first US[k] vectors 33 turn-wise against each of the parameters 39 for the second US[k−1] vectors 33. The reorder unit 34 may reorder (using, as one example, a Hungarian algorithm) the various vectors within the US[k] matrix 33 and the V [k] matrix 35 based on the current parameters 37 and the previous parameters 39 to output a reordered US[k] matrix 33' (which may be denoted mathematically as $\overline{US}[k]$) and a reordered V[k] matrix 35' (which may be denoted mathematically as $\overline{V}[k]$) to a foreground sound (or predominant sound—PS) selection unit 36 ("foreground selection unit 36") and an energy compensation unit 38.

The soundfield analysis unit 44 may represent a unit configured to perform a soundfield analysis with respect to the HOA coefficients 11 so as to potentially achieve a target bitrate 41. The soundfield analysis unit 44 may, based on the analysis and/or on a received target bitrate 41, determine the total number of psychoacoustic coder instantiations (which may be a function of the total number of ambient or background channels ($BG_{TOT}$) and the number of foreground channels or, in other words, predominant channels. The total number of psychoacoustic coder instantiations can be denoted as numHOATransportChannels.

The soundfield analysis unit 44 may also determine, again to potentially achieve the target bitrate 41, the total number of foreground channels (nFG) 45, the minimum order of the background (or, in other words, ambient) soundfield ($N_{BG}$ or, alternatively, MinAmbHOAorder), the corresponding number of actual channels representative of the minimum order of background soundfield (nBGa=(MinAmbHOAorder+1)$^2$), and indices (i) of additional BG HOA channels to send (which may collectively be denoted as background channel information 43 in the example of FIG. 3). The background channel information 42 may also be referred to as ambient channel information 43. Each of the channels that remains from numHOATransportChannels—nBGa, may either be an "additional background/ambient channel", an "active vector-based predominant channel", an "active directional based predominant signal" or "completely inactive". In one aspect, the channel types may be indicated (as a "ChannelType") syntax element by two bits (e.g. 00: directional based signal; 01: vector-based predominant signal; 10: additional ambient signal; 11: inactive signal). The total number of background or ambient signals, nBGa, may be given by (MinAmbHOAorder+1)$^2$+the number of times the index 10 (in the above example) appears as a channel type in the bitstream for that frame.

The soundfield analysis unit 44 may select the number of background (or, in other words, ambient) channels and the number of foreground (or, in other words, predominant) channels based on the target bitrate 41, selecting more background and/or foreground channels when the target bitrate 41 is relatively higher (e.g., when the target bitrate 41 equals or is greater than 512 Kbps). In one aspect, the numHOATransportChannels may be set to 8 while the MinAmbHOAorder may be set to 1 in the header section of the bitstream. In this scenario, at every frame, four channels may be dedicated to represent the background or ambient portion of the soundfield while the other 4 channels can, on a frame-by-frame basis vary on the type of channel—e.g., either used as an additional background/ambient channel or a foreground/predominant channel. The foreground/predominant signals can be one of either vector-based or directional based signals, as described above.

In some instances, the total number of vector-based predominant signals for a frame, may be given by the number of times the ChannelType index is 01 in the bitstream of that frame. In the above aspect, for every additional background/ambient channel (e.g., corresponding to a ChannelType of 10), corresponding information of which of the possible HOA coefficients (beyond the first four) may be represented in that channel. The information, for fourth order HOA content, may be an index to indicate the HOA coefficients 5-25. The first four ambient HOA coefficients 1-4 may be sent all the time when minAmbHOAorder is set to 1, hence the audio encoding device may only need to indicate one of the additional ambient HOA coefficient having an index of 5-25. The information could thus be sent using a 5 bits syntax element (for 4$^{th}$ order content), which may be denoted as "CodedAmbCoeffIdx." In any event, the soundfield analysis unit 44 outputs the background channel information 43 and the HOA coefficients 11 to the background (BG) selection unit 36, the background channel information 43 to coefficient reduction unit 46 and the bitstream generation unit 42, and the nFG 45 to a foreground selection unit 36.

The background selection unit 48 may represent a unit configured to determine background or ambient HOA coefficients 47 based on the background channel information (e.g., the background soundfield ($N_{BG}$) and the number (nBGa) and the indices (i) of additional BG HOA channels to send). For example, when $N_{BG}$ equals one, the background selection unit 48 may select the HOA coefficients 11 for each sample of the audio frame having an order equal to or less than one. The background selection unit 48 may, in this example, then select the HOA coefficients 11 having an index identified by one of the indices (i) as additional BG HOA coefficients, where the nBGa is provided to the bitstream generation unit 42 to be specified in the bitstream 21 so as to enable the audio decoding device, such as the audio decoding device 24 shown in the example of FIGS. 2 and 4, to parse the background HOA coefficients 47 from the bitstream 21. The background selection unit 48 may then output the ambient HOA coefficients 47 to the energy compensation unit 38. The ambient HOA coefficients 47 may have dimensions D: M×[($N_{BG}$+1)$^2$ nBGa]. The ambient HOA coefficients 47 may also be referred to as "ambient HOA coefficients 47," where each of the ambient HOA coefficients 47 corresponds to a separate ambient HOA channel 47 to be encoded by the psychoacoustic audio coder unit 40.

The foreground selection unit 36 may represent a unit configured to select the reordered US[k] matrix 33' and the reordered V[k] matrix 35' that represent foreground or distinct components of the soundfield based on nFG 45 (which may represent a one or more indices identifying the foreground vectors). The foreground selection unit 36 may output nFG signals 49 (which may be denoted as a reordered $US[k]_{1,\ldots,nFG}$ 49, $FG_{1,\ldots,nfG}[k]$ 49, or $X_{PS}^{(1\ldots nFG)}(k)$ 49) to the psychoacoustic audio coder unit 40, where the nFG signals 49 may have dimensions D: M×nFG and each represent mono-audio objects. The foreground selection unit 36 may also output the reordered V[k] matrix 35' (or $v^{(1\ldots nFG)}(k)$ 35') corresponding to foreground components of the soundfield to the spatio-temporal interpolation unit 50, where a subset of the reordered V[k] matrix 35' corresponding to the foreground components may be denoted as foreground V[k] matrix $\mathbf{51}_k$ (which may be mathematically denoted $\overline{V}_{1,\ldots,nFG}[k]$) having dimensions D: (N+1)$^2$×nFG.

The energy compensation unit 38 may represent a unit configured to perform energy compensation with respect to the ambient HOA coefficients 47 to compensate for energy loss due to removal of various ones of the HOA channels by the background selection unit 48. The energy compensation unit 38 may perform an energy analysis with respect to one or more of the reordered US[k] matrix 33', the reordered V[k] matrix 35', the nFG signals 49, the foreground V[k] vectors $\mathbf{51}_k$ and the ambient HOA coefficients 47 and then perform energy compensation based on the energy analysis to generate energy compensated ambient HOA coefficients 47'. The energy compensation unit 38 may output the energy compensated ambient HOA coefficients 47' to the decorrelation unit 60.

The decorrelation unit 60 may represent a unit configured to implement various aspects of the techniques described in this disclosure to reduce or eliminate correlation between the energy compensated ambient HOA coefficients 47' to form one or more decorrelated ambient HOA audio signals 67. The decorrelation unit 40' may output the decorrelated HOA audio signals 67 to the gain control unit 62. The gain control unit 62 may represent a unit configured to perform automatic gain control (which may be abbreviated as "AGC") with respect to the decorrelated ambient HOA audio signals 67 to obtain gain controlled ambient HOA audio signals 67'. After applying the gain control, the automatic gain control unit 62 may provide the gain controlled ambient HOA audio signals 67' to the psychoacoustic audio coder unit 40.

The decorrelation unit 60 included within the audio encoding device 20 may represent single or multiple instances of a unit configured to apply one or more decorrelation transforms to the energy compensated ambient HOA coefficients 47', to obtain the decorrelated HOA audio signals 67. In some examples, the decorrelation unit 40' may apply a UHJ matrix to the energy compensated ambient HOA coefficients 47'. At various instances of this disclosure, the UHJ matrix may also be referred to as a "phase-based transform." Application of the phase-based transform may also be referred to herein as "phaseshift decorrelation."

Ambisonic UHJ format is a development of the Ambisonic surround sound system designed to be compatible with mono and stereo media. The UHJ format includes a hierarchy of systems in which the recorded soundfield will be reproduced with a degree of accuracy that varies according to the available channels. In various instances, UHJ is also referred to as "C-Format". The initials indicate some of sources incorporated into the system: U from Universal (UD-4); H from Matrix H; and J from System 45J.

UHJ is a hierarchical system of encoding and decoding directional sound information within Ambisonics technology. Depending on the number of channels available, a system can carry more or less information. UHJ is fully stereo- and mono-compatible. Up to four channels (L, R, T, Q) may be used.

In one form, 2-channel (L, R) UHJ, horizontal (or "planar") surround information can be carried by normal stereo signal channels—CD, FM or digital radio, etc.—which may be recovered by using a UHJ decoder at the listening end. Summing the two channels may yield a compatible mono signal, which may be a more accurate representation of the two-channel version than summing a conventional "panpotted mono" source. If a third channel (T) is available, the third channel can be used to yield improved localization accuracy to the planar surround effect when decoded via a 3-channel UHJ decoder. The third channel may not be not required to have full audio bandwidth for this purpose, leading to the possibility of so-called "2½-channel" systems, where the third channel is bandwidth-limited. In one example, the limit may be 5 kHz. The third channel can be broadcast via FM radio, for example, by means of phase-quadrature modulation. Adding a fourth channel (Q) to the UHJ system may allow the encoding of full surround sound with height, sometimes referred to n as Periphony, with a level of accuracy identical to 4-channel B-Format.

2-channel UHJ is a format commonly used for distribution of Ambisonic recordings. 2-channel UHJ recordings can be transmitted via all normal stereo channels and any of the normal 2-channel media can be used with no alteration. UHJ is stereo compatible in that, without decoding, the listener may perceive a stereo image, but one that is significantly wider than conventional stereo (e.g., so-called "Super Stereo"). The left and right channels can also be summed for a very high degree of mono-compatibility. Replayed via a UHJ decoder, the surround capability may be revealed.

An example mathematical representation of the decorrelation unit 60 applying the UHJ matrix (or phase-based transform) is as follows:

UHJ encoding:

$$S=(0.9397*W)+(0.1856*X);$$

$$D=\text{imag}(\text{hilbert}((-0.3420*W)+(0.5099*X)))+(0.6555*Y);$$

$$T=\text{imag}(\text{hilbert}((-0.1432*W)+(0.6512*X)))-(0.7071*Y);$$

$$Q=0.9772*Z;$$

conversion of S and D to Left and Right:

$$\text{Left}=(S+D)/2$$

$$\text{Right}=(S-D)/2$$

According to some implementations of the calculations above, assumptions with respect to the calculations above may include the following: HOA Background channel are 1st order Ambisonics, FuMa normalized, in the Ambisonics channel numbering order W (a00), X(a11), Y(a11−), Z(a10).

In the calculations listed above, the decorrelation unit 40' may perform a scalar multiplication of various matrices by constant values. For instance, to obtain the S signal, the decorrelation unit 60 may perform scalar multiplication of a W matrix by the constant value of 0.9397 (e.g., by scalar multiplication), and of an X matrix by the constant value of 0.1856. As also illustrated in the calculations listed above, the decorrelation unit 60 may apply a Hilbert transform (denoted by the "Hilbert ( )" function in the above UHJ encoding) in obtaining each of the D and T signals. The "imag( )" function in the above UHJ encoding indicates that the imaginary (in the mathematical sense) of the result of the Hilbert transform is obtained.

Another example mathematical representation of the decorrelation unit 60 applying the UHJ matrix (or phase-based transform) is as follows:

UHJ Encoding:

$$S=(0.9396926*W)+(0.151520536509082*X);$$

$$D=\text{imag}(\text{hilbert}((-0.3420201*W)+(0.416299273350443*X)))+(0.535173990363608*Y);$$

$$T=0.940604061228740*(\text{imag}(\text{hilbert}((-0.1432*W)+(0.531702573500135*X)))-(0.577350269189626*Y));$$

$$Q=Z;$$

conversion of S and D to Left and Right:

$$\text{Left}=(S+D)/2;$$

$$\text{Right}=(S-D)/2;$$

In some example implementations of the calculations above, assumptions with respect to the calculations above may include the following: HOA Background channel are 1st order Ambisonics, N3D (or "full three-D") normalized, in the Ambisonics channel numbering order W (a00), X(a11), Y(a11−), Z(a10). Although described herein with respect to N3D normalization, it will be appreciated that the example calculations may also be applied to HOA background channels that are SN3D normalized (or "Schmidt semi-normalized). N3D and SN3D normalization may differ in terms of the scaling factors used. An example representation of N3D normalization, relative to SN3D normalization, is expressed below:

$$N_{l,m}^{N3D} = N_{l,m}^{SN3D}\sqrt{2l+1}$$

An example of weighting coefficients used in SN3D normalization is expressed below:

$$N_{l,m}^{SN3D} = \sqrt{\frac{2-\delta m(l-|m|)!}{4\pi(l+|m|)!}},$$

$$\delta m \begin{cases} 1 & \text{if } m = 0 \\ 0 & \text{if } m \neq 0 \end{cases}$$

In the calculations listed above, the decorrelation unit 60 may perform a scalar multiplication of various matrices by constant values. For instance, to obtain the S signal, the decorrelation unit 60 may perform scalar multiplication of a W matrix by the constant value of 0.9396926 (e.g., by scalar multiplication), and of an X matrix by the constant value of 0.151520536509082. As also illustrated in the calculations listed above, the decorrelation unit 60 may apply a Hilbert transform (denoted by the "Hilbert ( )" function in the above UHJ encoding or phaseshift decorrelation) in obtaining each of the D and T signals. The "imag( )" function in the above UHJ encoding indicates that the imaginary (in the mathematical sense) of the result of the Hilbert transform is obtained.

The decorrelation unit 60 may perform the calculations listed above, such that the resulting S and D signals represent left and right audio signals (or in other words stereo audio signals). In some such scenarios, the decorrelation unit 60 may output the T and Q signals as part of the decorrelated ambient HOA audio signals 67, but a decoding device that receives the bitstream 21 may not process the T and Q signals when rendering to a stereo speaker geometry (or, in other words, stereo speaker configuration). In examples, the ambient HOA coefficients 47' may represent a soundfield to be rendered on a mono-audio reproduction system. The decorrelation unit 60 may output the S and D signals as part of the decorrelated ambient HOA audio signals 67, and a decoding device that receives the bitstream 21 may combine (or "mix") the S and D signals to form an audio signal to be rendered and/or output in mono-audio format.

In these examples, the decoding device and/or the reproduction device may recover the mono-audio signal in various ways. One example is by mixing the left and right signals (represented by the S and D signals). Another example is by applying a UHJ matrix (or phase-based transform) to decode a W signal. By producing a natural left signal and a natural right signal in the form of the S and D signals by applying the UHJ matrix (or phase-based transform), the decorrelation unit 60 may implement techniques of this disclosure to provide potential advantages and/or potential improvements over techniques that apply other decorrelation transforms (such as a mode matrix described in the MPEG-H standard).

In various examples, the decorrelation unit 60 may apply different decorrelation transforms, based on a bit rate of the received energy compensated ambient HOA coefficients 47'. For example, the decorrelation unit 60 may apply the UHJ matrix (or phase-based transform) described above in scenarios where the energy compensated ambient HOA coefficients 47' represent a four-channel input. More specifically, based on the energy compensated ambient HOA coefficients 47' representing a four-channel input, the decorrelation unit 60 may apply a 4×4 UHJ matrix (or phase-based transform). For instance, the 4×4 matrix may be orthogonal to the four-channel input of the energy compensated ambient HOA coefficients 47'. In other words, in instances where the energy compensated ambient HOA coefficients 47' represent a lesser number of channels (e.g., four), the decorrelation unit 60 may apply the UHJ matrix as the selected decorrelation transform, to decorrelate the background signals of the energy compensated ambient HOA signals 47' to obtain the decorrelated ambient HOA audio signals 67.

According to this example, if the energy compensated ambient HOA coefficients 47' represent a greater number of channels (e.g., nine), the decorrelation unit 60 may apply a decorrelation transform different from the UHJ matrix (or phase-based transform). For instance, in a scenario where the energy compensated ambient HOA coefficients 47' represent a nine-channel input, the decorrelation unit 60 may apply a mode matrix (e.g., as described in phase I of the MPEG-H 3D audio standard referenced above), to decorrelate the energy compensated ambient HOA coefficients 47'. In examples where the energy compensated ambient HOA coefficients 47' represent a nine-channel input, the decorrelation unit 60 may apply a 9×9 mode matrix to obtain the decorrelated ambient HOA audio signals 67.

In turn, various components of the audio encoding device 20 (such as the psychoacoustic audio coder 40) may perceptually code the decorrelated ambient HOA audio signals 67 according to AAC or USAC. The decorrelation unit 60 may apply the phaseshift decorrelation transform (e.g., the UHJ matrix or phase-based transform in case of a four-channel input), to potentially optimize the AAC/USAC coding for HOA. In examples where the energy compensated ambient HOA coefficients 47' (and thereby, the decorrelated ambient HOA audio signals 67) represent audio data to be rendered on a stereo reproduction system, the decorrelation unit 60 may apply the techniques of this disclosure to improve or optimize compression, based on AAC and USAC being relatively oriented (or optimized for) stereo audio data.

It will be understood that the decorrelation unit 60 may apply the techniques described herein in situations where the energy compensated ambient HOA coefficients 47' include foreground channels, as well in situations where the energy compensated ambient HOA coefficients 47' do not include any foreground channels. As one example, the decorrelation unit 40' may apply the techniques and/or calculations described above, in a scenario where the energy compensated ambient HOA coefficients 47' include zero (0) foreground channels and four (4) background channels (e.g., a scenario of a lower/lesser bit rate).

In some examples, the decorrelation unit 60 may cause the bitstream generation unit 42 to signal, as part of the vector-based bitstream 21, one or more syntax elements that indicate that the decorrelation unit 60 applied a decorrelation transform to the energy compensated ambient HOA coefficients 47'. By providing such an indication to a decoding device, the decorrelation unit 60 may enable the decoding device to perform reciprocal decorrelation transforms on audio data in the HOA domain. In some examples, the decorrelation unit 60 may cause the bitstream generation unit 42 to signal syntax elements that indicate which decorrelation transform was applied, such as the UHJ matrix (or other phase based transform) or the mode matrix.

The decorrelation unit 60 may apply a phase-based transform to the energy compensated ambient HOA coefficient 47'. The phase-based transform for the first $O_{MIN}$ HOA coefficient sequences of $C_{AMB}(k-1)$ is defined by $$\begin{bmatrix} x_{AMB,LOW,1}(k-2) \\ x_{AMB,LOW,2}(k-2) \\ x_{AMB,LOW,3}(k-2) \\ x_{AMB,LOW,4}(k-2) \end{bmatrix} = \begin{bmatrix} d(9)\cdot(S(k-2)+M(k-2)) \\ d(9)\cdot(M(k-2)-S(k-2)) \\ d(8)\cdot(B_{+90}(k-2)+d(5)\cdot c_{AMB,2}(k-2)) \\ c_{AMB,3}(k-2) \end{bmatrix},$$

with the coefficients d as defined in Table 1, the signal frames S(k−2) and M(k−2) being defined by $$S(k-2)=A_{+90}(k-2)+d(6)\cdot C_{AMB,2}(k-2)$$

$$M(k-2)=d(4)\cdot C_{AMB,1}(k-2)+d(5)\cdot c_{AMB,4}(k-2)$$

and $A_{+90}(k-2)$ and $B_{+90}(k-2)$ are the frames of +90 degree phase shifted signals A and B defined by $$A(k-2)=d(0)\cdot c_{AMB,LOW,1}(k-2)+d(1)\cdot c_{AMB,4}(k-2)$$

$$B(k-2)=d(2)\cdot C_{AMB,LOW,1}(k-2)+d(3)\cdot c_{AMB,4}(k-2).$$

The phase-based transform for the first $O_{MIN}$ HOA coefficient sequences of $C_{P,AMB}$ (k−1) is defined accordingly. The transform described may introduce a delay of one frame.

In the foregoing, the $X_{AMB,LOW,1}(k-2)$ through $x_{AMB,LOW,4}(k-^2)$ may correspond to decorrelated ambient HOA audio signals 67. In the foregoing equation, the variable $C_{AMB,1}(k)$ variable denotes the HOA coefficients for the $k^{th}$ frame corresponding to the spherical basis functions having an (order:sub-order) of (0:0), which may also be referred to as the 'W' channel or component. The variable $C_{AMB,2}(k)$ variable denotes the HOA coefficients for the $k^{th}$ frame corresponding to the spherical basis functions having an (order:sub-order) of (1:−1), which may also be referred to as the 'Y' channel or component. The variable $C_{AMB,3}(k)$ variable denotes the HOA coefficients for the $k^{th}$ frame corresponding to the spherical basis functions having an (order:sub-order) of (1:0), which may also be referred to as the 'Z' channel or component. The variable $C_{AMB,4}(k)$ variable denotes the HOA coefficients for the $k^{th}$ frame corresponding to the spherical basis functions having an (order:sub-order) of (1:1), which may also be referred to as the 'X' channel or component. The $C_{AMB,1}(k)$ through $C_{AMB,3}(k)$ may correspond to ambient HOA coefficients 47'.

Table 1 below illustrates an example of coefficients that the decorrelation unit 40 may use for performing a phase-based transform.

TABLE 1

Coefficients for phase-based transform

| n | d(n) |
|---|---|
| 0 | 0.34202009999999999 |
| 1 | 0.41629927335044281 |
| 2 | 0.14319999999999999 |
| 3 | 0.53170257350013528 |
| 4 | 0.93969259999999999 |
| 5 | 0.15152053650908184 |
| 6 | 0.53517399036360758 |
| 7 | 0.57735026918962584 |
| 8 | 0.94060406122874030 |
| 9 | 0.500000000000000 |

In some examples, various components of the audio encoding device 20 (such as the bitstream generation unit 42) may be configured to transmit only first order HOA representations for lower target bitrates (e.g., a target bitrate of 128K or 256K). According to some such examples, the audio encoding device 20 (or components thereof, such as the bitstream generation unit 42) may be configured to discard higher order HOA coefficients (e.g., coefficients with a greater order than the first order, or in other words, N>1). However, in examples where the audio encoding device 20 determines that the target bitrate is relatively high, the audio encoding device 20 (e.g., the bitstream generation unit 42) may separate the foreground and background channels, and may assign bits (e.g., in greater amounts) to the foreground channels.

Although described as being applied to the energy compensated ambient HOA coefficients 47', the audio encoding device 20 may not apply decorrelation to the energy compensated ambient HOA coefficients 47'. Instead, energy compensation unit 38 may provide the energy compensated ambient HOA coefficients 47' directly to the gain control unit 62, which may perform automatic gain control with respect to the energy compensated ambient HOA coefficients 47'. As such, the decorrelation unit 60 is shown as a dashed line to indicate that the decorrelation unit may not always perform decorrelation or be included in the audio decoding device 20.

The spatio-temporal interpolation unit 50 may represent a unit configured to receive the foreground V[k] vectors $\mathbf{51}_k$ for the $k^{th}$ frame and the foreground V[k−1] vectors $\mathbf{51}_{k-1}$ for the previous frame (hence the k−1 notation) and perform spatio-temporal interpolation to generate interpolated foreground V[k] vectors. The spatio-temporal interpolation unit 50 may recombine the nFG signals 49 with the foreground V[k] vectors $\mathbf{51}_k$ to recover reordered foreground HOA coefficients. The spatio-temporal interpolation unit 50 may then divide the reordered foreground HOA coefficients by the interpolated V[k] vectors to generate interpolated nFG signals 49'.

The spatio-temporal interpolation unit 50 may also output the foreground V[k] vectors $\mathbf{51}_k$ that were used to generate the interpolated foreground V[k] vectors so that an audio decoding device, such as the audio decoding device 24, may generate the interpolated foreground V[k] vectors and thereby recover the foreground V[k] vectors $\mathbf{51}_k$. The foreground V[k] vectors $\mathbf{51}_k$ used to generate the interpolated foreground V[k] vectors are denoted as the remaining foreground V[k] vectors 53. In order to ensure that the same V[k] and V[k−1] are used at the encoder and decoder (to create the interpolated vectors V[k]) quantized/dequantized versions of the vectors may be used at the encoder and decoder. The spatio-temporal interpolation unit 50 may output the interpolated nFG signals 49' to the gain control unit 62 and the interpolated foreground V[k] vectors $\mathbf{51}_k$ to the coefficient reduction unit 46.

The gain control unit 62 may also represent a unit configured to perform automatic gain control (which may be abbreviated as "AGC") with respect to the interpolated nFG signals 49' to obtain gain controlled nFG signals 49". After applying the gain control, the automatic gain control unit 62 may provide the gain controlled nFG signals 49" to the psychoacoustic audio coder unit 40.

The coefficient reduction unit 46 may represent a unit configured to perform coefficient reduction with respect to the remaining foreground V[k] vectors 53 based on the background channel information 43 to output reduced foreground V[k] vectors 55 to the quantization unit 52. The reduced foreground V[k] vectors 55 may have dimensions D: $[(N+1)^2-(N_{BG}+1)^2-BG_{TOT}]\times nFG$. The coefficient reduction unit 46 may, in this respect, represent a unit configured to reduce the number of coefficients in the remaining foreground V[k] vectors 53. In other words, coefficient reduction unit 46 may represent a unit configured to eliminate the coefficients in the foreground V[k] vectors (that form the remaining foreground V[k] vectors 53) having little to no directional information. In some examples, the coefficients of the distinct or, in other words, foreground V[k] vectors corresponding to a first and zero order basis functions (which may be denoted as $N_{BG}$) provide little directional information and therefore can be removed from the foreground V-vectors (through a process that may be referred to as "coefficient reduction"). In this example, greater flexibility may be provided to not only identify the coefficients that correspond $N_{BG}$ but to identify additional HOA channels (which may be denoted by the variable TotalOfAddAmbHOAChan) from the set of $[(N_{BG}+1)^2+1, (N+1)^2]$.

The quantization unit 52 may represent a unit configured to perform any form of quantization to compress the reduced foreground V[k] vectors 55 to generate coded foreground V[k] vectors 57, outputting the coded foreground V[k] vectors 57 to the bitstream generation unit 42. In operation, the quantization unit 52 may represent a unit configured to compress a spatial component of the soundfield, i.e., one or more of the reduced foreground V[k] vectors 55 in this example. The quantization unit 52 may perform any one of the following 12 quantization modes set forth in phase I or phase II of the MPEG-H 3D audio coding standard referenced above. The quantization unit 52 may also perform predicted versions of any of the foregoing types of quantization modes, where a difference is determined between an element of (or a weight when vector quantization is performed) of the V-vector of a previous frame and the element (or weight when vector quantization is performed) of the V-vector of a current frame is determined. The quantization unit 52 may then quantize the difference between the elements or weights of the current frame and previous frame rather than the value of the element of the V-vector of the current frame itself. The quantization unit 52 may provide the coded foreground V[k] vectors 57 to the bitstream generation unit 42. The quantization unit 52 may also provide the syntax elements indicative of the quantization mode (e.g., the NbitsQ syntax element) and any other syntax elements used to dequantize or otherwise reconstruct the V-vector.

The psychoacoustic audio coder unit 40 included within the audio encoding device 20 may represent multiple instances of a psychoacoustic audio coder, each of which is used to encode a different audio object or HOA channel of each of the energy compensated ambient HOA coefficients 47' and the interpolated nFG signals 49' to generate encoded ambient HOA coefficients 59 and encoded nFG signals 61. The psychoacoustic audio coder unit 40 may output the encoded ambient HOA coefficients 59 and the encoded nFG signals 61 to the bitstream generation unit 42.

The bitstream generation unit 42 included within the audio encoding device 20 represents a unit that formats data to conform to a known format (which may refer to a format known by a decoding device), thereby generating the vector-based bitstream 21. The bitstream 21 may, in other words, represent encoded audio data, having been encoded in the manner described above. The bitstream generation unit 42 may represent a multiplexer in some examples, which may receive the coded foreground V[k] vectors 57, the encoded ambient HOA coefficients 59, the encoded nFG signals 61 and the background channel information 43. The bitstream generation unit 42 may then generate a bitstream 21 based on the coded foreground V[k] vectors 57, the encoded ambient HOA coefficients 59, the encoded nFG signals 61 and the background channel information 43. In this way, the bitstream generation unit 42 may thereby specify the vectors 57 in the bitstream 21 to obtain the bitstream 21. The bitstream 21 may include a primary or main bitstream and one or more side channel bitstreams.

Although not shown in the example of FIG. 3, the audio encoding device 20 may also include a bitstream output unit that switches the bitstream output from the audio encoding device 20 (e.g., between the directional-based bitstream 21 and the vector-based bitstream 21) based on whether a current frame is to be encoded using the directional-based synthesis or the vector-based synthesis. The bitstream output unit may perform the switch based on the syntax element output by the content analysis unit 26 indicating whether a directional-based synthesis was performed (as a result of detecting that the HOA coefficients 11 were generated from a synthetic audio object) or a vector-based synthesis was performed (as a result of detecting that the HOA coefficients were recorded). The bitstream output unit may specify the correct header syntax to indicate the switch or current encoding used for the current frame along with the respective one of the bitstreams 21.

Moreover, as noted above, the soundfield analysis unit 44 may identify $BG_{TOT}$ ambient HOA coefficients 47, which may change on a frame-by-frame basis (although at times $BG_{TOT}$ may remain constant or the same across two or more adjacent (in time) frames). The change in $BG_{TOT}$ may result in changes to the coefficients expressed in the reduced foreground V[k] vectors 55. The change in $BG_{TOT}$ may result in background HOA coefficients (which may also be referred to as "ambient HOA coefficients") that change on a frame-by-frame basis (although, again, at times $BG_{TOT}$ may remain constant or the same across two or more adjacent (in time) frames). The changes often result in a change of energy for the aspects of the sound field represented by the addition or removal of the additional ambient HOA coefficients and the corresponding removal of coefficients from or addition of coefficients to the reduced foreground V[k] vectors 55.

As a result, the soundfield analysis unit 44 may further determine when the ambient HOA coefficients change from frame to frame and generate a flag or other syntax element indicative of the change to the ambient HOA coefficient in terms of being used to represent the ambient components of the sound field (where the change may also be referred to as a "transition" of the ambient HOA coefficient or as a "transition" of the ambient HOA coefficient). In particular, the coefficient reduction unit 46 may generate the flag (which may be denoted as an AmbCoeffTransition flag or an AmbCoeffIdxTransition flag), providing the flag to the bitstream generation unit 42 so that the flag may be included in the bitstream 21 (possibly as part of side channel information).

The coefficient reduction unit 46 may, in addition to specifying the ambient coefficient transition flag, also modify how the reduced foreground V[k] vectors 55 are generated. In one example, upon determining that one of the ambient HOA ambient coefficients is in transition during the current frame, the coefficient reduction unit 46 may specify, a vector coefficient (which may also be referred to as a "vector element" or "element") for each of the V-vectors of the reduced foreground V[k] vectors 55 that corresponds to the ambient HOA coefficient in transition. Again, the ambient HOA coefficient in transition may add or remove from the $BG_{TOT}$ total number of background coefficients. Therefore, the resulting change in the total number of background coefficients affects whether the ambient HOA coefficient is included or not included in the bitstream, and whether the corresponding element of the V-vectors are included for the V-vectors specified in the bitstream in the second and third configuration modes described above. More information regarding how the coefficient reduction unit 46 may specify the reduced foreground V[k] vectors 55 to overcome the changes in energy is provided in U.S. application Ser. No. 14/594,533, entitled "TRANSITIONING OF AMBIENT HIGHER_ORDER AMBISONIC COEFFICIENTS," filed Jan. 12, 2015.

In this respect, the bitstream generation unit 42 may generate a bitstream 21 in a wide variety of different encoding schemes, which may facilitate flexible bitstream generation to accommodate a large number of different content delivery contexts. One context that appears to be gaining traction within the audio industry is the delivery (or, in other words, "streaming") of audio data via networks to a growing number of different playback devices. Delivering audio content via bandwidth constricted networks to devices having varying degrees of playback capabilities may be difficult, especially in the context of HOA audio data that permit a high degree of 3D audio fidelity during playback at an expense of large bandwidth consumption (relative to channel- or object-based audio data).

In accordance with the techniques described in this disclosure, the bitstream generation unit 42 may utilize one or more scalable layers to allow for various reconstructions of the HOA coefficients 11. Each of the layers may be hierarchical. For example, a first layer (which may be referred to as a "base layer") may provide a first reconstruction of the HOA coefficients that permits for stereo loudspeaker feeds to be rendered. A second layer (which may be referred to as a first "enhancement layer") may, when applied to the first reconstruction of the HOA coefficients, scale the first reconstruction of the HOA coefficient to permit for horizontal surround sound loudspeaker feeds (e.g., 5.1 loudspeaker feeds) to be rendered. A third layer (which may be referred to as a second "enhancement layer") may provide may, when applied to the second reconstruction of the HOA coefficients, scale the first reconstruction of the HOA coefficient to permit for 3D surround sound loudspeaker feeds (e.g., 22.2 loudspeaker feeds) to be rendered. In this respect, the layers may be considered to hierarchical scale a previous layer. In other words, the layers are hierarchical such that a first layer, when combined with a second layer, provides a higher resolution representation of the higher order ambisonic audio signal.

Although described above as allowing for scaling of an immediately preceding layer, any layer above another layer may scale the lower layer. In other words, the third layer described above may be used to scale the first layer, even though the first layer has not been "scaled" by the second layer. The third layer, when applied directly to the first layer, may provide height information and thereby allow for irregular speaker feeds corresponding to irregularly arranged speaker geometries to be rendered.

The bitstream generation unit 42 may, in order to permit the layers to be extracted from the bitstream 21, specify an indication of a number of layers specified in the bitstream. The bitstream generation unit 42 may output the bitstream 21 that includes the indicated number of layers. The bitstream generation unit 42 is described in more detail with respect to FIG. 5. Various different examples of generating the scalable HOA audio data are described in the following FIGS. 7A-9B, with an example of the sideband information for each of the above examples in FIGS. 10-13B.

Figure 5:
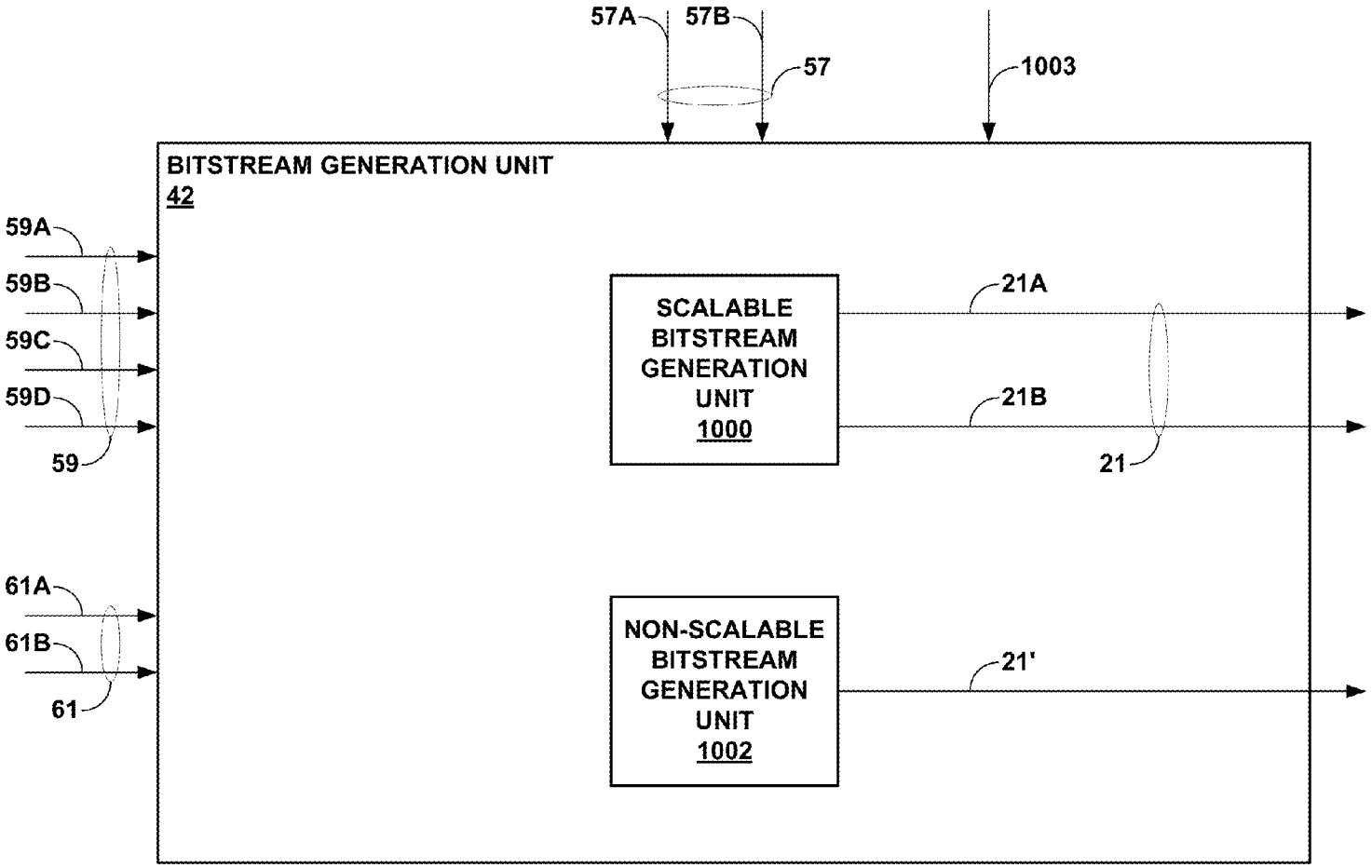
FIG. 5 is a diagram illustrating, in more detail, the bitstream generation unit of FIG. 3 when configured to perform a first one of the potential versions of the scalable audio coding techniques described in this disclosure.

FIG. 5 is a diagram illustrating, in more detail, the bitstream generation unit 42 of FIG. 3 when configured to perform a first one of the potential versions of the scalable audio coding techniques described in this disclosure. In the example of FIG. 5, the bitstream generation unit 42 includes a scalable bitstream generation unit 1000 and a non-scalable bitstream generation unit 1002. The scalable bitstream generation unit 1000 represents a unit configured to generate a scalable bitstream 21 comprising two or more layers (although in some instances a scalable bitstream may comprise a single layer for certain audio contexts) having HOAFrames( ) similar to those shown in and described below with respect to the examples of FIGS. 11-13B. The non-scalable bitstream generation unit 1002 may represent a unit configured to generate a non-scalable bitstream 21 that does not provide for layers or, in other words, scalability.

Both the non-scalable bitstream 21 and the scalable bitstream 21 may be referred to as "bitstream 21" given that both typically include the same underlying data in terms of the encoded ambient HOA coefficients 59, the encoded nFG signals 61 and the coded foreground V[k] vectors 57. One difference, however, between the non-scalable bitstream 21 and the scalable bitstream 21 is that the scalable bitstream 21 includes layers, which may be denoted as layers 21A, 21B, etc. The layers 21A may include subsets of the encoded ambient HOA coefficients 59, the encoded nFG signals 61 and the coded foreground V[k] vectors 57, as described in more detail below.

Although the scalable and non-scalable bitstreams 21 may effectively be different representations of the same bitstream 21, the non-scalable bitstream 21 is denoted as non-scalable bitstream 21' to differentiate the scalable bitstream 21 from the non-scalable bitstream 21'. Moreover, in some instances, the scalable bitstream 21 may include various layers that conform to the non-scalable bitstream 21. For example, the scalable bitstream 21 may include a base layer that conforms to non-scalable bitstream 21. In these instances, the non-scalable bitstream 21' may represent a sub-bitstream of scalable bitstream 21, where this non-scalable sub-bitstream 21' may be enhanced with additional layers of the scalable bitstream 21 (which are referred to as enhancement layers).

The bitstream generation unit 42 may obtain scalability information 1003 indicative of whether to invoke the scalable bitstream generation unit 1000 or the non-scalable bitstream generation unit 1002. In other words, the scalability information 1003 may indicate whether bitstream generation unit 42 is to output scalable bitstream 21 or non-scalable bitstream 21'. For purposes of illustration, the scalability information 1003 is assumed to indicate that the bitstream generation unit 42 is to invoke the scalable bitstream generation unit 1000 to output the scalable bitstream 21'.

As further shown in the example of FIG. 5, the bitstream generation unit 42 may receive the encoded ambient HOA coefficients 59A-59D, the encoded nFG signals 61A and 61B, and the coded foreground V[k] vectors 57A and 57B. The encoded ambient HOA coefficients 59A may represent encoded ambient HOA coefficients associated with a spherical basis function having an order of zero and a sub-order of zero. The encoded ambient HOA coefficients 59B may represent encoded ambient HOA coefficients associated with a spherical basis function having an order of one and a sub-order of zero. The encoded ambient HOA coefficients 59C may represent encoded ambient HOA coefficients associated with a spherical basis function having an order of one and a sub-order of negative one. The encoded ambient HOA coefficients 59D may represent encoded ambient HOA coefficients associated with a spherical basis function having an order of one and a sub-order of positive one. The encoded ambient HOA coefficients 59A-59D may represent one example of, and as a result may be referred to collectively as, the encoded ambient HOA coefficients 59 discussed above.

The encoded nFG signals 61A and 61B may each represent a US audio object representative of, in this example, the two most predominant foreground aspects of the soundfield. The coded foreground V[k] vectors 57A and 57B may represent directional information (which may also specify width in addition to direction) for the encoded nFG signals 61A and 61B respectively. The encoded nFG signals 61A and 61B may represent one example of, and as a result may be referred to collectively as, the encoded nFG signals 61 described above. The coded foreground V[k] vectors 57A and 57B may represent one example of, and as a result may be referred to collectively as, the coded foreground V[k] vectors 57 described above.

Once invoked, the scalable bitstream generation unit 1000 may generate the scalable bitstream 21 to include the layers 21A and 21B in a manner substantially similar to that described below with respect to FIGS. 7A-9B. The scalable bitstream generation unit 1000 may specify an indication of the number of layers in the scalable bitstream 21 as well as the number of foreground elements and background elements in each of the layers 21A and 21B. The scalable bitstream generation unit 1000 may, as one example, specify a NumberOfLayers syntax element that may specify L number of layers, where the variable L may denote the number of layers. The scalable bitstream generation unit 1000 may then specify, for each layer (which may be denoted as the variable i=1 to L), the Bi number of the encoded ambient HOA coefficients 59 and the Fi number of the coded nFG signals 61 sent for each layer (which may also or alternatively indicate the number of corresponding coded foreground V[k] vectors 57).

In the example of FIG. 5, the scalable bitstream generation unit 1000 may specify in the scalable bitstream 21 that scalable coding has been enabled and that two layers are included in the scalable bitstream 21, that the first layer 21A includes four encoded ambient HOA coefficients 59 and zero encoded nFG signals 61, and that the second layer 21A includes zero encoded ambient HOA coefficients 59 and w encoded nFG signals 61. The scalable bitstream generation unit 1000 may also generate the first layer 21A (which may also be referred to as a "base layer 21A") to include the encoded ambient HOA coefficients 59. The scalable bitstream generation unit 1000 may further generate the second layer 21A (which may be referred to as an "enhancement layer 21B") to include the encoded nFG signals 61 and the coded foreground V[k] vectors 57. The scalable bitstream generation unit 1000 may output the layers 21A and 21B as scalable bitstream 21. In some examples, the scalable bitstream generation unit 1000 may store the scalable bitstream 21' to a memory (either internal to or external from the encoder 20).

In some instances, the scalable bitstream generation unit 1000 may not specify one or more or any of the indications of the number of layers, the number of foreground components (e.g., number of the encoded nFG signals 61 and coded foreground V[k] vectors 57) in the one or more layers, and the number of background components (e.g., the encoded ambient HOA coefficients 59) in the one or more layers. The components may also be referred to as channels in this disclosure. Instead, the scalable bitstream generation unit 1000 may compare the number of layers for a current frame to the number of layers for a previous frame (e.g., the most temporally recent previous frame). When the comparison results in no differences (meaning that the number of layers in the current frame is equal to the number of layers in the previous frame, the scalable bitstream generation unit 1000 may compare the number of background and foreground components in each layer in a similar manner.

In other words, the scalable bitstream generation unit 1000 may compare the number of background components in the one or more layers for the current frame to the number of background component in the one or more layers for a previous frame. The scalable bitstream generation unit 1000 may further compare the number of foreground components in the one or more layers for the current frame to the number of foreground components in the one or more layers for the previous frame.

When both of the component-based comparisons result in no differences (meaning, that the number of foreground and background components in the previous frame is equal to the number of foreground and background components in the current frame), the scalable bitstream generation unit 1000 may specify an indication (e.g., an HOABaseLayerConfigurationFlag syntax element) in the scalable bitstream 21 that the number of layers in the current frame is equal to the number of layers in the previous frame rather than specify one or more or any of the indications of the number of layers, the number of foreground components (e.g., number of the encoded nFG signals 61 and coded foreground V[k] vectors 57) in the one or more layers, and the number of background components (e.g., the encoded ambient HOA coefficients 59) in the one or more layers. The audio decoding device 24 may then determine that the previous frame indications of the number of layers, background components and foreground components equal the current frame indication of number of the number of layers, background components and foreground components, as described below in more detail.

When any of the comparisons noted above result in differences, the scalable bitstream generation unit 1000 may specify an indication (e.g., an HOABaseLayerConfigurationFlag syntax element) in the scalable bitstream 21 that the number of layers in the current frame is not equal to the number of layers in the previous frame. The scalable bitstream generation unit 1000 may then specify the indications of the number of layers, the number of foreground components (e.g., number of the encoded nFG signals 61 and coded foreground V[k] vectors 57) in the one or more layers, and the number of background components (e.g., the encoded ambient HOA coefficients 59) in the one or more layers, as noted above. In this respect, the scalable bitstream generation unit 1000 may specify, in the bitstream, an indication of whether a number of layers of the bitstream has changed in a current frame when compared to a number of layers of the bitstream in a previous frame, and specify the indicated number of layers of the bitstream in the current frame.

In some examples, rather than not specify an indication of the number of foreground components and the indication of the number of background components, the scalable bitstream generation unit 1000 may not specify an indication of a number of components (e.g., a "NumChannels" syntax element, which may be an array having [i] entries where i is equal to the number of layers) in the scalable bitstream 21. The scalable bitstream generation unit 1000 may not specify this indication of the number of components (where these components may also be referred to as "channels") in place of not specifying the number of foreground and background components given that the number of foreground and background components may be derived from the more general number of channels. The derivation of the indication of the number of foreground components and the indication of the number of background channels may, in some examples, proceed in accordance with the following table:

TABLE

Syntax of ChannelSideInfoData(i)

| Syntax | No. of bits | Mnemonic |
|---|---|---|
| ChannelSideInfoData(i) | | |
| { | | |
| ChannelType[i] | 2 | uimsbf |
| switch ChannelType[i] | | |
| { | | |
| case 0: | | |
| ActiveDirsIds[i]; | NumOfBitsPerDirIdx | uimsbf |
| break; | | |
| case 1: | | |
| if(hoaIndependencyFlag){ | | |
| NbitsQ(k)[i] | 4 | uimsbf |
| if (NbitsQ(k)[i] == 4) { | | |
| CodebkIdx(k)[i]; | 3 | uimsbf |
| NumVecIndices(k)[i]++; | NumVVecVqElementsBits | uimsbf |
| } | | |
| elseif (NbitsQ(k)[i] >= 6) { | | |
| PFlag(k)[i] = 0; | | |
| CbFlag(k)[i]; | 1 | bslbf |
| } | | |
| } | | |
| else{ | | |
| bA; | 1 | bslbf |
| bB; | 1 | bslbf |
| if ((bA + bB) == 0) { | | |
| NbitsQ(k)[i] = NbitsQ(k−1)[i]; | | |
| PFlag(k)[i] = PFlag(k−1)[i]; | | |
| CbFlag(k)[i] = CbFlag(k−1)[i]; | | |
| CodebkIdx(k)[i] = CodebkIdx(k−1)[i]; | | |
| NumVecIndices(k)[i] = NumVecIndices[k−1][i]; | | |
| } | | |
| else{ | | |
| NbitsQ(k)[i] = (8*bA)+(4*bB)+uintC; | 2 | uimsbf |
| if (NbitsQ(k)[i] == 4) { | | |
| CodebkIdx(k)[i]; | 3 | uimsbf |
| } | | |
| elseif (NbitsQ(k)[i] >= 6) { | | |
| PFlag(k)[i]; | 1 | bslbf |
| CbFlag(k)[i]; | 1 | bslbf |
| } | | |
| } | | |
| } | | |
| break; | | |
| case 2: | | |
| AddAmbHoaInfoChannel(i); | | |
| break; | | |
| default: | | |
| } | | |
| } | | |

where the description of the ChannelType is given as follows:

ChannelType:

0: Direction-based Signal

1: Vector-based Signal (which may represent a foreground signal)

2: Additional Ambient HOA Coefficient (which may represent a background or ambient signal)

3: Empty

As a result of signaling the ChannelType per the above SideChannelInfo syntax table, the number of foreground components per layer may be determined as a function of the number of ChannelType syntax elements set to 1 and the number of background components per layer may be determines as a function of the number of ChannelType syntax elements set to 2.

The scalable bitstream generation unit 1000 may, in some examples, specify an HOADecoderConfig on a frame-by-frame basis, which provides the configuration information for extracting the layers from the bitstream 21. The HOADecoderConfig may be specified as an alternative to or in conjunction with the above table. The following table may define the syntax for the HOADecoderConfig_FrameByFrame( ) object in the bitstream 21.

| Syntax | No. of bits | Mnemonic |
|---|---|---|
| HOADecoderConfig__FrameByFrame(numHOATransportChannels) | | |
| { | | |
| HOABaseLayerPresent; | 1 | bslbf |
| if(HOABaseLayerPresent){ | | |
| HOABaseLayerConfigurationFlag; | 1 | bslbf |
| if(HOABaseLayerConfigurationFlag){ | | |
| NumLayerBits = ceil(log2(numHOATransportChannels−2)); | | |
| NumLayers = NumLayers+2; | NumLayerBits | uimsbf |
| numAvailableTransportChannels = numHOATransportChannels−2; | | |
| numAvailableTransportChannelsBits = NumLayerBits; | | |
| for (i=0; i<NumLayers−1; ++i) { | | |
| NumFGchannels[i] = NumFGchannels[i]+1; | numAvailableTransportChannelsBits | uimsbf |
| numAvailableTransportChannels = numAvailableTransportChannels − NumFGchannels[i] numAvailableTransportChannelsBits = ceil(log2(numAvailableTransportChannels)); | | |
| NumBGchannels[i] = NumBGchannels[i] + 1; | numAvailableTransportChannelsBits | uimsbf |
| numAvailableTransportChannels = numAvailableTransportChannels − NumBGchannels[i] numAvailableTransportChannelsBits = ceil(log2(numAvailableTransportChannels)); | | |
| } | | |
| } else { | | |
| NumLayers=NumLayersPrevFrame; | | |
| for (i=0; i<NumLayers; ++i) { | | |
| NumFGchannels[i] = NumFGchannels__PrevFrame[i]; | | |
| NumBGchannels[i] = NumBGchannels__PrevFrame[i]; | | |
| } | | |
| } | | |
| } | | |
| MinAmbHoaOrder = escapedValue(3,5,0) alue | 3,8 | uimsbf |
| MinNumOfCoeffsForAmbHOA = (MinAmbHoaOrder + 1)^2; | | |
| . | | |
| . | | |
| . | | |
| NumLayersPrevFrame=NumLayers; | | |
| for (i=0; i<NumLayers; ++i) { | | |
| NumFGchannels__PrevFrame[i] = NumFGchannels[i]; | | |
| NumBGchannels__PrevFrame[i] = NumBGchannels[i]; | | |
| } | | |
| } | | |

In the foregoing table, the HOABaseLayerPresent syntax element may represent a flag that indicates whether the base layer of the scalable bitstream 21 is present. When present, the scalable bitstream generation unit 1000 specifies an HOABaseLayerConfigurationFlag syntax element, which may represent a syntax element indicating whether configuration information for the base layer is present in the bitstream 21. When the configuration information for the base layer is present in the bitstream 21, the scalable bitstream generation unit 1000 specifies a number of layers (i.e., the NumLayers syntax element in the example), a number of foreground channels (i.e., the NumFGchannels syntax element in the example) for each of the layers, and a number of background channels (i.e., the NumBGchannels syntax element in the example) for each of the layers. When the HOABaseLayerPresent flag indicates that the base layer configuration is not present, the scalable bitstream generation unit 1000 may not provide any additional syntax elements and the audio decoding device 24 may determine that the configuration data for the current frame is the same as that for a previous frame.

In some examples, the scalable bitstream generation unit 1000 may specify the HOADecoderConfig object in the scalable bitstream 21 but not specify the number of foreground and background channels per layer, where the number of foreground and background channels may be static or determined as described above with respect to the ChannelSideInfo table. The HOADecoderConfig may, in this example, be defined in accordance with the following table.

| Syntax | No. of bits | Mnemonic |
|---|---|---|
| HOADecoderConfig(numHOATransportChannels) | | |
| { | | |
| HOABaseLayerPresent; | 1 | bslbf |
| if(HOABaseLayerPresent){ | | |
| HOABaseLayerChBits = ceil(log2(numHOATransportChannels)); | | |
| NumHOABaseLayerCh; | HOABaseLayerChBits | uimsbf |
| HOABaseLayerConfigurationFlag; | 1 | bslbf |
| if(HOABaseLayerConfigurationFlag){ | | |
| NumLayerBits = ceil(log2(numHOATransportChannels)); | | |
| NumLayers; | NumLayerBits | uimsbf |
| numAvailableTransportChannels = numHOATransportChannels | | |
| numAvailableTransportChannelsBits = ceil(log2(numAvailableTransportChannels)); | | |
| for i=1:NumLayers−1 { | | |
| NumChannels[i] | numAvailableTransportChannelsBits | |
| numAvailableTransportChannels = numAvailableTransportChannels − NumChannels[i] | | |
| numAvailableTransportChannelsBits = ceil(log2(numAvailableTransportChannels)); | | |
| } | | |
| } else { | | |
| NumLayers=NumLayersPrevFrame; | | |
| for i=1:NumLayers { | | |
| NumChannels[i] = NumChannels_PrevFrame[i]; | | |
| } | | |
| } | | |
| } | | |
| MinAmbHoaOrder = escapedValue(3,5,0) − 1; | 3,8 | uimsbf |
| MinNumOfCoeffsForAmbHOA = (MinAmbHoaOrder + 1)^2; | | |
| . | | |
| . | | |
| . | | |
| . | | |
| . | | |
| NumLayersPrevFrame=NumLayers; | | |
| for i=1:NumLayers { | | |
| NumChannels_PrevFrame[i] = NumChannels[i]; | | |
| } | | |
| } | | |

As yet another alternative, the foregoing syntax tables for HOADecoderConfig may be replaced with the following syntax table for HOADecoderConfig.

| Syntax | No. of bits | Mnemonic |
|---|---|---|
| HOADecoderConfig(numHOATransportChannels) | | |
| { | | |
| MinAmbHoaOrder = escapedValue(3,5,0) − 1; | 3,8 | uimsbf |
| MinNumOfCoeffsForAmbHOA = (MinAmbHoaOrder + 1)^2; | | |
| NumOfAdditionalCoders = numHOATransportChannels − MinNumOfCoeffsForAmbHOA; | | |
| SingleLayer; | 1 | bslbf |
| if(SingleLayer==0){ | | |
| NumOfAdditionalCoders = escapeValue(5,8,16) +1 + NumOfAdditionalCoders; | | uimsbf |
| HOALayerChBits = ceil(log2(NumOfAdditionalCoders)); | | |
| NumHOAChannelsLayer[0] = codedLayerCh + MinNumOfCoeffsForAmbHOA; | HOALayerChBits | uimsbf |
| remainingCh = numHOATransportChannels − NumHOACannelsLayer[0]; | | |
| NumLayers = 1; | | |
| while (remainingCh>1) { | | |
| HOALayerChBits = ceil(log2(remainingCh)); | | |
| NumHOAChannelsLayer[NumLayers] = codedLayerCh + 1; | HOALayerChBits | uimsbf |

-continued

| Syntax | No. of bits | Mnemonic |
|---|---|---|
| remainingCh = remainingCh – NumHOAChannelsLayer[NumLayers]; | | |
| NumLayers++; | | |
| } | | |
| if (remainingCh) { | | |
| NumHOAChannelsLayer[NumLayers] = 1; | | |
| NumLayers++; | | |
| } | | |
| } | | |
| MaxNoOfDirSigsForPrediction = MaxNoOfDirSigsForPrediction + 1; | 2 | uimsbf |
| NoOfBitsPerScalefactor = NoOfBitsPerScalefactor + 1; | 4 | uimsbf |
| CodedSpatialInterpolationTime; | 3 | uimsbf |
| SpatialInterpolationMethod; | 1 | bslbf |
| CodedVVecLength; | 2 | uimsbf |
| MaxGainCorrAmpExp; | 3 | uimsbf |
| MaxNumAddActiveAmbCoeffs = NumOfHoaCoeffs – MinNumOfCoeffsForAmbHOA; | | |
| AmbAsignmBits = ceil( log2( MaxNumAddActiveAmbCoeffs ) ); | | |
| ActivePredIdsBits = ceil( log2( NumOfHoaCoeffs ) ); | | |
| i = 1; | | |
| while( i * ActivePredIdsBits + ceil( log2( i ) ) < NumOfHoaCoeffs ){ | | |
| i++; | | |
| } | | |
| NumActivePredIdsBits = ceil( log2( max( 1, i – 1 ) ) ); | | |
| GainCorrPrevAmpExpBits = ceil( log2( ceil( log2( 1.5 * NumOfHoaCoeffs )) + MaxGainCorrAmpExp + 1 ) ); | | |
| for (i=0; i<NumOfAdditionalCoders; ++i){ | | |
| AmbCoeffTransitionState[i] = 3; | | |
| } | | |
| } | | |

NOTE:
MinAmbHoaOrder = 30 . . . 37 are reserved.

In this respect, the scalable bitstream generation unit 1000 may be configured to, as described above, specify, in the bitstream, an indication of a number of channels specified in one or more layers of the bitstream, and specify the indicated number of the channels in the one or more layers of the bitstream.

Moreover, the scalable bitstream generation unit 1000 may be configured to specify a syntax element (e.g., in the form of a NumLayers syntax element or a codedLayerCh syntax element as described below in more detail) indicative of the number of channels.

In some examples, the scalable bitstream generation unit 1000 may be configured to specify an indication of a total number of channels specified in the bitstream. The scalable bitstream generation unit 1000 may be configured to, in these instances, specify the indicated total number of the channels in the one or more layers of the bitstream. In these instances, the scalable bitstream generation unit 1000 may be configured to specify a syntax element (e.g., a numHOATransportChannels syntax element as described below in more detail) indicative of the total number of channels.

In these and other examples, the scalable bitstream generation unit 1000 may be configured to specify an indication a type of one of the channels specified in the one or more layers in the bitstream. In these instances, the scalable bitstream generation unit 1000 may be configured to specify the indicated number of the indicated type of the one of the channels in the one or more layers of the bitstream. The foreground channel may comprise a US audio object and a corresponding V-vector.

In these and other examples, the scalable bitstream generation unit 1000 may be configured to specify an indication a type of one of the channels specified in the one or more layers in the bitstream, the indication of the type of the one of the channels indicating that the one of the channels is a foreground channel. In these instances, the scalable bitstream generation unit 1000 may be configured to specify the foreground channel in the one or more layers of the bitstream.

In these and other examples, the scalable bitstream generation unit 1000 may be configured to specify an indication a type of one of the channels specified in the one or more layers in the bitstream, the indication of the type of the one of the channels indicating that the one of the channels is a background channel. In these instances, the scalable bitstream generation unit 1000 may be configured to specify the background channel in the one or more layers of the bitstream. The background channel may comprise an ambient HOA coefficient.

In these and other examples, the scalable bitstream generation unit 1000 may be configured to specify a syntax element (e.g., a ChannelType syntax element) indicative of the type of the one of the channels.

In these and other examples, the scalable bitstream generation unit 1000 may be configured to specify the indication of the number of channels based on a number of channels remaining in the bitstream after one of the layers is obtained (as defined for example by a remainingCh syntax element or a numAvailableTransportChannels syntax element as described in more detail below.

FIGS. 7A-7D are flowcharts illustrating example operation of the audio encoding device 20 in generating an encoded two-layer representation of the HOA coefficients 11. Referring first to the example of FIG. 7A, the decorrelation unit 60 may first apply the UHJ decorrelation with respect to the first order ambisonics background (where "ambisonics background" may refer to ambisonic coefficients describing a background component of a soundfield) represented as energy compensated background HOA coefficients 47A'-47D' (300). The first order ambisonics background 47A'-47D' may include the HOA coefficients corresponding to spherical basis functions having the following (order, sub-order): (0, 0), (1, 0), (1, −1), (1, 1).

The decorrelation unit 60 may output the decorrelated ambient HOA audio signals 67 as the above noted Q, T, L and R audio signals. The Q audio signal may provide height information. The T audio signal may provide horizontal information (including information for representing channels behind the sweet spot). The L audio signal provides a left stereo channel. The R audio signal provides a right stereo channel.

In some examples, the UHJ matrix may comprise at least higher order ambisonic audio data associated with a left audio channel. In other examples, the UHJ matrix may comprise at least higher order ambisonic audio data associated with a right audio channel. In still other examples, the UHJ matrix may comprise at least higher order ambisonic audio data associated with a localization channel. In other examples, the UHJ matrix may comprise at least higher order ambisonic audio data associated with a height channel. In other examples, the UHJ matrix may comprise at least higher order ambisonic audio data associated with a sideband for automatic gain correction. In other examples, the UHJ matrix may comprise at least higher order ambisonic audio data associated with a left audio channel, a right audio channel, a localization channel, and a height channel, and a sideband for automatic gain correction.

The gain control unit 62 may apply automatic gain control (AGC) to the decorrelated ambient HOA audio signals 67 (302). The gain control unit 62 may pass the adjusted ambient HOA audio signals 67' to the bitstream generation unit 42, which may form the base layer based on the adjusted ambient HOA audio signals 67' and at least part of the sideband channel based on the higher order ambisonic gain control data (HOAGCD) (304).

The gain control unit 62 may also apply the automatic gain control with respect to the interpolated nFG audio signals 49' (which may also be referred to as the "vector-based predominant signals") (306). The gain control unit 62 may output the adjusted nFG audio signals 49" along with the HOAGCD for the adjusted nFG audio signals 49" to the bitstream generation unit 42. The bitstream generation unit 42 may form the second layer based on the adjusted nFG audio signals 49" while forming part of the sideband information based on the HOAGCD for the adjusted nFG audio signals 49" and the corresponding coded foreground V[k] vectors 57 (308).

The first layer (i.e., a base layer) of the two or more layers of higher order ambisonic audio data may comprise higher order ambisonic coefficients corresponding to one or more spherical basis functions having an order equal to or less than one. In some examples, the second layer (i.e., an enhancement layer) comprises vector-based predominant audio data.

In some examples, the vector-based predominant audio comprises at least a predominant audio data and an encoded V-vector. As described above, the encoded V-vector may be decomposed from the higher order ambisonic audio data through application of a linear invertible transform by the LIT unit 30 of the audio encoding device 20. In other examples, the vector-based predominant audio data comprises at least an additional higher order ambisonic channel. In still other examples, the vector-based predominant audio data comprises at least an automatic gain correction sideband. In other examples, the vector-based predominant audio data comprises at least a predominant audio data, an encoded V-vector, an additional higher order ambisonic channel, and an automatic gain correction sideband.

In forming the first layer and the second layer, the bitstream generation unit 42 may perform error checking processes that provides for error detection, error correction or both error detection and correction. In some examples, the bitstream generation unit 42 may perform an error checking process on the first layer (i.e., the base layer). In another example, the audio coding device may perform an error checking process on the first layer (i.e., the base layer) and refrain from performing an error checking process on the second layer (i.e., the enhancement layer). In yet another example, the bitstream generation unit 42 may perform an error checking process on the first layer (i.e., the base layer) and, in response to determining that the first layer is error free, the audio coding device may perform an error checking process on the second layer (i.e., the enhancement layer). In any of the above examples in which the bitstream generation unit 42 performs the error checking process on the first layer (i.e., the base layer), the first layer may be considered a robust layer that is robust to errors.

Figure 7A:
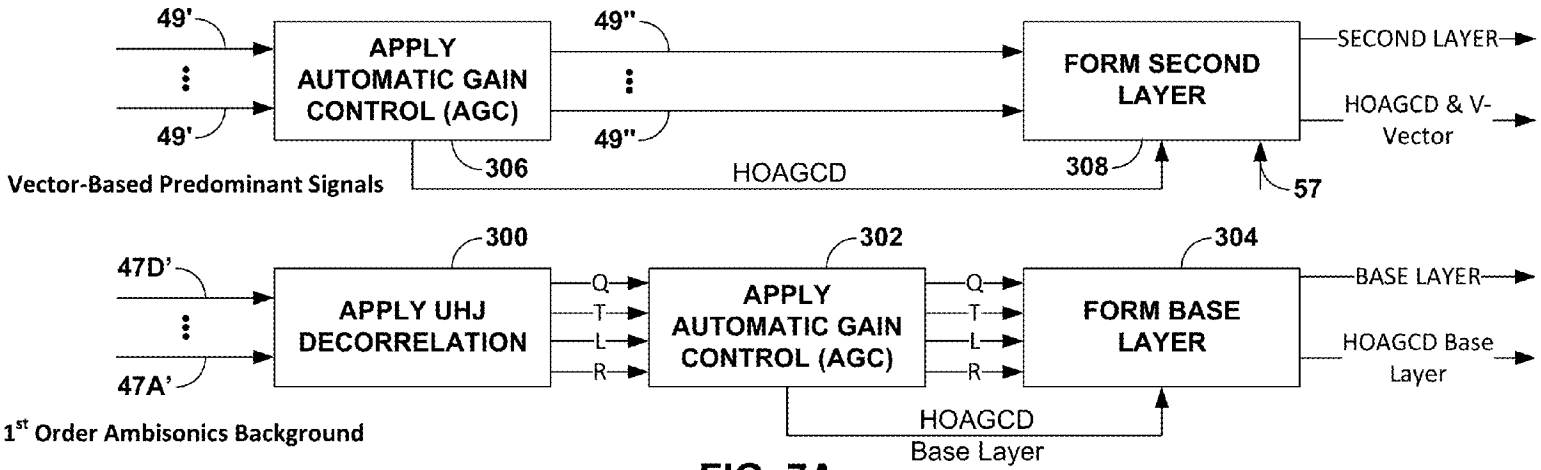
FIGS. 7A-7D are flowcharts illustrating example operation of the audio encoding device in generating an encoded two-layer representation of the higher order ambisonic (HOA) coefficients.
Figure 7B:
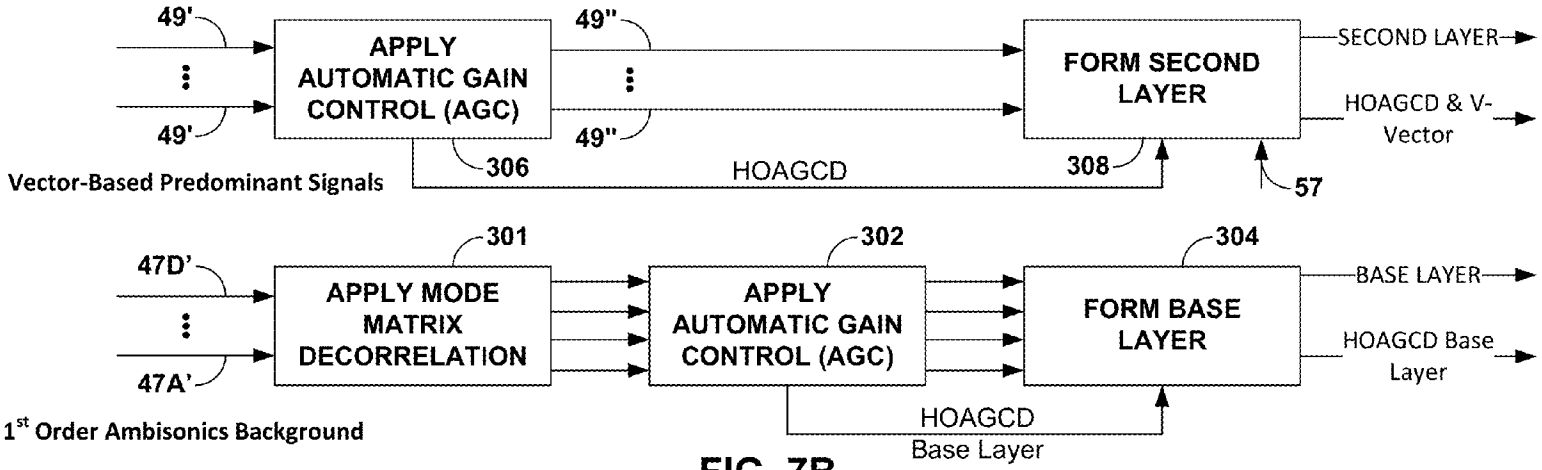

Referring next to FIG. 7B, the gain control unit 62 and the bitstream generation unit 42 perform similar operations to that of the gain control unit 62 and the bitstream generation unit 42 described above with respect to FIG. 7A. However, the decorrelation unit 60 may apply a mode matrix decorrelation, rather than the UHJ decorrelation, to the first order ambisonics background 47A'-47D' (301).

Figure 7C:
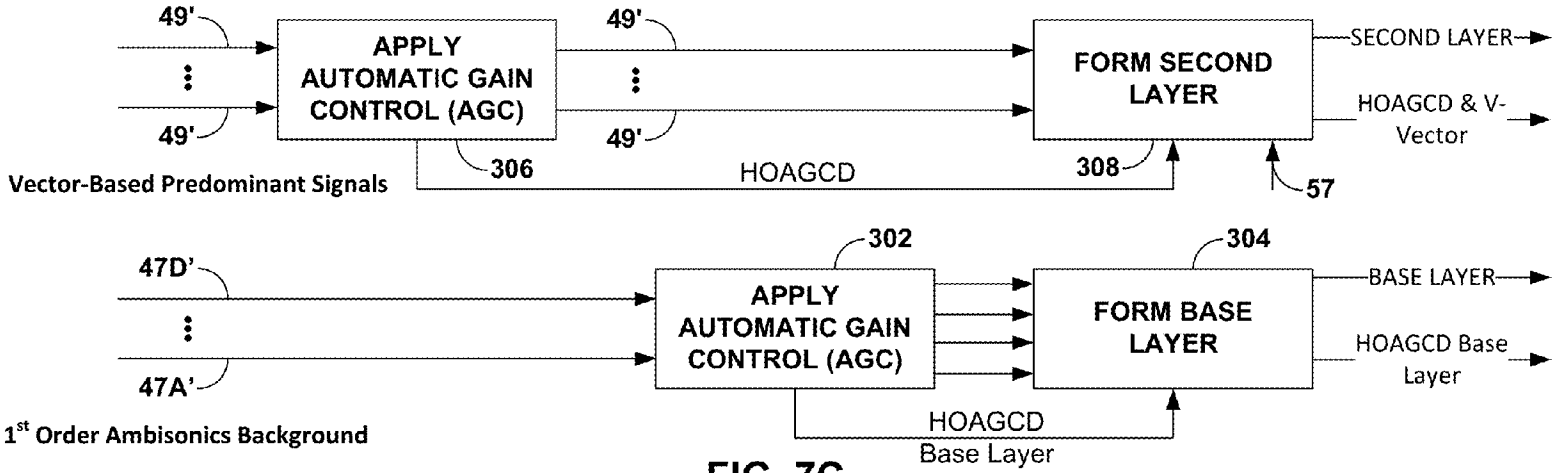

Referring next to FIG. 7C, the gain control unit 62 and the bitstream generation unit 42 may perform similar operations to that of the gain control unit 62 and the bitstream unit 42 described above with respect to the examples of FIGS. 7A and 7B. However, in the example of FIG. 7C, the decorrelation unit 60 may not apply any transform to the first order ambisonics background 47A'-47D'. In each of the following examples 8A-10B, it is assumed but not illustrated that the decorrelation unit 60 may, as an alternative, not apply decorrelation with respect to one or more of the first order ambisonics background 47A'-47D'.

Figure 7D:
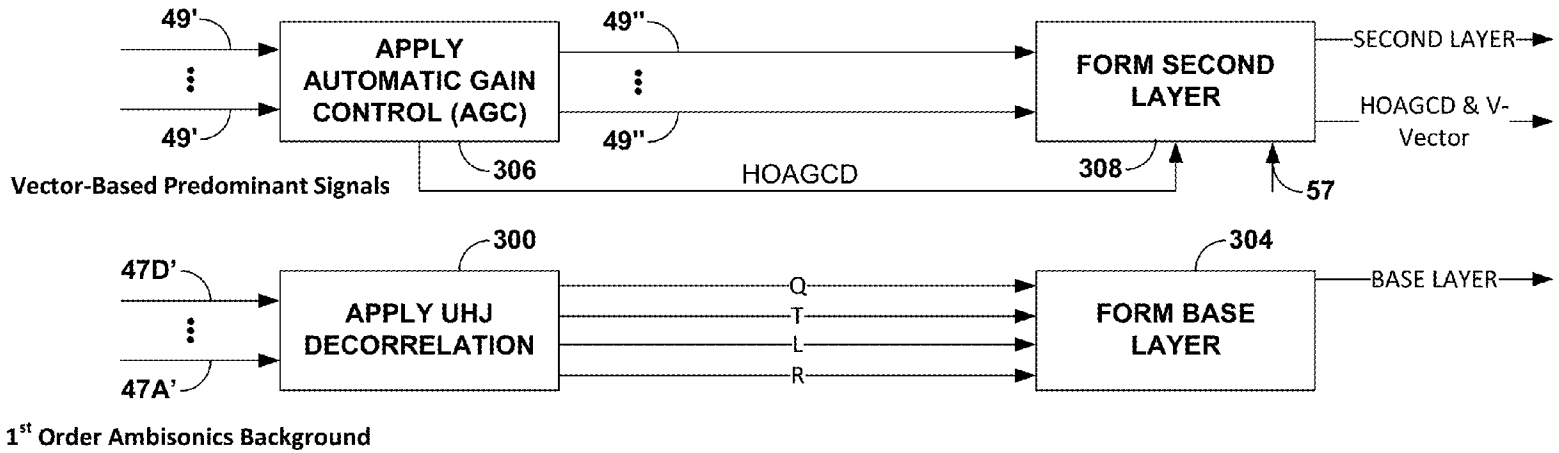

Referring next to FIG. 7D, the decorrelation unit 60 and the bitstream generation unit 42 may perform similar operations to that of the gain control unit 52 and the bitstream generation unit 42 described above with respect to the examples of FIGS. 7A and 7B. However, in the example of FIG. 7D, the gain control unit 62 may not apply any gain control to the decorrelated ambient HOA audio signals 67. In each of the following examples 8A-10B, it is assumed but not illustrated that the gain control unit 52 may, as an alternative, not apply decorrelation with respect to one or more of the decorrelation ambient HOA audio signals 67.

Figure 10:
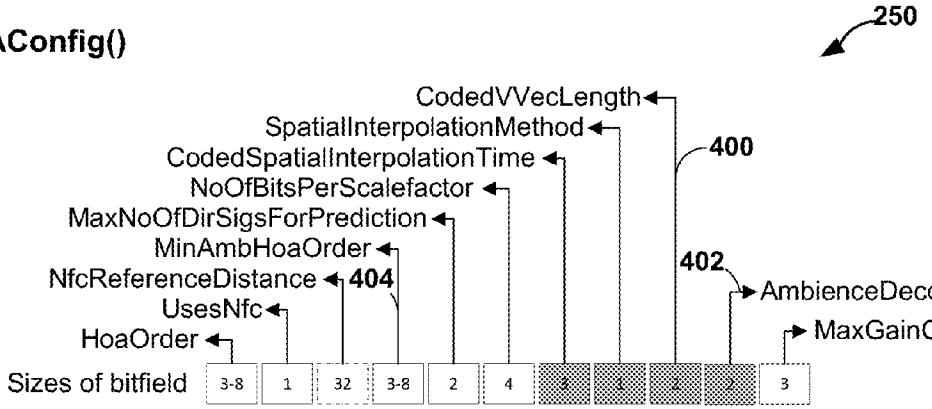
FIG. 10 is a diagram illustrating an example of an HOA configuration object specified in the bitstream in accordance with various aspects of the techniques.

In each of the examples of FIGS. 7A-7D, the bitstream generation unit 42 may specify one or more syntax elements in the bitstream 21. FIG. 10 is a diagram illustrating an example of an HOA configuration object specified in the bitstream 21. For each of the examples of FIGS. 7A-7D, the bitstream generation unit 42 may set the codedVVecLength syntax element 400 to 1 or 2, which indicates that the 1st order background HOA channels contain the 1st order component of all predominant sounds. The bitstream generation unit 42 may also set the ambienceDecorrelationMethod syntax element 402 such that the element 402 signals the use of the UHJ decorrelation (e.g., as described above with respect to FIG. 7A), signals the use of the matrix mode decorrelation (e.g., as described above with respect to FIG. 7B), or signals that no decorrelation was used (e.g., as described above with respect to FIG. 7C).

Figure 11:
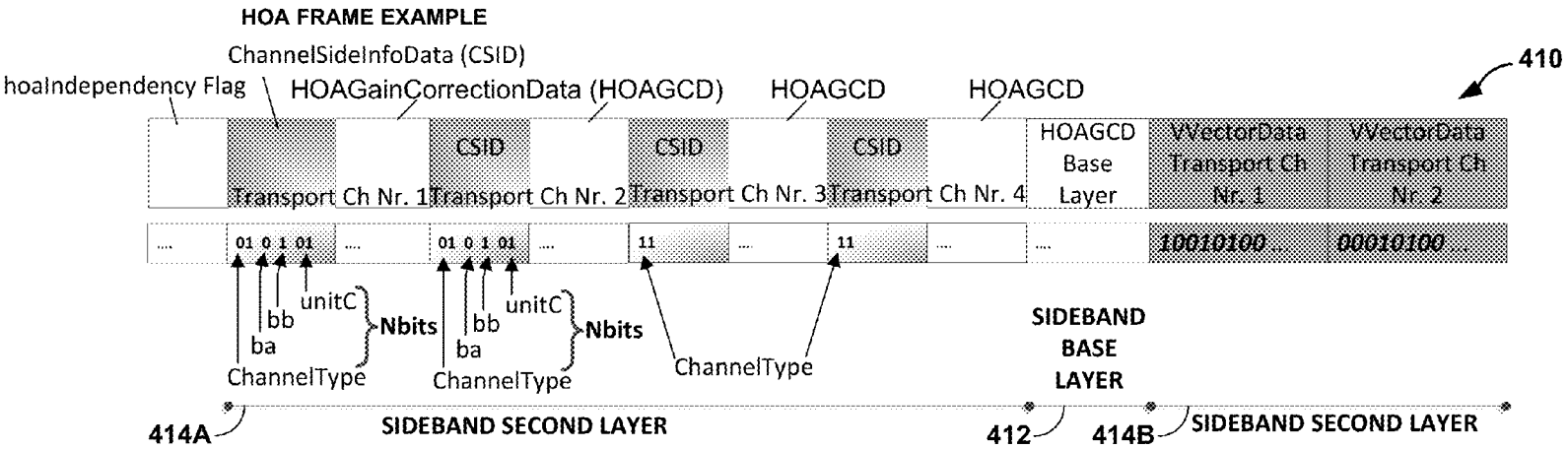
FIG. 11 is a diagram illustrating sideband information generated by the bitstream generation unit for the first and second layers.

FIG. 11 is a diagram illustrating sideband information 410 generated by the bitstream generation unit 42 for the first and second layers. The sideband information 410 includes sideband base layer information 412 and sideband second layer information 414A and 414B. When only the base layer is provided to the audio decoding device 24, the audio encoding device 20 may provide only the sideband base layer information 412. The sideband base layer information 412 includes the HOAGCD for the base layer. The sideband second layer information 414A includes transport channels 1-4 syntax elements and corresponding HOAGCD. The sideband second layer information 414B includes the corresponding two coded reduced V[k] vectors 57 corresponding to transport channels 1 and 2 (given that transport channels 3 and 4 are empty as denoted by the ChannelType syntax element equaling $11_2$ or $3_{10}$.).

Figure 8A:
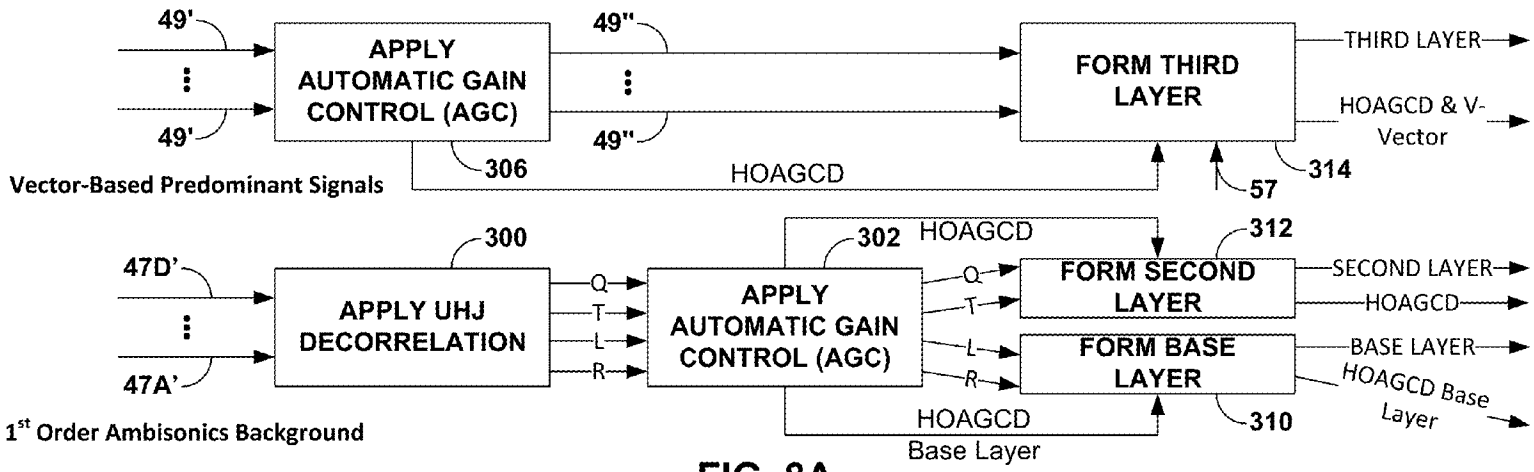
FIGS. 8A and 8B are flowcharts illustrating example operation of the audio encoding device in generating an encoded three-layer representation of the HOA coefficients.
Figure 8B:
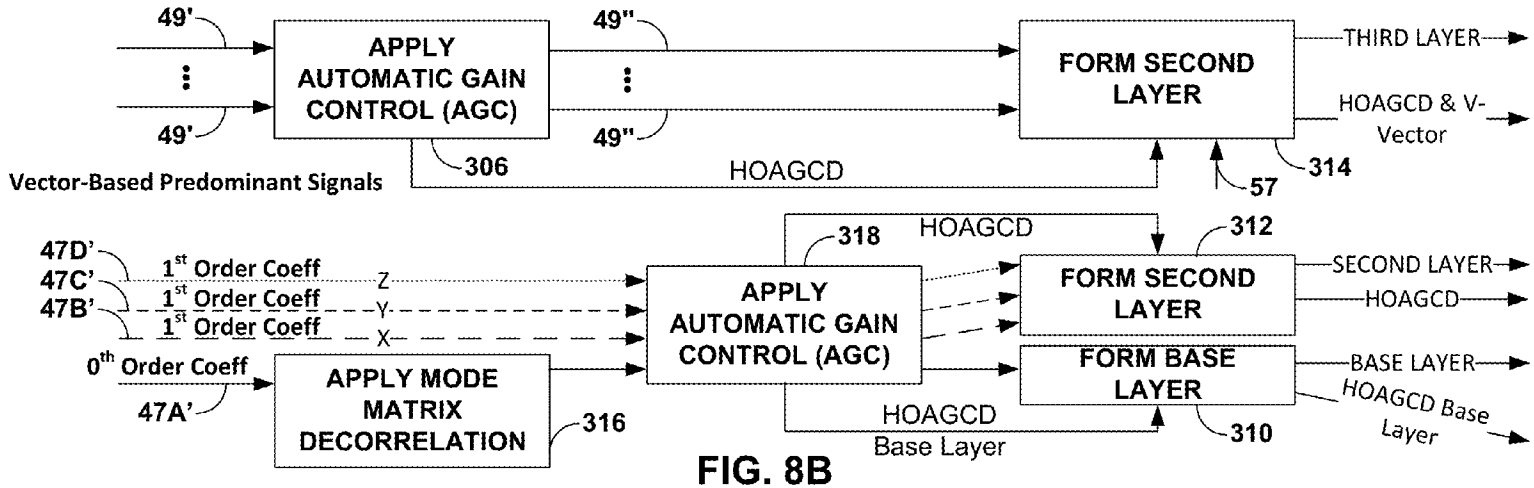

FIGS. 8A and 8B are flowcharts illustrating example operation of the audio encoding device 20 in generating an encoded three-layer representation of the HOA coefficients 11. Referring first to the example of FIG. 8A, the decorrelation unit 60 and the gain control unit 62 may perform operations similar to those described above with respect to FIG. 7A. However, the bitstream generation unit 42 may form the base layer based on the L audio signal and the R audio signal of the adjusted ambient HOA audio signals 67 rather than all of the adjusted ambient HOA audio signals 67 (310). The base layer may, in this respect, provide for stereo channels when rendered at the audio decoding device 24. The bitstream generation unit 42 may also generate sideband information for the base layer that includes the HOAGCD.

The operation of the bitstream generation unit 42 may also differ from that described above with respect to FIG. 7A in that the bitstream generation unit 42 may form a second layer based on the Q and T audio signals of the adjusted ambient HOA audio signals 67 (312). The second layer in the example of FIG. 8A may provide for horizontal channels and 3D audio channels when rendered at the audio decoding device 24. The bitstream generation unit 42 may also generate sideband information for the second layer that includes the HOAGCD. The bitstream generation unit 42 may also form a third layer in a manner substantially similar to that described above with respect to forming the second layer in the example of FIG. 7A.

The bitstream generation unit 42 may specify the HOA configuration object for the bitstream 21 similar to that described above with respect to FIG. 10. Further, bitstream generation unit 42 of audio encoder 20 sets the MinAmbHoaOrder syntax element 404 to 2 so as to indicate that the 1st order HOA background is transmitted.

Figure 12A:
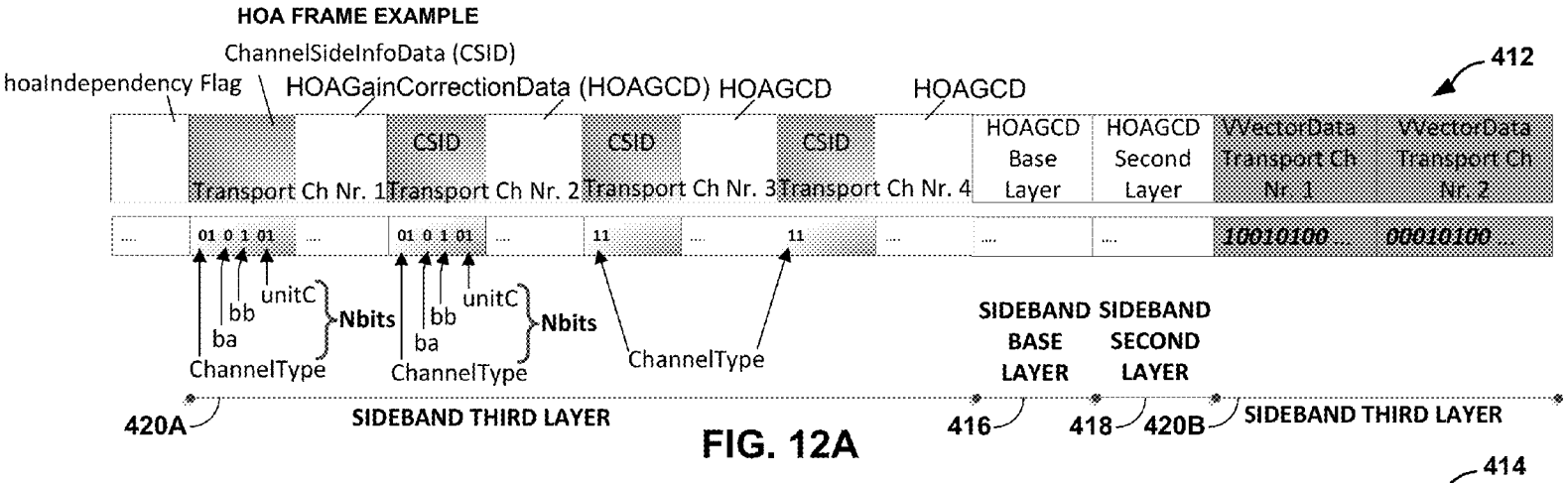
FIGS. 12A and 12B are diagrams illustrating sideband information generated in accordance with the scalable coding aspects of the techniques described in this disclosure.

The bitstream generation unit 42 may also generate sideband information similar to sideband information 412 shown in the example of FIG. 12A. FIG. 12A is a diagram illustrating sideband information 412 generated in accordance with the scalable coding aspects of the techniques described in this disclosure. The sideband information 412 includes sideband base layer information 416, sideband second layer information 418, and sideband third layer information 420A and 420B. The sideband base layer information 416 may provide the HOAGCD for the base layer. The sideband second layer information 418 may provide the HOAGCD for the second layer. The sideband third layer information 420A and 420B may be similar to the sideband information 414A and 414B described above with respect to FIG. 11.

Similar to FIG. 7A, the bitstream generation device 42 may perform error checking processes. In some examples, bitstream generation device 42 may perform an error checking process on the first layer (i.e., the base layer). In another example, the bitstream generation device 42 may perform an error checking process on the first layer (i.e., the base layer) and refrain from performing an error checking process on the second layer (i.e., the enhancement layer). In yet another example, the bitstream generation device 42 may perform an error checking process on the first layer (i.e., the base layer) and, in response to determining that the first layer is error free, the audio coding device may perform an error checking process on the second layer (i.e., the enhancement layer). In any of the above examples in which the audio coding device performs the error checking process on the first layer (i.e., the base layer), the first layer may be considered a robust layer that is robust to errors.

Although described as providing three layers, in some examples, the bitstream generation device 42 may specify an indication in the bitstream that there are only two layers and specify a first one of the layers of the bitstream indicative of background components of the higher order ambisonic audio signal that provide for stereo channel playback, and a second one of the layers of the bitstream indicative of the background components of the higher order ambisonic audio signal that provide for horizontal multi-channel playback by three or more speakers arranged on a single horizontal plane. In other words, while shown as providing three layers, the bitstream generation device 42 may generate only two of the three layers in some instances. It should be understood that any subset of the layers may be generated although not described in detail herein.

Referring next to FIG. 8B, the gain control unit 62 and the bitstream generation unit 42 perform similar operations to that of the gain control unit 62 and the bitstream generation unit 42 described above with respect to FIG. 8A. However, the decorrelation unit 60 may apply a mode matrix decorrelation, rather than the UHJ decorrelation, to the first order ambisonics background 47A' (316). In some examples, the first order ambisonics background 47A' may include the zeroth order ambisonic coefficients 47A'. The gain control unit 62 may apply the automatic gain control to the first order ambisonic coefficients corresponding to the spherical harmonic coefficients having a first order, and the decorrelated ambient HOA audio signal 67.

The bitstream generation unit 42 may form a base layer based on the adjusted ambient HOA audio signal 67 and at least part of the sideband based on the corresponding HOAGCD (310). The ambient HOA audio signal 67 may provide for a mono channel when rendered at the audio decoding device 24. The bitstream generation unit 42 may form a second layer based on the adjusted ambient HOA coefficients 47B"-47D" and at least part of the sideband based on the corresponding HOAGCD (318). The adjusted ambient HOA coefficients 47B'-47D' may provide X, Y and Z (or stereo, horizontal and height) channels when rendered at the audio decoding device 24. The bitstream generation unit 42 may form the third layer and at least part of the sideband information in a manner similar to that described above with respect to FIG. 8A. The bitstream generation unit 42 may generate sideband information 412 as described in more detail with respect to FIG. 12B (326).

Figure 12B:
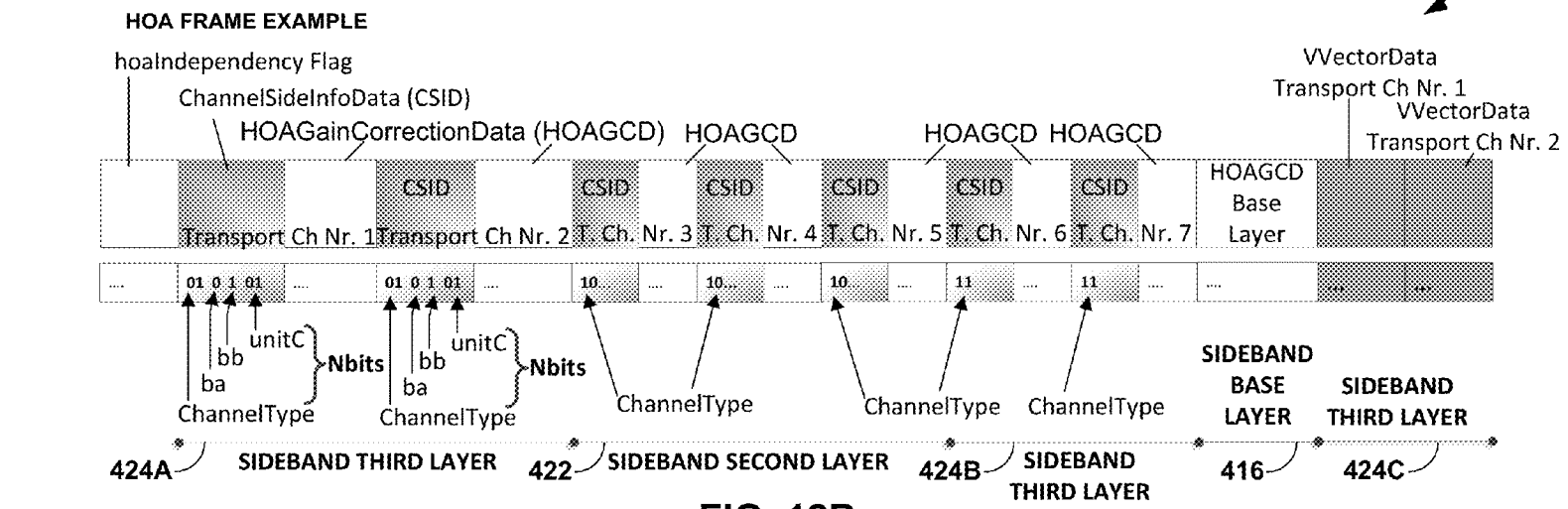

FIG. 12B is a diagram illustrating sideband information 414 generated in accordance with the scalable coding aspects of the techniques described in this disclosure. The sideband information 414 includes sideband base layer information 416, sideband second layer information 422, and sideband third layer information 424A-424C. The sideband base layer information 416 may provide the HOAGCD for the base layer. The sideband second layer information 422 may provide the HOAGCD for the second layer. The sideband third layer information 424A-424C may be similar to the sideband information 414A (except for the sideband information 414A is specified as sideband third layer information 424A and 424B) and 414B described above with respect to FIG. 11.

Figure 9A:
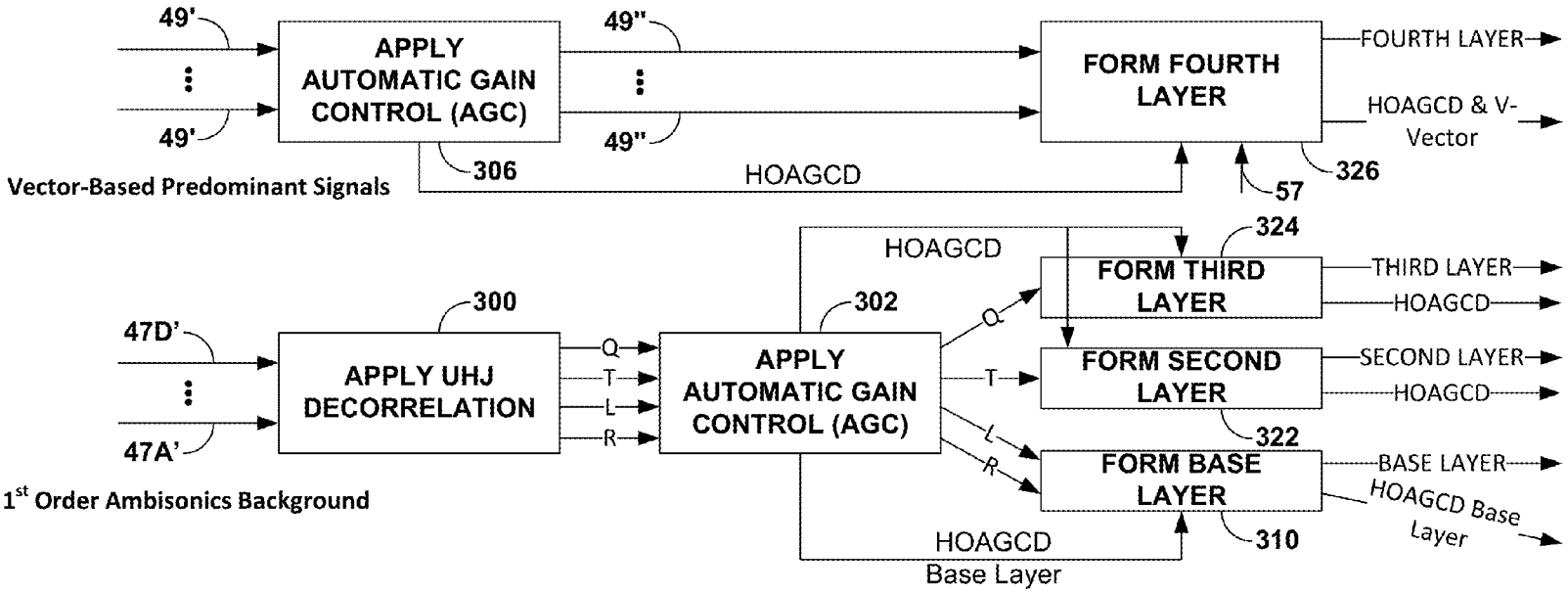
FIGS. 9A and 9B are flowcharts illustrating example operation of the audio encoding device in generating an encoded four-layer representation of the HOA coefficients.
Figure 9B:
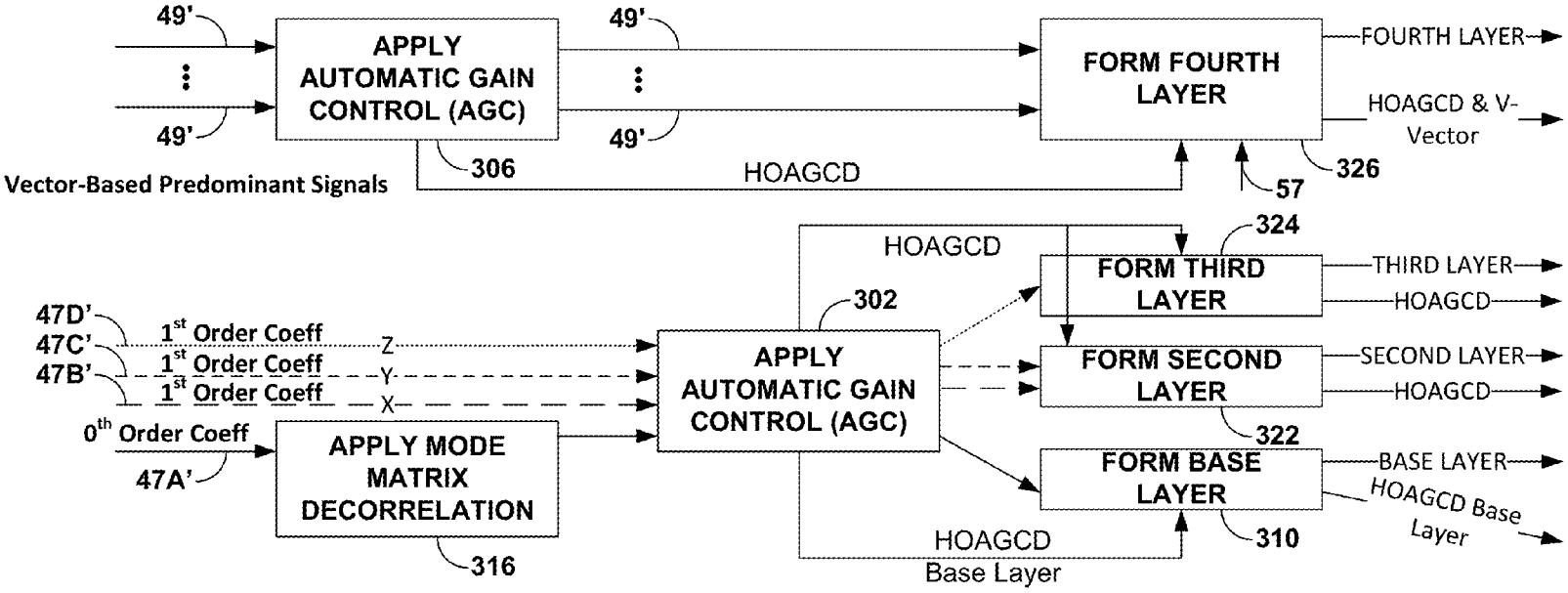

FIGS. 9A and 9B are flowcharts illustrating example operation of the audio encoding device 20 in generating an encoded four-layer representation of the HOA coefficients 11. Referring first to the example of FIG. 9A, the decorrelation unit 60 and the gain control unit 62 may perform operations similar to those described above with respect to FIG. 8A. The bitstream generation unit 42 may form the base layer in a manner similar to that described above with respect to the example of FIG. 8A, i.e., based on the L audio signal and the R audio signal of the adjusted ambient HOA audio signals 67 rather than all of the adjusted ambient HOA audio signals 67 (310). The base layer may, in this respect, provide for stereo channels when rendered at the audio decoding device 24 (or, in other words, provide stereo channel playback). The bitstream generation unit 42 may also generate sideband information for the base layer that includes the HOAGCD.

The operation of the bitstream generation unit 42 may differ from that described above with respect to FIG. 8A in that the bitstream generation unit 42 may form a second layer based on the T audio signal (and not the Q audio signal) of the adjusted ambient HOA audio signals 67 (322). The second layer in the example of FIG. 9A may provide for horizontal channels when rendered at the audio decoding device 24 (or, in other words, multi-channel playback by three or more loudspeakers on a single horizontal plane). The bitstream generation unit 42 may also generate sideband information for the second layer that includes the HOAGCD. The bitstream generation unit 42 may also form a third layer based on the Q audio signal of the adjusted ambient HOA audio signals 67 (324). The third layer may provide for three dimensional playback by three or more speakers arranged on one or more horizontal planes. The bitstream generation unit 42 may form the fourth layer in a manner substantially similar to that described above with respect to forming the third layer in the example of FIG. 8A (326).

The bitstream generation unit 42 may specify the HOA configuration object for the bitstream 21 similar to that described above with respect to FIG. 10. Further, bitstream generation unit 42 of audio encoder 20 sets the MinAmbHoaOrder syntax element 404 to 2 so as to indicate that the 1st order HOA background is transmitted.

Figure 13A:
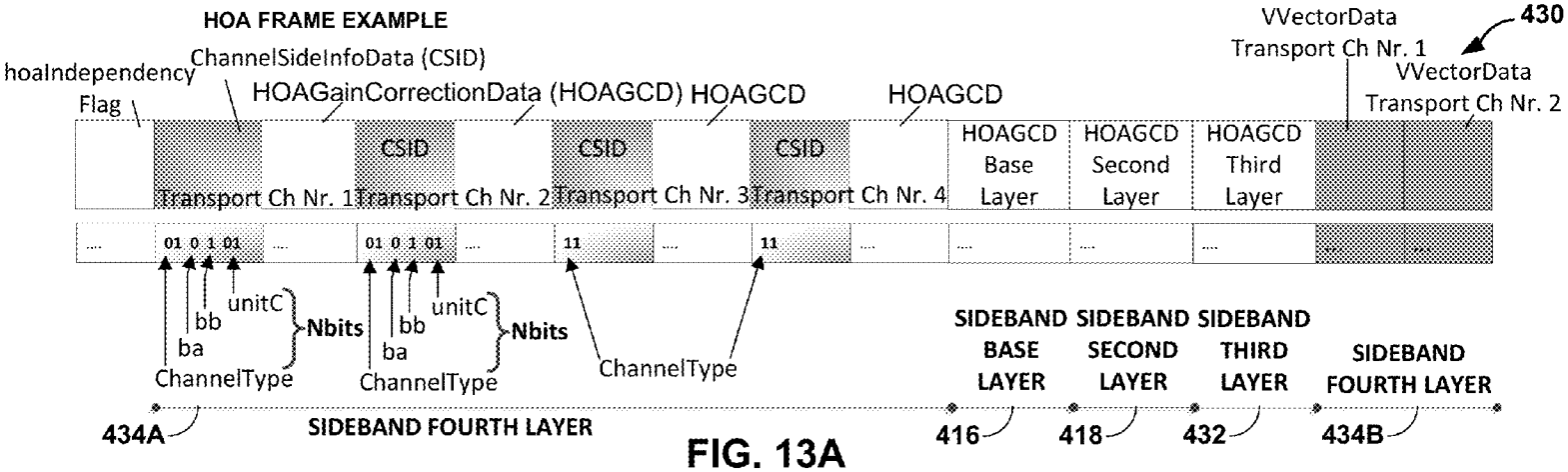
FIGS. 13A and 13B are diagrams illustrating sideband information generated in accordance with the scalable coding aspects of the techniques described in this disclosure.

The bitstream generation unit 42 may also generate sideband information similar to sideband information 412 shown in the example of FIG. 13A. FIG. 13A is a diagram illustrating sideband information 430 generated in accordance with the scalable coding aspects of the techniques described in this disclosure. The sideband information 430 includes sideband base layer information 416, sideband second layer information 418, sideband third layer information 432 and sideband fourth layer information 434A and 434B. The sideband base layer information 416 may provide the HOAGCD for the base layer. The sideband second layer information 418 may provide the HOAGCD for the second layer. The sideband third layer information 430 may provide the HOAGCD for the third layer. The sideband fourth layer information 434A and 434B may be similar to the sideband information 420A and 420B described above with respect to FIG. 12A.

Similar to FIG. 7A, the bitstream generation device 42 may perform error checking processes. In some examples, bitstream generation device 42 may perform an error checking process on the first layer (i.e., the base layer). In another example, the bitstream generation device 42 may perform an error checking process on the first layer (i.e., the base layer) and refrain from performing an error checking process on the remaining layer (i.e., the enhancement layers). In yet another example, the bitstream generation device 42 may perform an error checking process on the first layer (i.e., the base layer) and, in response to determining that the first layer is error free, the audio coding device may perform an error checking process on the second layer (i.e., the enhancement layer). In any of the above examples in which the audio coding device performs the error checking process on the first layer (i.e., the base layer), the first layer may be considered a robust layer that is robust to errors.

Referring next to FIG. 9B, the gain control unit 62 and the bitstream generation unit 42 perform similar operations to that of the gain control unit 62 and the bitstream generation unit 42 described above with respect to FIG. 9A. However, the decorrelation unit 60 may apply a mode matrix decorrelation, rather than the UHJ decorrelation, to the first order ambisonics background 47A' (316). In some examples, the first order ambisonics background 47A' may include the zeroth order ambisonic coefficients 47A'. The gain control unit 62 may apply the automatic gain control to the first order ambisonic coefficients corresponding to the spherical harmonic coefficients having a first order, and the decorrelated ambient HOA audio signal 67 (302).

The bitstream generation unit 42 may form a base layer based on the adjusted ambient HOA audio signal 67 and at least part of the sideband based on the corresponding HOAGCD (310). The ambient HOA audio signal 67 may provide for a mono channel when rendered at the audio decoding device 24. The bitstream generation unit 42 may form a second layer based on the adjusted ambient HOA coefficients 47B" and 47C" and at least part of the sideband based on the corresponding HOAGCD (322). The adjusted ambient HOA coefficients 47B" and 47C" may provide X, Y horizontal multi-channel playback by three or more speakers arranged on a single horizontal plane. The bitstream generation unit 42 may form a third layer based on the adjusted ambient HOA coefficients 47D" and at least part of the sideband based on the corresponding HOAGCD (324). The adjusted ambient HOA coefficients 47D" may provide for three dimensional playback by three or more speakers arranged in one or more horizontal planes. The bitstream generation unit 42 may form the fourth layer and at least part of the sideband information in a manner similar to that described above with respect to FIG. 8A (326). The bitstream generation unit 42 may generate sideband information 412 as described in more detail with respect to FIG. 12B.

Figure 13B:
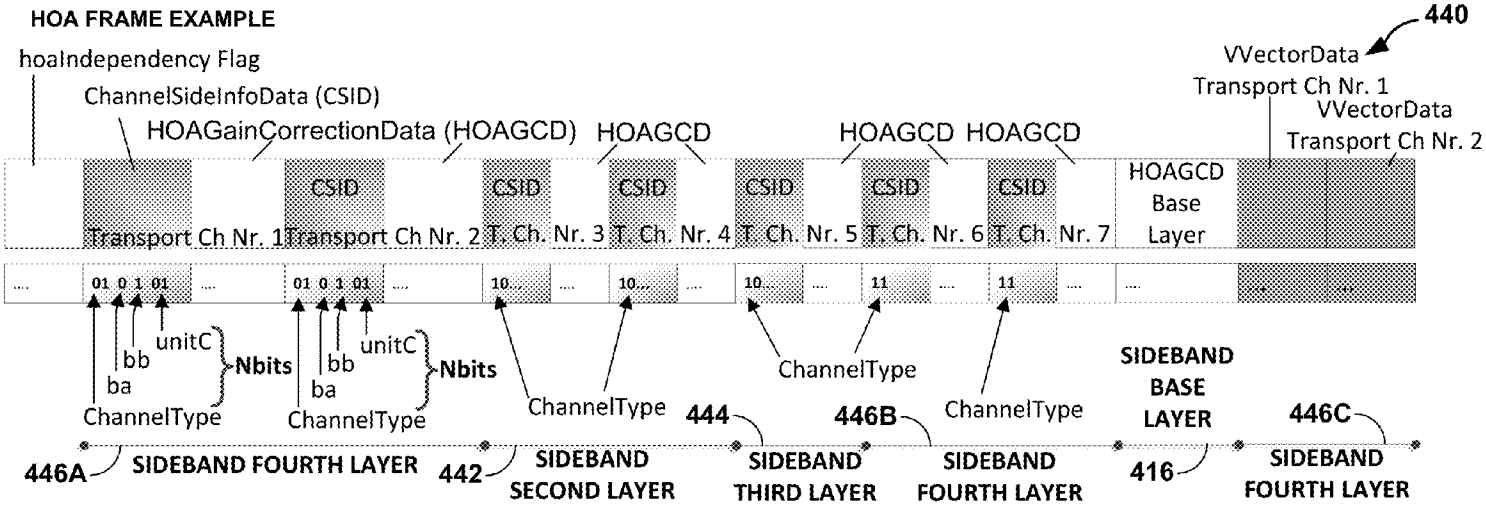

FIG. 13B is a diagram illustrating sideband information 440 generated in accordance with the scalable coding aspects of the techniques described in this disclosure. The sideband information 440 includes sideband base layer information 416, sideband second layer information 442, sideband third layer information 444 and sideband fourth layer information 446A-446C. The sideband base layer information 416 may provide the HOAGCD for the base layer. The sideband second layer information 442 may provide the HOAGCD for the second layer. The sideband third layer information may provide the HOAGCD for the third layer. The sideband fourth layer information 446A-446C may be similar to the sideband information 424A-424C described above with respect to FIG. 12B.

Figure 4:
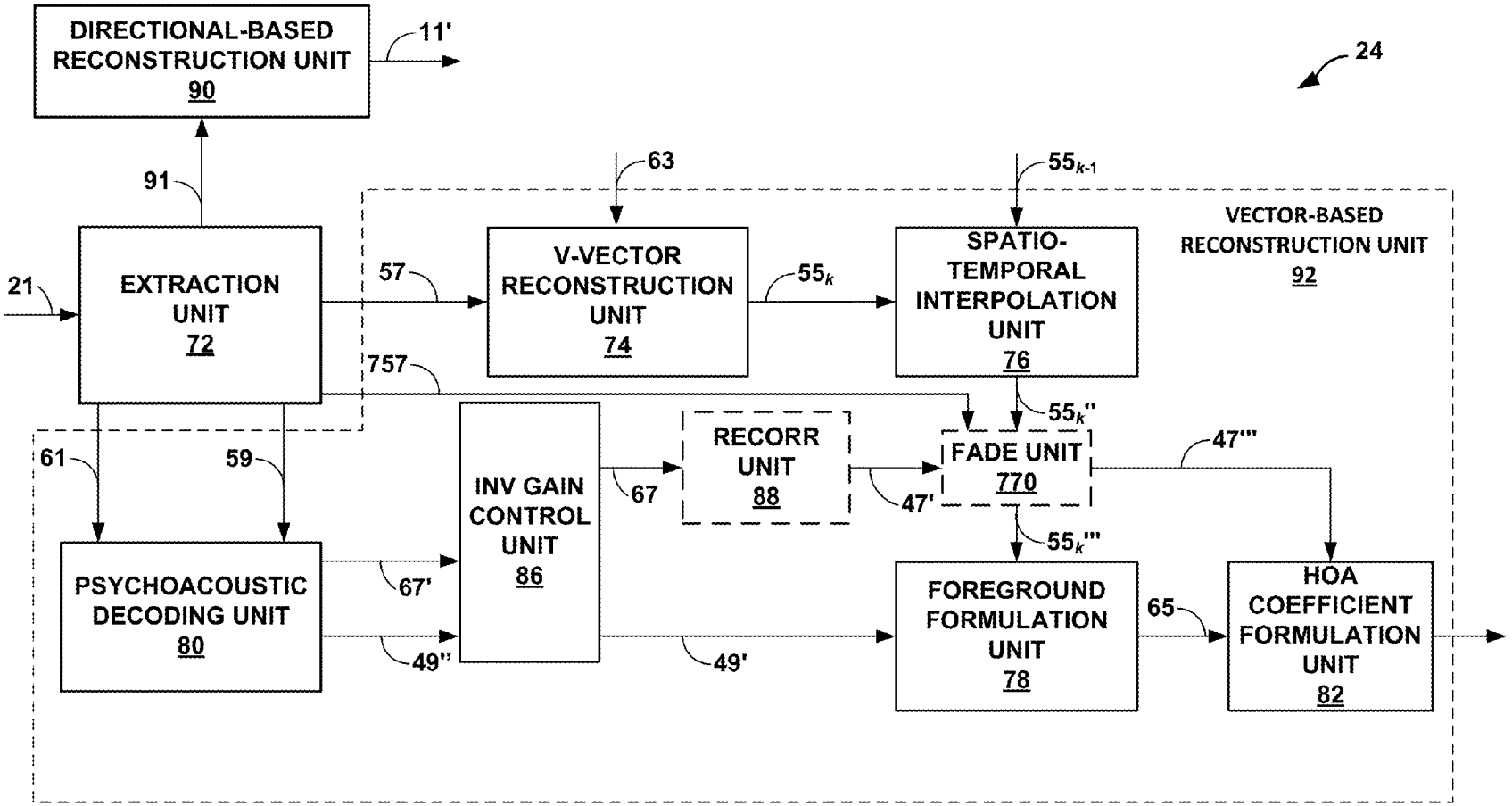
FIG. 4 is a block diagram illustrating the audio decoding device of FIG. 2 in more detail.

FIG. 4 is a block diagram illustrating the audio decoding device 24 of FIG. 2 in more detail. As shown in the example of FIG. 4 the audio decoding device 24 may include an extraction unit 72, a directionality-based reconstruction unit 90 and a vector-based reconstruction unit 92. Although described below, more information regarding the audio decoding device 24 and the various aspects of decompressing or otherwise decoding HOA coefficients is available in International Patent Application Publication No. WO 2014/194099, entitled "INTERPOLATION FOR DECOMPOSED REPRESENTATIONS OF A SOUND FIELD," filed 29 May, 2014. Further information may also be found in the above referenced phase I and phase II of the MPEG-H 3D audio coding standard and the corresponding paper referenced above summarizing phase I of the MPEG-H 3D audio coding standard.

The extraction unit 72 may represent a unit configured to receive the bitstream 21 and extract the various encoded versions (e.g., a directional-based encoded version or a vector-based encoded version) of the HOA coefficients 11. The extraction unit 72 may determine from the above noted syntax element indicative of whether the HOA coefficients 11 were encoded via the various direction-based or vector-based versions. When a directional-based encoding was performed, the extraction unit 72 may extract the directional-based version of the HOA coefficients 11 and the syntax elements associated with the encoded version (which is denoted as directional-based information 91 in the example of FIG. 4), passing the directional based information 91 to the directional-based reconstruction unit 90. The directional-based reconstruction unit 90 may represent a unit configured to reconstruct the HOA coefficients in the form of HOA coefficients 11' based on the directional-based information 91.

When the syntax element indicates that the HOA coefficients 11 were encoded using a vector-based synthesis, the extraction unit 72 may extract the coded foreground V[k] vectors 57 (which may include coded weights 57 and/or indices 63 or scalar quantized V-vectors), the encoded ambient HOA coefficients 59 and the corresponding audio objects 61 (which may also be referred to as the encoded nFG signals 61). The audio objects 61 each correspond to one of the vectors 57. The extraction unit 72 may pass the coded foreground V[k] vectors 57 to the V-vector reconstruction unit 74 and the encoded ambient HOA coefficients 59 along with the encoded nFG signals 61 to the psychoacoustic decoding unit 80. The extraction unit 72 is described in more detail with respect to the example of FIG. 6.

Figure 6:
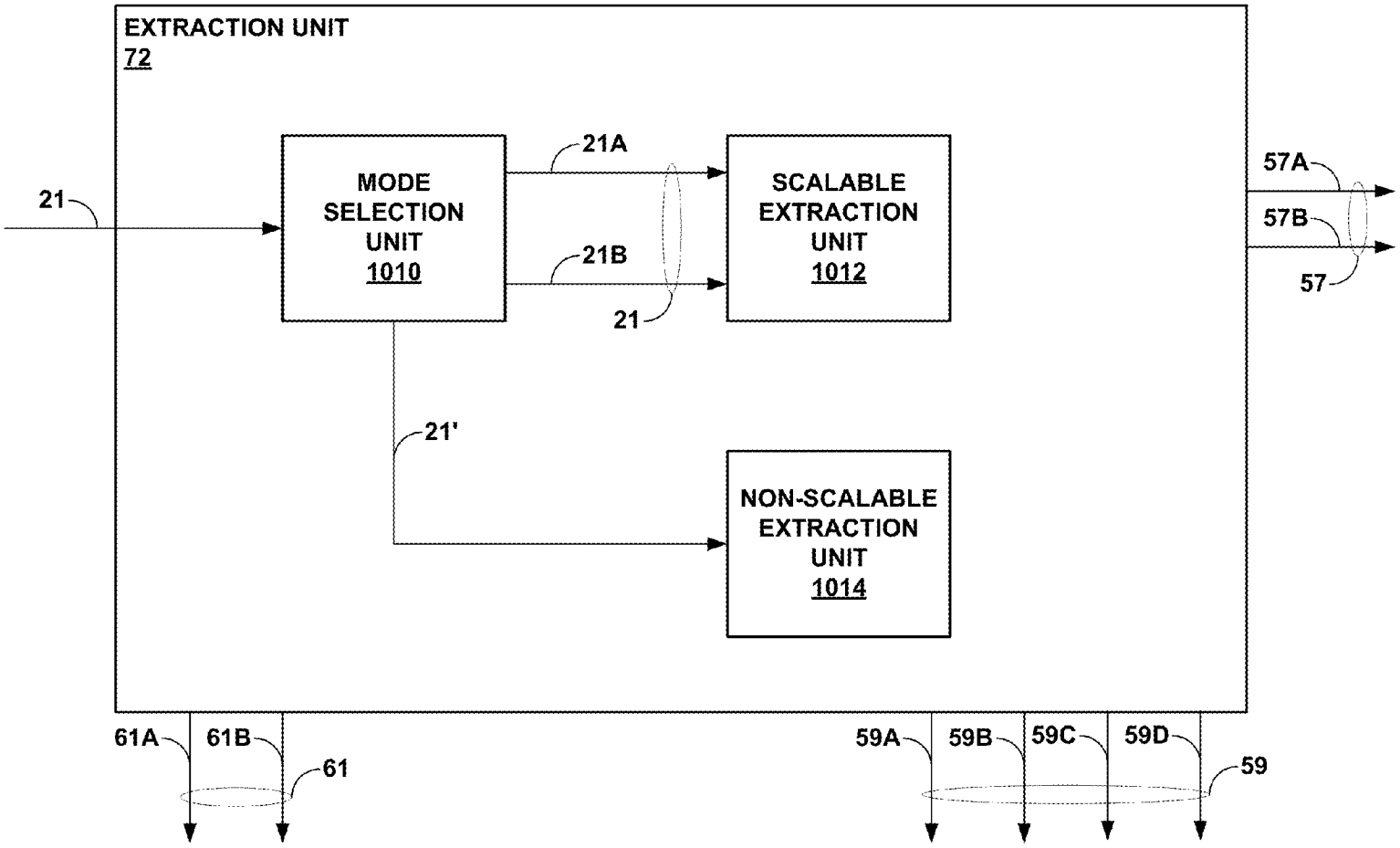
FIG. 6 is a diagram illustrating, in more detail, the extraction unit of FIG. 4 when configured to perform the first one of the potential versions the scalable audio decoding techniques described in this disclosure.

FIG. 6 is a diagram illustrating, in more detail, the extraction unit 72 of FIG. 4 when configured to perform the first one of the potential versions the scalable audio decoding techniques described in this disclosure. In the example of FIG. 6, the extraction unit 72 includes a mode selection unit 1010, a scalable extraction unit 1012 and a non-scalable extraction unit 1014. The mode selection unit 1010 represents a unit configured to select whether scalable or non-scalable extraction is to be performed with respect to the bitstream 21. The mode selection unit 1010 may include a memory to which the bitstream 21 is stored. The mode selection unit 1010 may determine whether scalable or non-scalable extraction is to be performed based on the indication of whether scalable coding has been enabled. A HOABaseLayerPresent syntax element may represent the indication of whether scalable coding was performed when encoding the bitstream 21.

When the HOABaseLayerPresent syntax element indicates that scalable coding has been enabled, the mode selection unit 1010 may identify the bitstream 21 as the scalable bitstream 21 and output the scalable bitstream 21 to the scalable extraction unit 1012. When the HOABaseLayerPresent syntax element indicates that scalable coding has not been enabled, the mode selection unit 1010 may identify the bitstream 21 as the non-scalable bitstream 21' and output the non-scalable bitstream 21' to the non-scalable extraction unit 1014. The non-scalable extraction unit 1014 represents a unit configured to operate in accordance with phase I of the MPEG-H 3D audio coding standard.

The scalable extraction unit 1012 may represent a unit configured to extract one or more of the ambient HOA coefficients 59, the encoded nFG signals 61 and the coded foreground V[k] vectors 57 from one or more layers of the scalable bitstream 21 based on various syntax element described below in more detail (and shown above in various HOADecoderConfig tables). In the example of FIG. 6, the scalable extraction unit 1012 may extract, as one example, the four encoded ambient HOA coefficients 59A-59D from the base layer 21A of the scalable bitstream 21. The scalable extraction unit 1012 may also extract, from the enhancement layer 21B of the scalable bitstream 21, the two encoded nFG signals 61A and 61B (as one example) as well as the two coded foreground V[k] vectors 57A and 57B. The scalable extraction unit 1012 may output the ambient HOA coefficients 59, the encoded nFG signals 61 and the coded foreground V[k] vectors 57 to the vector-based decoding unit 92 shown in the example of FIG. 4.

More specifically, the extraction unit 72 of the audio decoding device 24 may extract channels of the L layers as set forth in the above HOADecoderCofnig_FrameByFrame syntax table.

In accordance with the above HOADecoderCofnig_FrameByFrame syntax table, the mode selection unit 1010 may first obtain the HOABaseLayerPresent syntax element, which may indicate whether scalable audio encoding was performed. When not enabled as specified by, for example, a zero value for the HOABaseLayerPresent syntax element, the mode selection unit 1010 may determine the MinAmbHoaOrder syntax element and provides the non-scalable bitstream to the non-scalable extraction unit 1014, which performs non-scalable extraction processes similar to those described above. When enabled as specified by, for example, a one value for the HOABaseLayerPresent syntax element, the mode selection unit 1010 sets the MinAmbHOAOrder syntax element value to be negative one (−1) and provides the scalable bitstream 21' to the scalable extraction unit 1012.

The scalable extraction unit 1012 may obtain an indication of whether a number of layers of the bitstream have changed in a current frame when compared to a number of layers of the bitstream in a previous frame. The indication of whether the number of layers of the bitstream has changed in the current frame when compared to the number of layers of the bitstream in the previous frame may be denoted as an "HOABaseLayerConfigurationFlag" syntax element in the foregoing table.

The scalable extraction unit 1012 may obtain an indication of a number of layers of the bitstream in the current frame based on the indication. When the indication indicates that the number of layers of the bitstream has not changed in the current frame when compared to the number of layers of the bitstream in the previous frame, the scalable extraction unit 1012 may determine the number of layers of the bitstream in the current frame as equal to the number of layers of the bitstream in the previous frame in accordance with portion of the above syntax table that states:

```
...
} else }
    NumLayers = NumLayersPrevFrame;
```

where the "NumLayers" may represent a syntax element representing the number of layers of the bitstream in the current frame and the "NumLayersPrevFrame" may represent a syntax element representing the number of layers of the bitstream in the previous frame.

According to the above HOADecoderConfig_FrameBy-Frame syntax table, the scalable extraction unit 1012 may, when the indication indicates that the number of layers of the bitstream has not changed in the current frame when compared to the number of layers of the bitstream in the previous frame, determine a current foreground indication of a current number of foreground components in one or more of the layers for the current frame to be equal to a previous foreground indication for a previous number of foreground components in one or more of the layers of the previous frame. In other words, the scalable extraction unit 1012 may, when the HOABaseLayerConfigurationFlag is equal to zero, determine the NumFGchannels[i] syntax element representative of the current foreground indication of the current number of foreground component in one or more of the layers of the current frame to be equal to the NumFGchannels_PrevFrame[i] syntax element that is representative of the previous foreground indication of the previous number of foreground components in the one or more layers of the previous frame. The scalable extraction unit 1012 may further obtain the foreground components from the one or more layers in the current frame based on the current foreground indication.

The scalable extraction unit 1012 may also, when the indication indicates that the number of layers of the bitstream has not changed in the current frame when compared to the number of layers of the bitstream in the previous frame, determine a current background indication of a current number of background components in one or more of the layers for the current frame to be equal to a previous background indication for a previous number of background components in one or more of the layers of the previous frame. In other words, the scalable extraction unit 1012 may, when the HOABaseLayerConfigurationFlag is equal to zero, determine the NumBGchannels[i] syntax element representative of the current background indication of the current number of background component in one or more of the layers of the current frame to be equal to the NumBGchannels_PrevFrame[i] syntax element that is representative of the previous background indication of the previous number of background components in the one or more layers of the previous frame. The scalable extraction unit 1012 may further obtain the background components from the one or more layers in the current frame based on the current background indication.

To enable the foregoing techniques that may potentially reduce signaling of various indications of the number of layers, foreground components and background components, the scalable extraction unit 1012 may set the NumFGchannels_PrevFrame[i] syntax element and the NumBGchannel_PrevFrame[i] syntax element to the indications for the current frame (e.g., the NumFGchannels[i] syntax element and the NumBGchannels[i]), iterating through all i layers. This is represented in the following syntax:

```
NumLayersPrevFrame=NumLayers;
for i=1:NumLayers {
  NumFGchannels_PrevFrame[i] = NumFGchannels[i];
  NumBGchannels_PrevFrame[i] = NumBGchannels[i];
}
```

When the indication indicates that the number of layers of the bitstream has changed in the current frame when compared to the number of layers of the bitstream in the previous frame (e.g., when the HOABaseLayerConfigurationFlag is equal to one), the scalable extraction unit 1012 obtains the NumLayerBits syntax element as a function of the numHOATransportChannels, which is passed into the syntax table having been obtained in accordance with other syntax tables not described in this disclosure.

The scalable extraction unit 1012 may obtain an indication of the number of layers specified in the bitstream (e.g. the NumLayers syntax element), where the indication may have a number of bits indicated by the NumLayerBits syntax element. The NumLayers syntax element may specify the number of layers specified in the bitstream, where the number of layers may be denoted as L above. The scalable extraction unit 1012 may next determining the numAvailableTransportChannels as a function of the numHOATransportChannels and the numAvailable TransportChannelBits as a function of the numAvailableTransportChannels.

The scalable extraction unit 1012 may then iterate through the NumLayers from 1 to NumLayers−1 to determine the number of background HOA channels ($B_i$) and the number of foreground HOA channels ($F_i$) specified for the i-th layer. The scalable extraction unit 1012 may not iterate through the number of last layer (NumLayer) and only through the NumLayer-1 as the last layer $B_L$ may be determined when the total number of foreground and background HOA channels sent in the bitstream are known by the scalable extraction unit 1012 (e.g., when the total number of foreground and background HOA channels are signaled as syntax elements).

In this respect, the scalable extraction unit 1012 may obtain the layers of the bitstream based on the indication of the number of layers. The scalable extraction unit 1012 may, as described above, obtain an indication of a number of channels specified in the bitstream 21 (e.g., numHOATransportChannels), and obtain the layers, by at least in part, obtain the layers of the bitstream 21 based on the indication of the number of layers and the indication of the number of channels.

When iterating through each layer, the scalable extraction unit 1012 may first determine the number of foreground channels for the i-th layer by obtaining the NumFGchannels [i] syntax element. The scalable extraction unit 1012 may then subtract the NumFGchannels[i] from the numAvailableTransportChannels to update the NumAvailableTransportChannels and reflect that NumFGchannels [i] of the foreground HOA channels 61 (which may also be referred to as the "encoded nFG signals 61") have been extracted from the bitstream. In this way, the scalable extraction unit 1012 may obtain an indication of a number of foreground channels specified in the bitstream 21 for at least one of the layers (e.g., NumFGchannels) and obtain the foreground channels for the at least one of the layers of the bitstream based on the indication of the number of foreground channels.

Likewise, the scalable extraction unit 1012 may determine the number of background channels for the i-th layer by obtaining the NumBGchannels[i] syntax element. The scalable extraction unit 1012 may then subtract the NumBGchannels[i] from the numAvailableTransportChannels to reflect that NumBGchannels[i] of the background HOA channels 59 (which may also be referred to as the "encoded ambient HOA coefficients 59") have been extracted from the bitstream. In this way, the scalable extraction unit 1012 may obtain an indication of a number of background channels (e.g., NumBGChannels) specified in the bitstream 21 for at least one of the layers, and obtain the background channels for the at least one of the layers of the bitstream based on the indication of the number of background channels.

The scalable extraction unit 1012 may continue by obtaining the numAvailableTransportChannelsBits as a function of the numAvailableTransports. Per the above syntax table, the scalable extraction unit 1012 may parse the number of bits specified by the numAvailableTransportChannelsBits to determine the NumFGchannels[i] and the NumBGchannels [i]. Given that the numAvailableTransportChannelBits changes (e.g., becomes smaller after each iteration), the number of bits used to represent the NumFGchannels[i] syntax element and the NumBGchannels [i] syntax element reduces, thereby provides a form of variable length coding that potentially reduces overhead in signaling the NumFGchannels[i] syntax element and the NumBGchannels [i] syntax element.

As noted above, the scalable bitstream generation unit 1000 may specify the NumChannels syntax element in place of the NumFGchannels and NumBGchannels syntax elements. In this instance, the scalable extraction unit 1012 may be configured to operate in accordance with the second HOADecoderConfig syntax table shown above.

In this respect, the scalable extraction unit 1012 may, when the indication indicates that the number of layers of the bitstream has changed in the current frame when compared to the number of layers of the bitstream in the previous frame, obtain an indication of a number of components in one or more of the layers for the current frame based on the a number of components in one or more of the layers of the previous frame. The scalable extraction unit 1012 may further obtain an indication of a number of background components in the one or more layers for the current frame based on the indication of the number of components. The scalable extraction unit 1012 may also obtain an indication of a number of foreground components in the one or more layers for the current frame based on the indication of the number of components.

Given that the number of layers may change from frame to frame that the indication of the number of foreground and background channels may change from frame to frame, the indication that the number of layers has changed may effectively also indicate that the number of channels has changed. As a result, the indication that the number of layers has changed may result in the scalable extraction unit 1012 obtaining an indication of whether the number of channels specified in one or more layers in the bitstream 21 has changed in a current frame when compared to a number of channels specified in one or more layers in the bitstream of the previous frame. As such, the scalable extraction unit 1012 may obtain the one of the channels based on the indication of whether the number of channels specified in one or more layers in the bitstream has changed in the current frame.

Moreover, the scalable extraction unit 1012 may determine the number of channels specified in the one or more layers of the bitstream 21 in the current frame as the same as the number of channels specified in the one or more layers of the bitstream 21 in the previous frame when the indication indicates that the number of channels specified in the one or more layers of the bitstream 21 has not changed in the current frame when compared to the number of channels specified in the one or more layers of the bitstream in the previous frame.

In addition, the scalable extraction unit 1012 may, when the indication indicates that the number of channels specified in the one or more layers of the bitstream 21 has not changed in the current frame when compared to the number of channels specified in the one or more layers of the bitstream in the previous frame, obtain an indication of a current number of channels in one or more of the layers for the current frame to be the same as a previous number of channels in one or more of the layers of the previous frame.

To enable the foregoing techniques that may potentially reduce signaling of various indications of the number of layers and components (which may also be referred to as "channels" in this disclosure), the scalable extraction unit 1012 may set the NumChannels_PrevFrame[i] syntax element to the indications for the current frame (e.g., the NumChannels[i] syntax element), iterating through all i layers. This is represented in the following syntax:

```
NumLayersPrevFrame=NumLayers;
for i=1:NumLayers {
  NumChannels_PrevFrame[i] = NumChannels[i];
}
```

Alternatively, the foregoing syntax (NumLayersPrevFrame=NumLayers etc.) may be omitted and the syntax table HOADecoderConfig(numHOATransportChannels) listed above may be updated as set forth in the following table:

| Syntax | No. of bits | Mnemonic |
|---|---|---|
| HOADecoderConfig(numHOATransport Channels) | | |
| { | | |
| HOALayerPresent; | 1 | bslbf |
| if(HOALayerPresent){ | | |
| NumLayerBits = ceil(log2(numHOATransportChannels–2)); | | |
| NumLayers = NumLayers+2; | NumLayerBits | uimsbf |

-continued

| Syntax | No. of bits | Mnemonic |
|---|---|---|
| numAvailableTransportChannels = numHOATransportChannels−2; numAvailableTransportChannelsBits = NumLayerBits; | | |
| for (i=0; i<NumLayers−1; ++i) { | | |
| NumChannels[i] = NumChannels[i]+1; | numAvailableTransportChannelsBits | uimsbf |
| numAvailableTransportChannels = numAvailableTransportChannels − NumChannels[i]; numAvailableTransportChannelsBits = ceil(log2(numAvailableTransportChannels)); | | |
| } | | |
| } | | |
| MinAmbHoaOrder = escapedValue(3,5,0) − 1; | 3,8 | uimsbf |
| MinNumOfCoeffsForAmbHOA = (MinAmbHoaOrder + 1)^2; | | |
| . | | |
| . | | |
| . | | |
| } | | |

As yet another alternative, the extraction unit 72 may operate in accordance with the third HOADecoder Config listed above. In accordance with the third HOADecoder-Config syntax table listed above, the scalable extraction unit 1012 may be configured to obtain, from the scalable bitstream 21, an indication of a number of channels specified in one or more layers in the bitstream, and obtain the channels specified in the one or more layers in the bitstream based on the indication of the number of channels (which may refer to a background component or a foreground component of the soundfield). In these and other instances, the scalable extraction unit 1012 may be configured to obtain a syntax element (e.g., the codedLayerCh in the above referenced table) indicative of the number of channels.

In these and other instances, the scalable extraction unit 1012 may be configured to obtain an indication of a total number of channels specified in the bitstream. The scalable extraction unit 1012 may also be configured to obtain the channels specified in the one or more layers based on the indication of the number of channels specified in the one or more layers and the indication of the total number of channels. In these and other instances, the scalable extraction unit 1012 may be configured to obtain a syntax element (e.g. the above noted NumHOATransportChannels syntax element) indicative of the total number of channels.

In these and other instances, the scalable extraction unit 1012 may be configured to obtain an indication a type of one of the channels specified in the one or more layers in the bitstream. The scalable extraction unit 1012 may also be configured to obtain the one of the channels based on the indication of the number of layers and the indication of the type of the one of the channels.

In these and other instances, the scalable extraction unit 1012 may be configured to obtain an indication a type of one of the channels specified in the one or more layers in the bitstream, the indication of the type of the one of the channels indicating that the one of the channels is a foreground channel. The scalable extraction unit 1012 may be configured to obtain the one of the channels based on the indication of the number of layers and the indication that the type of the one of the channels is the foreground channel. In these instances, the one of the channels comprises a US audio object and a corresponding V-vector.

In these and other instances, the scalable extraction unit 1012 may be configured to obtain an indication a type of one of the channels specified in the one or more layers in the bitstream, the indication of the type of the one of the channels indicating that the one of the channels is a background channel. In these instances, the scalable extraction unit 1012 may also be configured to obtain the one of the channels based on the indication of the number of layers and the indication that the type of the one of the channels is the background channel. In these instances, the one of the channels comprises a background higher order ambisonic coefficient.

In these and other instances, the scalable extraction unit 1012 may be configured to obtain a syntax element (e.g., the ChannelType syntax element described above with respect to FIG. 30) indicative of the type of the one of the channels.

In these and other instances, the scalable extraction unit 1012 may be configured to obtain the indication of the number of channels based on a number of channels remaining in the bitstream after one of the layers is obtained. That is, the value of the HOALayerChBits syntax element varies as a function of the remainingCh syntax element as set forth in the above syntax table throughout the course of the while loop. The scalable extraction unit 1012 may then parse the codedLayerCh syntax element based on the changing HOALayerChBits syntax element.

Returning to the example of the four background channels and the two foreground channels, the scalable extraction unit 1012 may receive an indication that the number of layers is two, i.e., the base layer 21A and the enhancement layer 21B in the example of FIG. 6. The scalable extraction unit 1012 may obtain an indication that the number of foreground channels is zero for the base layer 21A (e.g., from NumFGchannels[0]) and two for the enhancement layer 21B (e.g., from NumFGchannels[1]). The scalable extraction unit 1012 may, in this example, also obtain an indication that the number of background channels is four for the base layer 21A (e.g., from NumBGchannels[0]) and zero for the enhancement layer 21B (e.g., from NumBGchannels[1]). Although described with respect to a particular example, any different combination of background and foreground channels may be indicated. The scalable extraction unit 1012 may then extract the specified four background channels 59A-59D from the base layer 21A and the two foreground channels 61A and 61B from the enhancement layer 21B (along with the corresponding V-vector information 57A and 57B from the sideband information).

Although described above with respect to the NumFGchannels and the NumBGchannels syntax element, the techniques may also be performed using the ChannelType syntax element from the ChannelSideInfo syntax table above. In this respect, the NumFGchannels and the NumBG channels may also represent an indication of a type of one of the channels. In other words, the NumBGchannels may represent an indication that a type of one of the channels is a background channel. The NumFG channels may represent an indication that a type of one of the channels is a foreground channel.

As such, whether the ChannelType syntax element or the NumFGchannels syntax element with the NumBGchannels syntax element are used (or potentially both or some subset of either), the scalable bitstream extraction unit 1012 may obtain an indication of a type of one of the channels specified in the one or more layers in the bitstream. The scalable bitstream extraction unit 1012 may, when the indication of the type indicates that the one of the channels is a background channel, obtain the one of the channels based on the indication of the number of layers and the indication that the type of the one of the channels is the background channel. The scalable bitstream extraction unit 1012 may, when the indication of the type indicates that the one of the channels is a foreground channel, obtain the one of the channels based on the indication of the number of layers and the indication that the type of the one of the channels is the foreground channel.

The V-vector reconstruction unit 74 may represent a unit configured to reconstruct the V-vectors from the encoded foreground V[k] vectors 57. The V-vector reconstruction unit 74 may operate in a manner reciprocal to that of the quantization unit 52.

The psychoacoustic decoding unit 80 may operate in a manner reciprocal to the psychoacoustic audio coder unit 40 shown in the example of FIG. 3 so as to decode the encoded ambient HOA coefficients 59 and the encoded nFG signals 61 and thereby generate adjusted ambient HOA audio signals 67' and the adjusted interpolated nFG signals 49" (which may also be referred to as adjusted interpolated nFG audio objects 49'). The psychoacoustic decoding unit 80 may pass the adjusted ambient HOA audio signals 67' and the adjusted interpolated nFG signals 49" to the inverse gain control unit 86.

The inverse gain control unit 86 may represent a unit configured to perform an inverse gain control with respect to each of the adjusted ambient HOA audio signals 67' and the adjusted interpolated nFG signals 49", where this inverse gain control is reciprocal to the gain control performed by the gain control unit 62. The inverse gain control unit 86 may perform the inverse gain control in accordance with the corresponding HOAGCD specified in the sideband information discussed above with respect to the examples of FIGS. 11-13B. The inverse gain control unit 86 may output decorrelated ambient HOA audio signals 67 to the recorrelation unit 88 (shown as "recorr unit 88" in the example of FIG. 4) and the interpolated nFG audio signals 49" to the foreground formulation unit 78.

The recorrelation unit 88 may implement techniques of this disclosure to reduce correlation between background channels of the decorrelated ambient HOA audio signals 67 to reduce or mitigate noise unmasking. In examples where the recorrelation unit 88 applies a UHJ matrix (e.g., an inverse UHJ matrix) as the selected recorrelation transform, the recorrelation unit 81 may improve compression rates and conserve computing resources by reducing data processing operations.

In some examples, the scalable bitstream 21 may include one or more syntax elements that indicate that a decorrelation transform was applied during encoding. The inclusion of such syntax elements in the vector-based bitstream 21 may enable recorrelation unit 88 to perform reciprocal decorrelation (e.g., correlation or recorrelation) transforms on the decorrelated ambient HOA audio signals 67. In some examples, the signal syntax elements may indicate which decorrelation transform was applied, such as the UHJ matrix or the mode matrix, thereby enabling the recorrelation unit 88 to select the appropriate recorrelation transform to apply to the decorrelated HOA audio signals 67.

The recorrelation unit 88 may perform the recorrelation with respect to the decorrelated ambient HOA audio signals 67 to obtain energy compensated ambient HOA coefficients 47'. The recorrelation unit 88 may output the energy compensated ambient HOA coefficients 47' to the fade unit 770. Although described as performing the decorrelation, in some examples no decorrelation may have been performed. As such, the vector-based reconstruction unit 92 may not perform or in some examples include a recorrelation unit 88. The absence of the recorrelation unit 88 in some examples is denoted by the dashed line of the recorrelation unit 88.

The spatio-temporal interpolation unit 76 may operate in a manner similar to that described above with respect to the spatio-temporal interpolation unit 50. The spatio-temporal interpolation unit 76 may receive the reduced foreground V[k] vectors $\mathbf{55}_k$ and perform the spatio-temporal interpolation with respect to the foreground V[k] vectors $\mathbf{55}_k$ and the reduced foreground V[k−1] vectors $\mathbf{55}_{k-1}$ to generate interpolated foreground V[k] vectors $\mathbf{55}_k$". The spatio-temporal interpolation unit 76 may forward the interpolated foreground V[k] vectors $\mathbf{55}_k$" to the fade unit 770.

The extraction unit 72 may also output a signal 757 indicative of when one of the ambient HOA coefficients is in transition to fade unit 770, which may then determine which of the $SHC_{BG}$ 47' (where the $SHC_{BG}$ 47' may also be denoted as "ambient HOA channels 47'" or "ambient HOA coefficients 47'") and the elements of the interpolated foreground V[k] vectors $\mathbf{55}_k$" are to be either faded-in or faded-out. In some examples, the fade unit 770 may operate opposite with respect to each of the ambient HOA coefficients 47' and the elements of the interpolated foreground V[k] vectors $\mathbf{55}_k$". That is, the fade unit 770 may perform a fade-in or fade-out, or both a fade-in or fade-out with respect to corresponding one of the ambient HOA coefficients 47', while performing a fade-in or fade-out or both a fade-in and a fade-out, with respect to the corresponding one of the elements of the interpolated foreground V[k] vectors $\mathbf{55}_k$". The fade unit 770 may output adjusted ambient HOA coefficients 47" to the HOA coefficient formulation unit 82 and adjusted foreground V[k] vectors $\mathbf{55}_k$'" to the foreground formulation unit 78. In this respect, the fade unit 770 represents a unit configured to perform a fade operation with respect to various aspects of the HOA coefficients or derivatives thereof, e.g., in the form of the ambient HOA coefficients 47' and the elements of the interpolated foreground V[k] vectors $\mathbf{55}_k$".

The foreground formulation unit 78 may represent a unit configured to perform matrix multiplication with respect to the adjusted foreground V[k] vectors $55_k'''$ and the interpolated nFG signals 49' to generate the foreground HOA coefficients 65. In this respect, the foreground formulation unit 78 may combine the audio objects 49' (which is another way by which to denote the interpolated nFG signals 49') with the vectors $55_k'''$ to reconstruct the foreground or, in other words, predominant aspects of the HOA coefficients 11'. The foreground formulation unit 78 may perform a matrix multiplication of the interpolated nFG signals 49' by the adjusted foreground V[k] vectors $55_k'''$.

The HOA coefficient formulation unit 82 may represent a unit configured to combine the foreground HOA coefficients 65 to the adjusted ambient HOA coefficients 47" so as to obtain the HOA coefficients 11'. The prime notation reflects that the HOA coefficients 11' may be similar to but not the same as the HOA coefficients 11. The differences between the HOA coefficients 11 and 11' may result from loss due to transmission over a lossy transmission medium, quantization or other lossy operations.

Figure 14A:
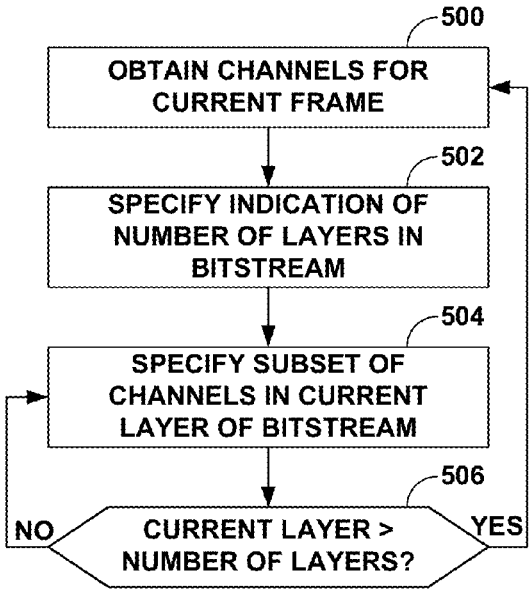
FIGS. 14A and 14B are flowcharts illustrating example operations of audio encoding device in performing various aspects of the techniques described in this disclosure.
Figure 14B:
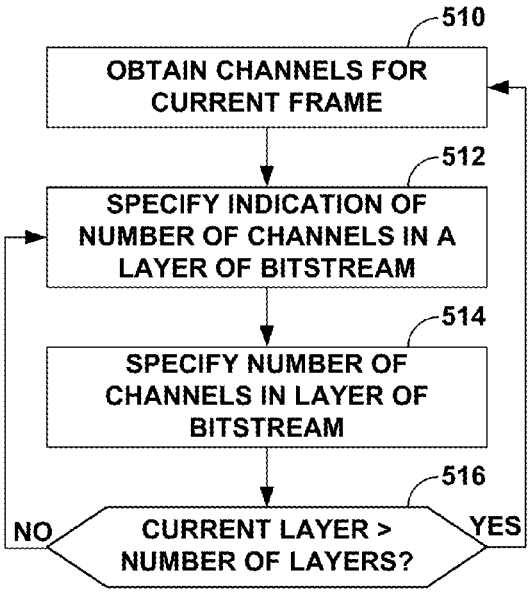

FIGS. 14A and 14B are flowcharts illustrating example operations of audio encoding device 20 in performing various aspects of the techniques described in this disclosure. Referring first to the example of FIG. 14A, the audio encoding device 20 may obtain channels for a current frame of HOA coefficients 11 in the manner described above (e.g., a linear decomposition, interpolation, etc.) (500). The channels may comprise encoded ambient HOA coefficients 59, encoded nFG signals 61 (and corresponding sideband in the form of coded foreground V-vectors 57) or both encoded ambient HOA coefficient 59 and encoded nFG signals 61 (and corresponding sideband in the form of coded foreground V-vectors 57).

The bitstream generation unit 42 of the audio encoding device 20 may then specify an indication of a number of layers in the scalable bitstream 21 in the manner described above (502). The bitstream generation unit 42 may specify a subset of the channels in the current layer of the scalable bitstream 21 (504). The bitstream generation unit 42 may maintain a counter for the current layer, where the counter provides an indication of the current layer. After specifying the channels in the current layer, the bitstream generation unit 42 may increment the counter.

The bitstream generation unit 42 may then determine whether the current layer (e.g., the counter) is greater than the number of layers specified in the bitstream (506). When the current layer is not greater than the number of layers ("NO" 506), the bitstream generation unit 42 may specify a different subset of the channels in the current layer (which changed when the counter was incremented) (504). The bitstream generation unit 42 may continue in this manner until the current layer is greater than the number of layers ("YES" 506). When the current layer is greater than the number of layers ("YES" 506), the bitstream generation unit may proceed to the next frame with the current frame becoming the previous frame and obtain the channels for the now current frame of the scalable bitstream 21 (500). The process may continue until reaching the last frame of the HOA coefficients 11 (500-506). As noted above, in some examples, the indication of the number of layers may not be explicitly indicated but implicitly specified in the scalable bitstream 21 (e.g., when the number of layers has not changed from the previous frame to the current frame).

Referring next to the example of FIG. 14B, the audio encoding device 20 may obtain channels for a current frame of HOA coefficients 11 in the manner described above (e.g., a linear decomposition, interpolation, etc.) (510). The channels may comprise encoded ambient HOA coefficients 59, encoded nFG signals 61 (and corresponding sideband in the form of coded foreground V-vectors 57) or both encoded ambient HOA coefficient 59 and encoded nFG signals 61 (and corresponding sideband in the form of coded foreground V-vectors 57).

The bitstream generation unit 42 of the audio encoding device 20 may then specify an indication of a number of channels in a layer of the scalable bitstream 21 in the manner described above (512). The bitstream generation unit 42 may specify the corresponding channels in the current layer of the scalable bitstream 21 (514).

The bitstream generation unit 42 may then determine whether the current layer (e.g., the counter) is greater than a number of layers (516). That is, in the example of FIG. 14B, the number of layers may be static or fixed (rather than specified in the scalable bitstream 21), while the number of channels per layer may be specified, unlike the example of FIG. 14A where the number of channels may be static or fixed and not signaled. The bitstream generation unit 42 may still maintain the counter indicative of the current layer.

When the current layer (as indicated by the counter) is not greater than the number of layers ("NO" 516), the bitstream generation unit 42 may specify another indication of the number of channels in another layer of the scalable bitstream 21 for the now current layer (which changed due to incrementing the counter) (512). The bitstream generation unit 42 may also specify the corresponding number of channels in the additional layer of the bitstream 21 (514). The bitstream generation unit 42 may continue in this manner until the current layer is greater than the number of layers ("YES" 516). When the current layer is greater than the number of layers ("YES" 516), the bitstream generation unit may proceed to the next frame with the current frame becoming the previous frame and obtain the channels for the now current frame of the scalable bitstream 21 (510). The process may continue until reaching the last frame of the HOA coefficients 11 (510-516).

As noted above, in some examples, the indication of the number of channels may not be explicitly indicated but implicitly specified in the scalable bitstream 21 (e.g., when the number of layers has not changed from the previous frame to the current frame). Moreover, although described as separate processes, the techniques described with respect to FIGS. 14A and 14B may be performed in combination in the manner described above.

Figure 15A:
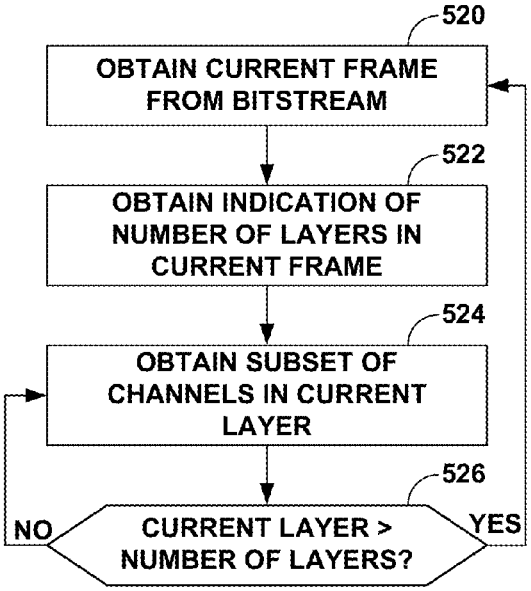
FIGS. 15A and 15B are flowcharts illustrating example operations of audio decoding device in performing various aspects of the techniques described in this disclosure.
Figure 15B:
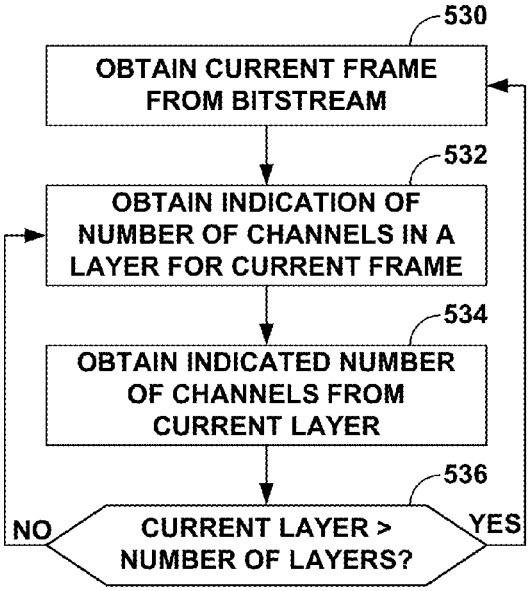

FIGS. 15A and 15B are flowcharts illustrating example operations of audio decoding device 24 in performing various aspects of the techniques described in this disclosure. Referring first to the example of FIG. 15A, the audio decoding device 24 may obtain a current frame from the scalable bitstream 21 (520). The current frame may include one or more layers, each of which may include one or more channels. The channels may comprise encoded ambient HOA coefficients 59, encoded nFG signals 61 (and corresponding sideband in the form of coded foreground V-vectors 57) or both encoded ambient HOA coefficient 59 and encoded nFG signals 61 (and corresponding sideband in the form of coded foreground V-vectors 57).

The extraction unit 72 of the audio decoding device 24 may then obtain an indication of a number of layers in the current frame of the scalable bitstream 21 in the manner described above (522). The extraction unit 72 may obtain a subset of the channels in the current layer of the scalable bitstream 21 (524). The extraction unit 72 may maintain a counter for the current layer, where the counter provides an indication of the current layer. After specifying the channels in the current layer, the extraction unit 72 may increment the counter.

The extraction unit 72 may then determine whether the current layer (e.g., the counter) is greater than the number of layers specified in the bitstream (526). When the current layer is not greater than the number of layers ("NO" 526), the extraction unit 72 may obtain a different subset of the channels in the current layer (which changed when the counter was incremented) (524). The extraction unit 72 may continue in this manner until the current layer is greater than the number of layers ("YES" 526). When the current layer is greater than the number of layers ("YES" 526), the extraction unit 72 may proceed to the next frame with the current frame becoming the previous frame and obtain the now current frame of the scalable bitstream 21 (520). The process may continue until reaching the last frame of the scalable bitstream 21 (520-526). As noted above, in some examples, the indication of the number of layers may not be explicitly indicated but implicitly specified in the scalable bitstream 21 (e.g., when the number of layers has not changed from the previous frame to the current frame).

Referring next to the example of FIG. 15B, the audio decoding device 24 may obtain a current frame from the scalable bitstream 21 (530). The current frame may include one or more layers, each of which may include one or more channels. The channels may comprise encoded ambient HOA coefficients 59, encoded nFG signals 61 (and corresponding sideband in the form of coded foreground V-vectors 57) or both encoded ambient HOA coefficient 59 and encoded nFG signals 61 (and corresponding sideband in the form of coded foreground V-vectors 57).

The extraction unit 72 of the audio decoding device 24 may then obtain an indication of a number of channels in a layer of the scalable bitstream 21 in the manner described above (532). The bitstream generation unit 42 may obtain the corresponding number of channels from the current layer of the scalable bitstream 21 (534).

The extraction unit 72 may then determine whether the current layer (e.g., the counter) is greater than a number of layers (536). That is, in the example of FIG. 15B, the number of layers may be static or fixed (rather than specified in the scalable bitstream 21), while the number of channels per layer may be specified, unlike the example of FIG. 15A where the number of channels may be static or fixed and not signaled. The extraction unit 72 may still maintain the counter indicative of the current layer.

When the current layer (as indicated by the counter) is not greater than the number of layers ("NO" 536), the extraction unit 72 may obtain another indication of the number of channels in another layer of the scalable bitstream 21 for the now current layer (which changed due to incrementing the counter) (532). The extraction unit 72 may also specify the corresponding number of channels in the additional layer of the bitstream 21 (514). The extraction unit 72 may continue in this manner until the current layer is greater than the number of layers ("YES" 516). When the current layer is greater than the number of layers ("YES" 516), the bitstream generation unit may proceed to the next frame with the current frame becoming the previous frame and obtain the channels for the now current frame of the scalable bitstream 21 (510). The process may continue until reaching the last frame of the HOA coefficients 11 (510-516).

As noted above, in some examples, the indication of the number of channels may not be explicitly indicated but implicitly specified in the scalable bitstream 21 (e.g., when the number of layers has not changed from the previous frame to the current frame). Moreover, although described as separate processes, the techniques described with respect to FIGS. 15A and 15B may be performed in combination in the manner described above.

Figure 16:
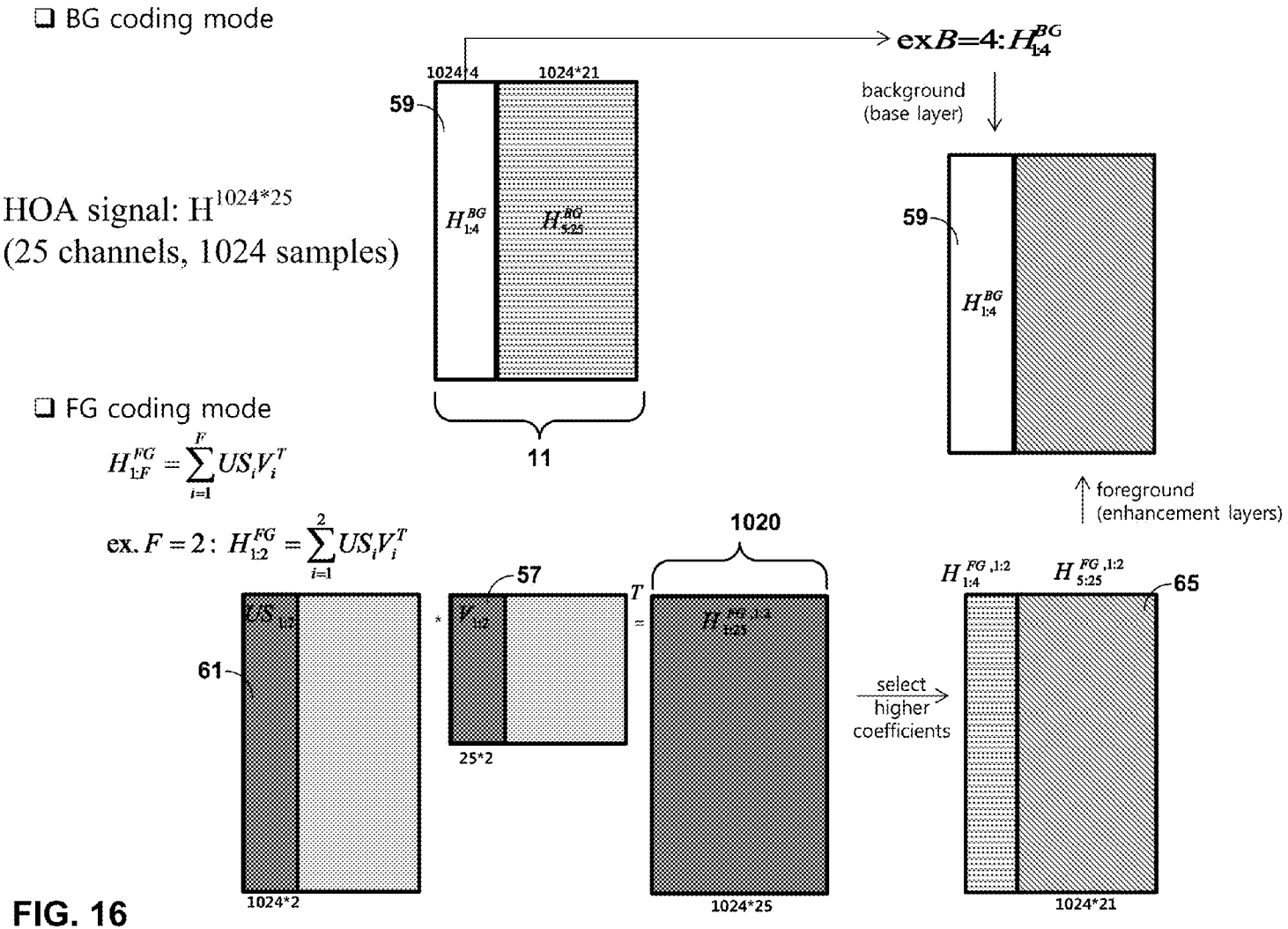
FIG. 16 is a diagram illustrating scalable audio coding as performed by the bitstream generation unit shown in the example of FIG. 16 in accordance with various aspects of the techniques described in this disclosure.

FIG. 16 is a diagram illustrating scalable audio coding as performed by the bitstream generation unit 42 shown in the example of FIG. 16 in accordance with various aspects of the techniques described in this disclosure. In the example of FIG. 16, an HOA audio encoder, such as the audio encoding device 20 shown in the examples of FIGS. 2 and 3, may encode HOA coefficients 11 (which may also be referred to as an "HOA signal 11"). The HOA signal 11 may comprise 24 channels, each channel having 1024 samples. As noted above, each channel includes 1024 samples, which may refer to 1024 HOA coefficients corresponding to one of the spherical basis functions. The audio encoding device 20 may, as described above with respect to the bitstream generation unit 42 shown in the example of FIG. 5, perform various operations to obtain the encoded ambient HOA coefficients 59 (which may also be referred to as the "background HOA channels 59") from the HOA signal 11.

As further shown in the example of FIG. 16, the audio encoding device 20 obtains the background HOA channels 59 as the first four channels of the HOA signal 11. The background HOA channels 59 are denoted as $H_{1:4}^{BG}$, where the 1:4 reflects that the first four channels of the HOA signal 11 was selected to represent the background components of the soundfield. This channel selection may be signaled as B=4 in a syntax element. The scalable bitstream generation unit 1000 of the audio encoding device 20 may then specify the HOA background channels 59 in the base layer 21A (which may be referred to as a first layer of the two or more layers).

The scalable bitstream generation unit 1000 may generate the base layer 21A to include the background channels 59 and gain information as specified in accordance with the following equation:

$$H_1^{BG}(\text{1st BG channel audio signal})+G_1^{BG}(\text{1st BG gain})$$

$$H_2^{BG}(\text{2nd BG channel audio signal})+G_2^{BG}(\text{2nd BG gain})$$

$$H_3^{BG}(\text{3rd BG channel audio signal})+G_3^{BG}(\text{3rd BG gain})$$

. . .

. . .

As further shown in the example of FIG. 16, the audio encoding device 20 may obtain F foreground HOA channels, which may be expressed as the US audio objects and the corresponding V-vector. It is assumed for purposes of illustration that F=2. The audio encoding device 20 may therefore select the first and second US audio objects 61 (which may also be referred to the "encoded nFG signals 61") and the first and second V-vectors 57 (which may also be referred to as the "coded foreground V[k] vectors 57"), where the selection is denoted in the example of FIG. 5 as $US_{1:2}$ and $V_{1:2}$, respectively. The scalable bitstream generation unit 1000 may then generate the second layer 21B of the scalable bitstream 21 to include the first and second US audio objects 61 and the first and second V-vectors 57.

The scalable bitstream generation unit 1000 may also generate the enhancement layer 21B to include the foreground HOA channels 61 and gain information along with the V-vectors 57 as specified in accordance with the following equation:

$US_1^{FG}$(1st FG channel audio signal)+$G_1^{FG}$(1st FG gain)+$V_1^{FG}$(1st V-vector)

$US_2^{FG}$(2nd FG channel audio signal)+$G_2^{FG}$(2nd FG gain)+$V_2^{FG}$(2nd V-vector)

$US_3^{FG}$(3rd FG channel audio signal)+$G_3^{FG}$(3rd FG gain)+$V_3^{FG}$(3rd V-vector)

. . .

. . .

To obtain the HOA coefficients 11' from the scalable bitstream 21', the audio decoding device 24 shown in the examples of FIGS. 2 and 3 may invoke extraction unit 72 shown in more detail in the example of FIG. 6. The extraction unit 72 which may extract the encoded ambient HOA coefficients 59A-59D, the encoded nFG signals 61A and 61B, and the coded foreground V[k] vectors 57A and 57B in the manner described above with respect to FIG. 6. The extraction unit 72 may then output the encoded ambient HOA coefficients 59A-59D, the encoded nFG signals 61A and 61B, and the coded foreground V[k] vectors 57A and 57B to the vector-based decoding unit 92.

The vector-based decoding unit 92 may then multiply the US audio objects 61 by the V-vectors 57 in accordance with the following equations:

$$H_{1:F}^{FG} = \sum_{i=1}^{F} US_i V_i^T$$

$$ex.\ F = 2: H_{1:2}^{FG} = \sum_{i=1}^{2} US_i V_i^T$$

The first equation provides the mathematical expression of the generic operation with respect to F. The second equation provides the mathematical expression in the example where F is assumed to equal two. The result of this multiplication is denoted as the foreground HOA signal 1020. The vector-based decoding unit 92 then selects the higher channels (given that the lowest four coefficients were already selected as the HOA background channels 59), where these higher channels are denoted as $H_{5:25}^{FG,1:2}$. The vector-based decoding unit 92 in other words obtains the HOA foreground channels 65 from the foreground HOA signal 1020.

As a result, the techniques may facilitate variable layering (as opposed to requiring a static number of layers) to accommodate a large number of coding contexts and potentially provide for much more flexibility in specifying the background and foreground components of the soundfield. The techniques may provide for many other use cases, as described with respect to FIGS. 17-26. These various use cases may be performed separately or together within a given audio stream. Moreover, the flexibility in specifying these components within the scalable audio encoding techniques may allow for many more use cases. In other words, the techniques should not be limited to the use cases described below but may include any way by which background and foreground components can be signaled in one or more layers of a scalable bitstream.

Figure 17:
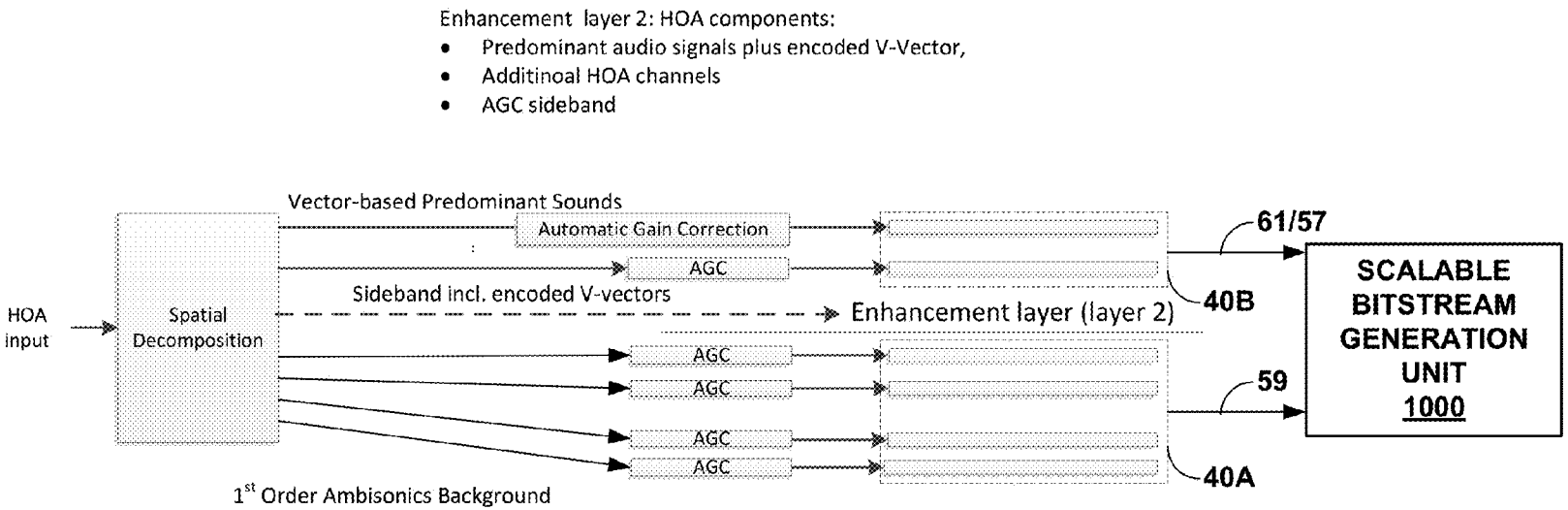
FIG. 17 is a conceptual diagram of an example where the syntax elements indicate that there are two layers with four encoded ambient HOA coefficients specified in a base layer and two encoded foreground signals are specified in the enhancement layer.

FIG. 17 is a conceptual diagram of an example where the syntax elements indicate that there are two layers with four encoded ambient HOA coefficients specified in a base layer and two encoded nFG signals are specified in the enhancement layer. The example of FIG. 17 shows the HOA frame as the scalable bitstream generation unit 1000 shown in the example of FIG. 5 may segment the frame to form the base layer including sideband HOA gain correction data for the encoded ambient HOA coefficients 59A-59D. The scalable bitstream generation unit 1000 may also segment the HOA frame form an enhancement layer 21 that includes the two coded foreground V[k] vectors 57 and the HOA gain correction data for the encoded ambient nFG signals 61.

As further shown in the example of FIG. 17, the psychoacoustic audio encoding unit 40 is shown as divided into separate instantiations of psychoacoustic audio encoder 40A, which may be referred to as base layer temporal encoders 40A, and psychoacoustic audio encoders 40B, which may be referred to as enhancement layer temporal encoders 40B. The base layer temporal encoders 40A represent four instantiations of psychoacoustic audio encoders that process the four components of the base layer. The enhancement layer temporal encoders 40B represent two instantiations of psychoacoustic audio encoders that process the two components of the enhancement layer.

Figure 18:
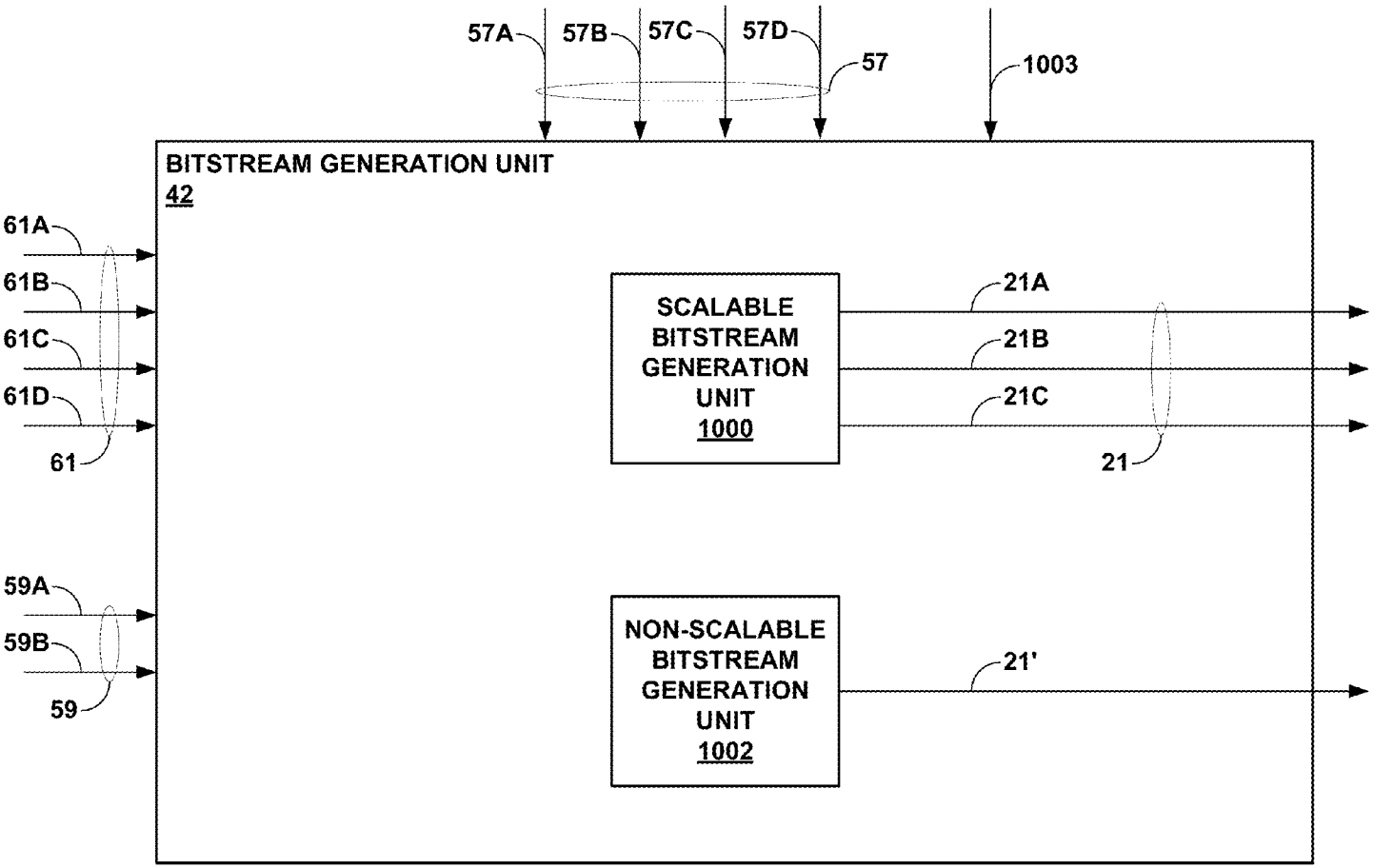
FIG. 18 is a diagram illustrating, in more detail, the bitstream generation unit of FIG. 3 when configured to perform a second one of the potential versions of the scalable audio coding techniques described in this disclosure.

FIG. 18 is a diagram illustrating, in more detail, the bitstream generation unit 42 of FIG. 3 when configured to perform a second one of the potential versions of the scalable audio coding techniques described in this disclosure. In this example, the bitstream generation unit 42 is substantially similar to the bitstream generation unit 42 described above with respect to the example of FIG. 5. However, the bitstream generation unit 42 performs the second version of the scalable coding techniques to specify three layers 21A-21C rather than two layers 21A and 21B. The scalable bitstream generation unit 1000 may specify indications that two encoded ambient HOA coefficients and zero encoded nFG signals are specified in the base layer 21A, indications that zero encoded ambient HOA coefficients and two encoded nFG signals are specified in a first enhancement layer 21B, and indications that zero encoded ambient HOA coefficients and two encoded nFG signals 61 are specified in a second enhancement layer 21C. The scalable bitstream generation unit 1000 may then specify the two encoded ambient HOA coefficients 59A and 59B in the base layer 21A, the two encoded nFG signals 61A and 61B with the corresponding two coded foreground V[k] vectors 57A and 57B in the first enhancement layer 21B, and the two encoded nFG signals 61C and 61D with the corresponding two coded foreground V[k] vectors 57C and 57D in the second enhancement layer 21C. The scalable bitstream generation unit 1000 may then output these layers as scalable bitstream 21.

Figure 19:
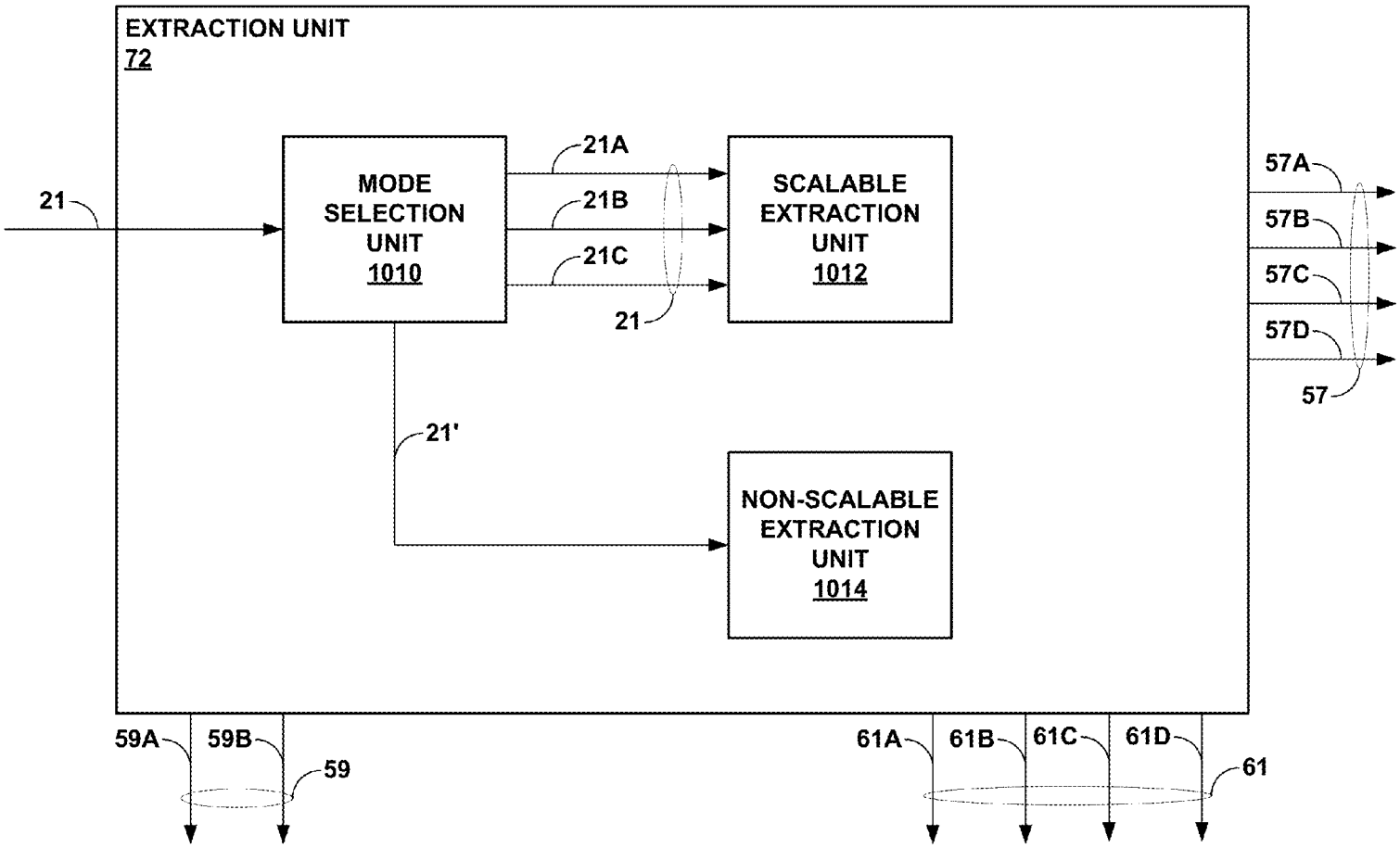
FIG. 19 is a diagram illustrating, in more detail, the extraction unit of FIG. 3 when configured to perform the second one of the potential versions the scalable audio decoding techniques described in this disclosure.

FIG. 19 is a diagram illustrating, in more detail, the extraction unit 72 of FIG. 3 when configured to perform the second one of the potential versions the scalable audio decoding techniques described in this disclosure. In this example, the bitstream extraction unit 72 is substantially similar to the bitstream extraction unit 72 described above with respect to the example of FIG. 6. However, the bitstream extraction unit 72 performs the second version of the scalable coding techniques with respect to three layers 21A-21C rather than two layers 21A and 21B. The scalable bitstream extraction unit 1012 may obtain indications that two encoded ambient HOA coefficients and zero encoded nFG signals are specified in the base layer 21A, indications that zero encoded ambient HOA coefficients and two encoded nFG signals are specified in a first enhancement layer 21B, and indications that zero encoded ambient HOA coefficients and two encoded nFG signals are specified in a second enhancement layer 21C. The scalable bitstream extraction unit 1012 may then obtain the two encoded ambient HOA coefficients 59A and 59B from the base layer 21A, the two encoded nFG signals 61A and 61B with the corresponding two coded foreground V[k] vectors 57A and 57B from the first enhancement layer 21B, and the two encoded nFG signals 61C and 61D with the corresponding two coded foreground V[k] vectors 57C and 57D from the second enhancement layer 21C. The scalable bitstream extraction unit 1012 may output the encoded ambient HOA coefficients 59, the encoded nFG signals 61 and the coded foreground V[k] vectors 57 to the vector-based decoding unit 92.

Figure 20:
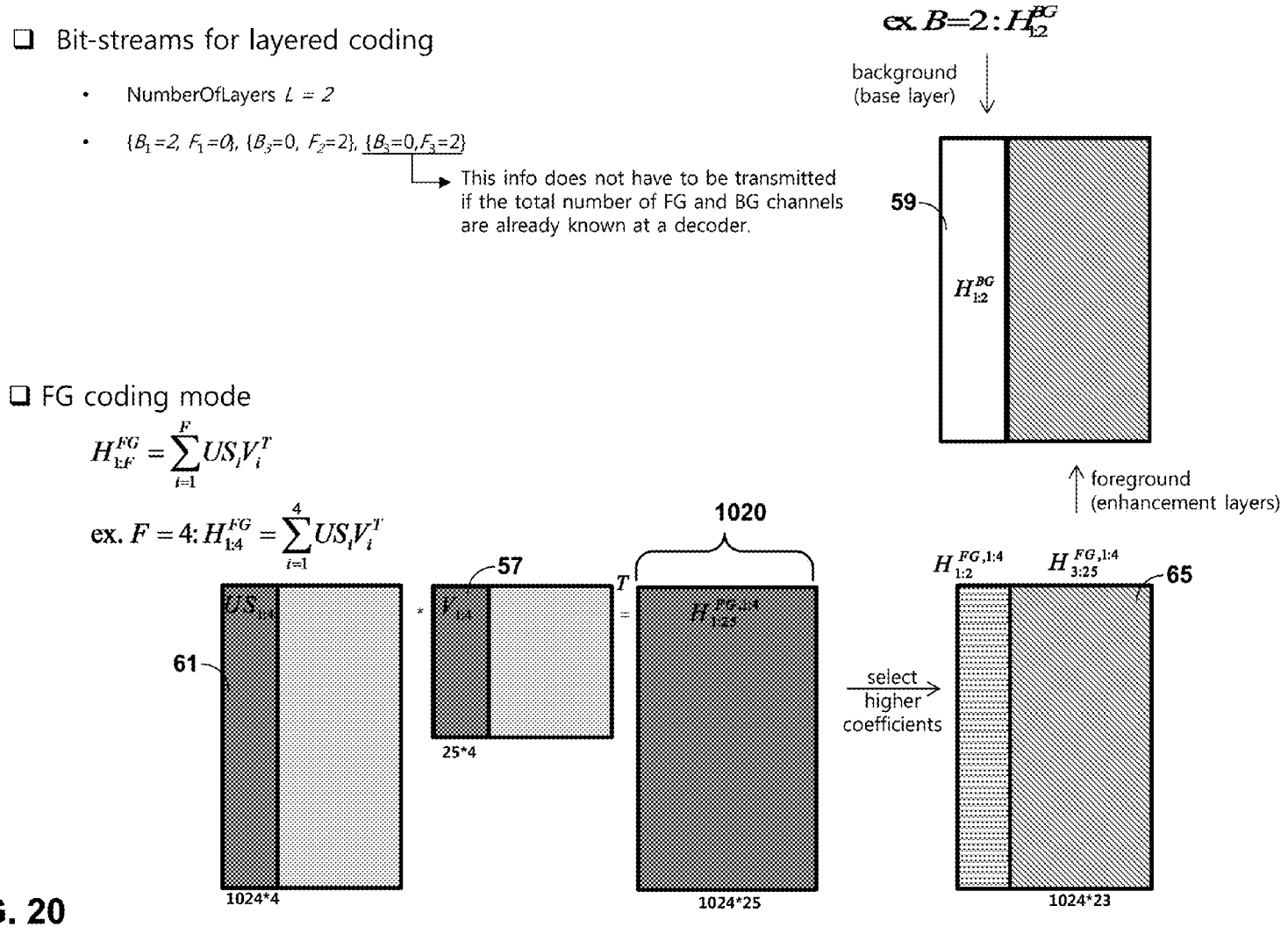
FIG. 20 is a diagram illustrating a second use case by which the bitstream generation unit of FIG. 18 and the extraction unit of FIG. 19 may perform the second one of the potential version of the techniques described in this disclosure.

FIG. 20 is a diagram illustrating a second use case by which the bitstream generation unit of FIG. 18 and the extraction unit of FIG. 19 may perform the second one of the potential version of the techniques described in this disclosure. For example, the bitstream generation unit 42 shown in the example of FIG. 18 may specify the NumLayer (which is shown as "NumberOfLayers" for ease of understanding) syntax element to indicate the number of layers specified in the scalable bitstream 21 is three. The bitstream generation unit 42 may further specify that the number of background channels specified in the first layer 21A (which is also referred to as the "base layer") is two while the number of foreground channels specified in the first layer 21B is zero (i.e., $B_1$=2, $F_1$=0 in the example of FIG. 20). The bitstream generation unit 42 may further specify that the number of background channels specified in the second layer 21B (which is also referred to as the "enhancement layer") is zero while the number of foreground channels specified in the second layer 21B is two (i.e., $B_2$=0, $F_2$=2 in the example of FIG. 20). The bitstream generation unit 42 may further specify that the number of background channels specified in the second layer 21C (which is also referred to as the "enhancement layer") is zero while the number of foreground channels specified in the second layer 21C is two (i.e., $B_3$=0, $F_3$=2 in the example of FIG. 20). However, the audio encoding device 20 may not necessarily signal the third layer background and foreground channel information when the total number of foreground and background channels are already known at the decoder (e.g., by way of additional syntax elements, such as totalNumBGchannels and totalNumFGchannels).

The bitstream generation unit 42 may specify these $B_i$ and $F_i$ values as NumBGchannels[i] and NumFGchannels[i]. For the above example, the audio encoding device 20 may specify the NumBGchannels syntax element as {2, 0, 0} and the NumFGchannels syntax element as {0, 2, 2}. The bitstream generation unit 42 may also specify the background HOA audio channels 59, the foreground HOA channels 61 and the V-vectors 57 in the scalable bitstream 21.

The audio decoding device 24 shown in the examples of FIGS. 2 and 4 may operate in a manner reciprocal to that of the audio encoding device 20 to parse these syntax elements from the bitstream (e.g., as set forth in the above HOADecoderConfig syntax table), as described above with respect to the bitstream extraction unit 72 of the FIG. 19. The audio decoding device 24 may also parse the corresponding background HOA audio channels 1002 and the foreground HOA channels 1010 from the bitstream 21 in accordance with the parsed syntax elements, again as described above with respect to the bitstream extraction unit 72 of the FIG. 19.

Figure 21:
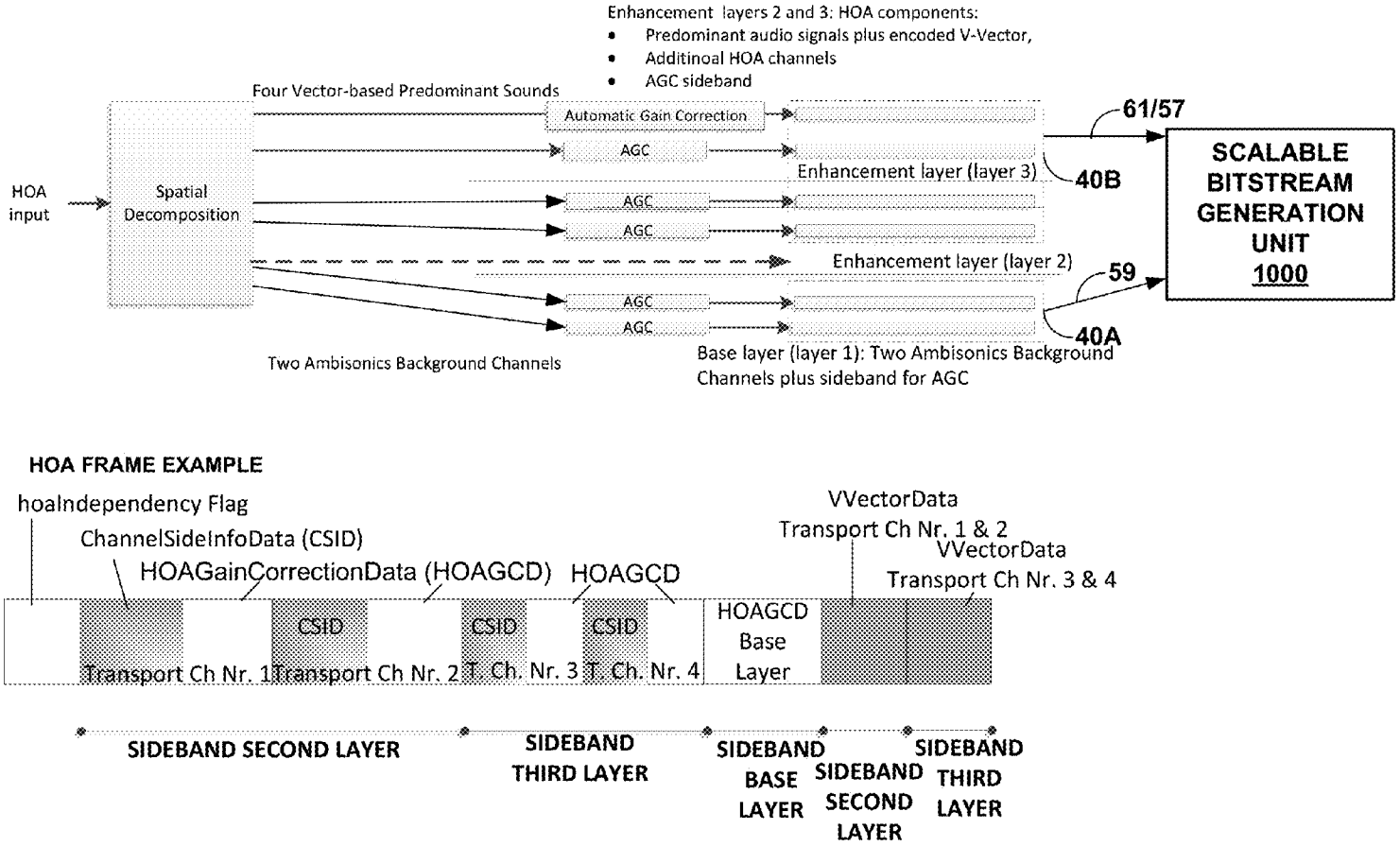
FIG. 21 is a conceptual diagram of an example where the syntax elements indicate that there are three layers with two encoded ambient HOA coefficients specified in a base layer, two encoded foreground signals are specified in a first enhancement layer and two encoded foreground signals are specified in a second enhancement layer.

FIG. 21 is a conceptual diagram of an example where the syntax elements indicate that there are three layers with two encoded ambient HOA coefficients specified in a base layer, two encoded nFG signals are specified in a first enhancement layer and two encoded nFG signals are specified in a second enhancement layer. The example of FIG. 21 shows the HOA frame as the scalable bitstream generation unit 1000 shown in the example of FIG. 18 may segment the frame to form the base layer including sideband HOA gain correction data for the encoded ambient HOA coefficients 59A and 59B. The scalable bitstream generation unit 1000 may also segment the HOA frame form an enhancement layer 21B that includes the two coded foreground V[k] vectors 57 and the HOA gain correction data for the encoded ambient nFG signals 61 and an enhancement layer 21C that includes the two additional coded foreground V[k] vectors 57 and the HOA gain correction data for the encoded ambient nFG signals 61.

As further shown in the example of FIG. 21, the psychoacoustic audio encoding unit 40 is shown as divided into separate instantiations of psychoacoustic audio encoder 40A, which may be referred to as base layer temporal encoders 40A, and psychoacoustic audio encoders 40B, which may be referred to as enhancement layer temporal encoders 40B. The base layer temporal encoders 40A represent two instantiations of psychoacoustic audio encoders that process the four components of the base layer. The enhancement layer temporal encoders 40B represent four instantiations of psychoacoustic audio encoders that process the two components of the enhancement layer.

Figure 22:
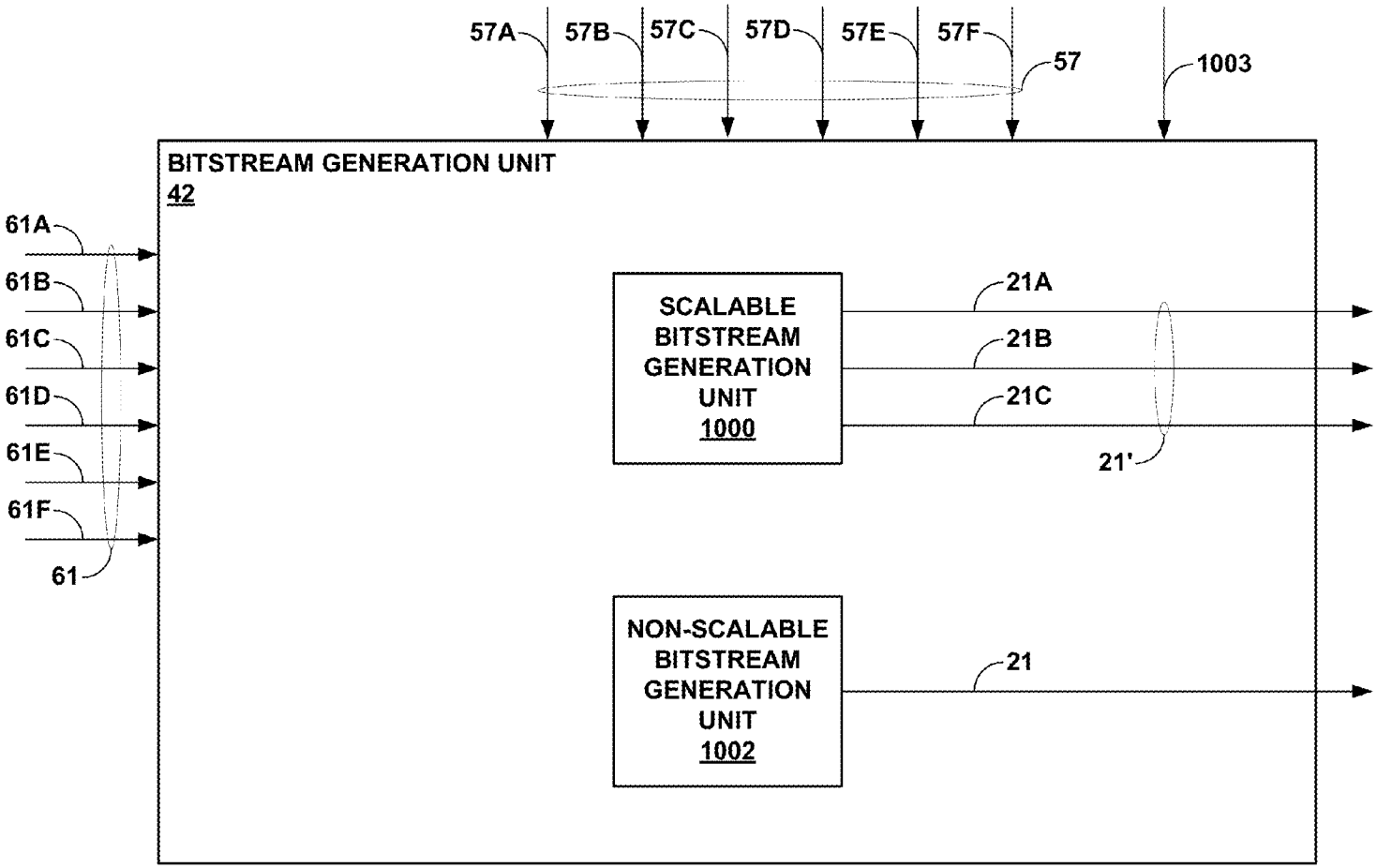
FIG. 22 is a diagram illustrating, in more detail, the bitstream generation unit of FIG. 3 when configured to perform a third one of the potential versions of the scalable audio coding techniques described in this disclosure.

FIG. 22 is a diagram illustrating, in more detail, the bitstream generation unit 42 of FIG. 3 when configured to perform a third one of the potential versions of the scalable audio coding techniques described in this disclosure. In this example, the bitstream generation unit 42 is substantially similar to the bitstream generation unit 42 described above with respect to the example of FIG. 18. However, the bitstream generation unit 42 performs the third version of the scalable coding techniques to specify three layers 21A-21C rather than two layers 21A and 21B. Moreover, the scalable bitstream generation unit 1000 may specify indications that zero encoded ambient HOA coefficients and two encoded nFG signals are specified in the base layer 21A, indications that zero encoded ambient HOA coefficients and two encoded nFG signals are specified in a first enhancement layer 21B, and indications that zero encoded ambient HOA coefficients and two encoded nFG signals are specified in a second enhancement layer 21C. The scalable bitstream generation unit 1000 may then specify the two encoded nFG signals 61A and 61B with the corresponding two coded foreground V[k] vectors 57A and 57B in the base layer 21A, the two encoded nFG signals 61C and 61D with the corresponding two coded foreground V[k] vectors 57C and 57D in the first enhancement layer 21B, and the two encoded nFG signals 61E and 61F with the corresponding two coded foreground V[k] vectors 57E and 57F in the second enhancement layer 21C. The scalable bitstream generation unit 1000 may then output these layers as scalable bitstream 21.

Figure 23:
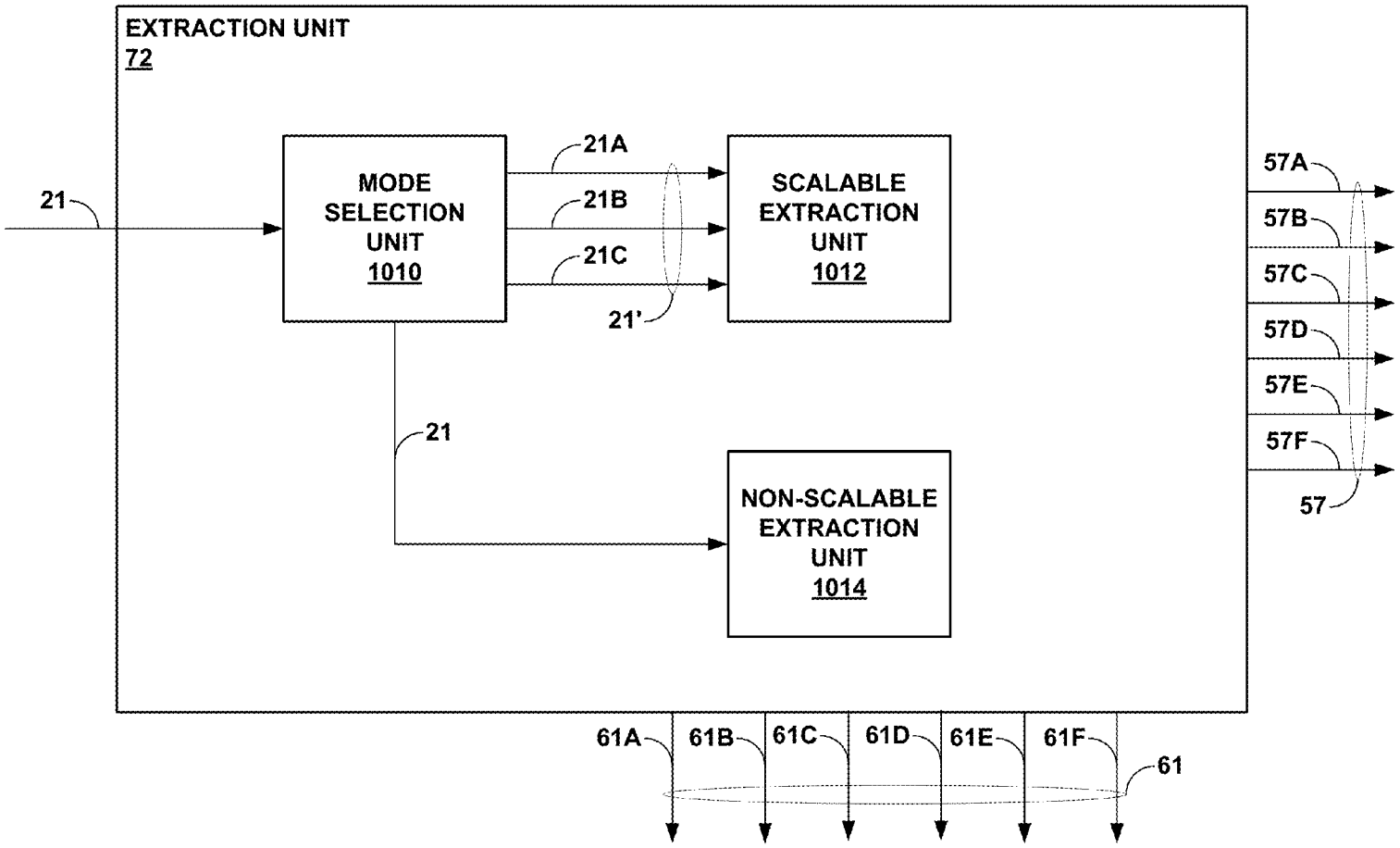
FIG. 23 is a diagram illustrating, in more detail, the extraction unit of FIG. 4 when configured to perform the third one of the potential versions the scalable audio decoding techniques described in this disclosure.

FIG. 23 is a diagram illustrating, in more detail, the extraction unit 72 of FIG. 4 when configured to perform the third one of the potential versions the scalable audio decoding techniques described in this disclosure. In this example, the bitstream extraction unit 72 is substantially similar to the bitstream extraction unit 72 described above with respect to the example of FIG. 19. However, the bitstream extraction unit 72 performs the third version of the scalable coding techniques with respect to three layers 21A-21C rather than two layers 21A and 21B. Moreover, the scalable bitstream extraction unit 1012 may obtain indications that zero encoded ambient HOA coefficients and two encoded nFG signals are specified in the base layer 21A, indications that zero encoded ambient HOA coefficients and two encoded nFG signals are specified in a first enhancement layer 21B, and indications that zero encoded ambient HOA coefficients and two encoded nFG signals are specified in a second enhancement layer 21C. The scalable bitstream extraction unit 1012 may then obtain the two encoded nFG signals 61A and 61B with the corresponding two coded foreground V[k] vectors 57A and 57B from the base layer 21A, the two encoded nFG signals 61C and 61D with the corresponding two coded foreground V[k] vectors 57C and 57D from the first enhancement layer 21B, and the two encoded nFG signals 61E and 61F with the corresponding two coded foreground V[k] vectors 57E and 57F from the second enhancement layer 21C. The scalable bitstream extraction unit 1012 may output the encoded nFG signals 61 and the coded foreground V[k] vectors 57 to the vector-based decoding unit 92.

Figure 24:
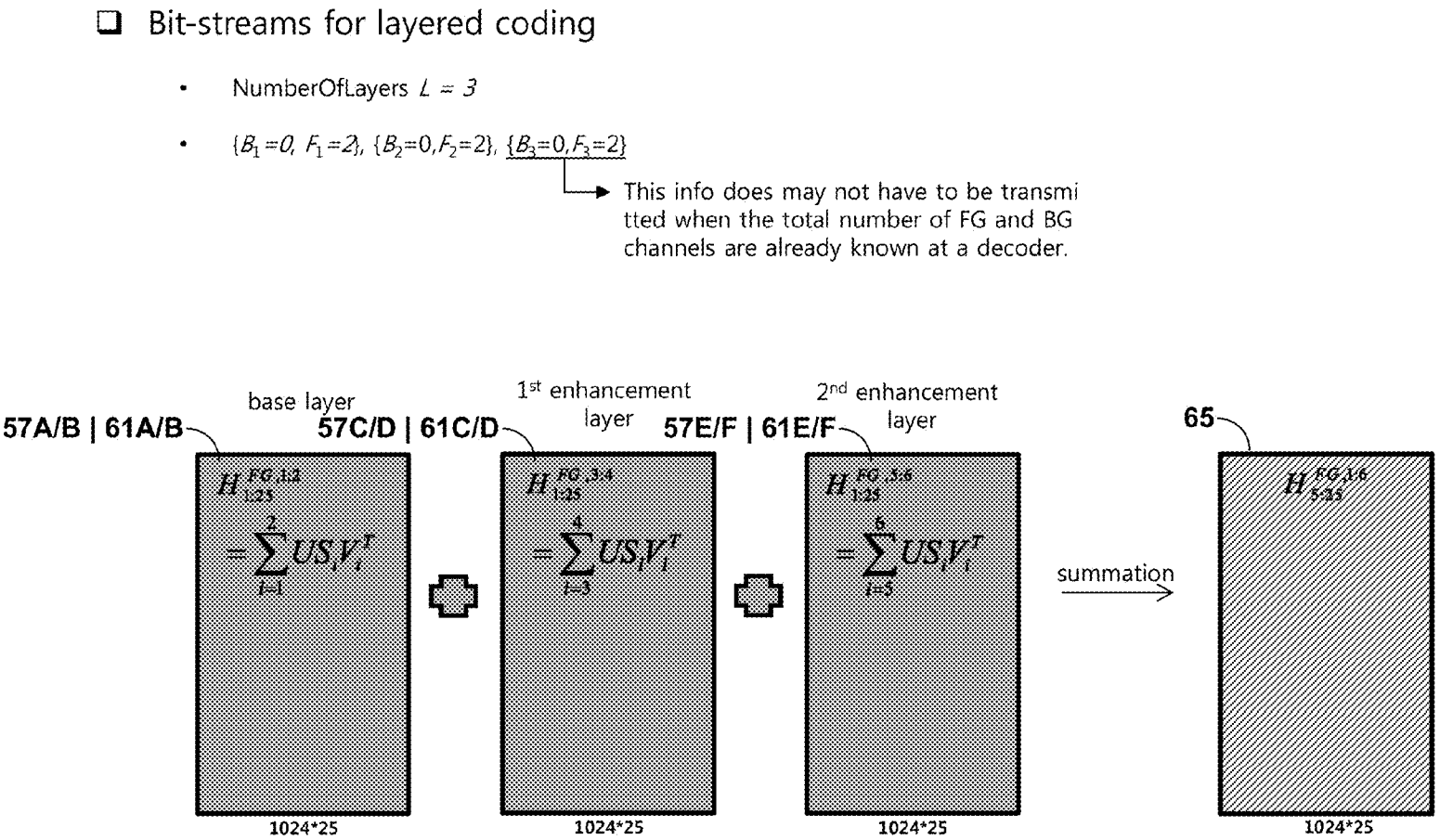
FIG. 24 is a diagram illustrating a third use case by which an audio encoding device may specify multiple layers in a multi-layer bitstream in accordance with the techniques described in this disclosure.

FIG. 24 is a diagram illustrating a third use case by which an audio encoding device may specify multiple layers in a multi-layer bitstream in accordance with the techniques described in this disclosure. For example, the bitstream generation unit 42 of FIG. 22 may specify the NumLayer (which is shown as "NumberOfLayers" for ease of understanding) syntax element to indicate the number of layers specified in the bitstream 21 is three. The bitstream generation unit 42 may further specify that the number of background channels specified in the first layer (which is also referred to as the "base layer") is zero while the number of foreground channels specified in the first layer is two (i.e., $B_1$=0, $F_1$=2 in the example of FIG. 24). In other words, the base layer does not always provide only for transport of ambient HOA coefficients but may allow for specification of predominant or in other words foreground HOA audio signals.

These two foreground audio channels are denoted as the encoded nFG signals 61A/B and the coded foreground V[k] vectors 57A/B and may be mathematically represented by the following equation:

$$H_{1:25}^{FG,1:2} = \sum_{i=1}^{2} US_i V_i^T.$$

The $H_{1:25}^{FG,1:2}$ denotes the two foreground audio channels, which may be represented by the first and second audio objects ($US_1$ and $US_2$) along with the corresponding V-vectors ($V_1$ and $V_2$).

The bitstream generation device 42 may further specify that the number of background channels specified in the second layer (which is also referred to as the "enhancement layer") is zero while the number of foreground channels specified in the second layer is two (i.e., $B_2$=0, $F_2$=2 in the example of FIG. 24). These two foreground audio channels are denoted as the encoded nFG signals 61C/D and the coded foreground V[k] vectors 57C/D and may be mathematically represented by the following equation:

$$H_{1:25}^{FG,3:4} = \sum_{i=3}^{4} US_i V_i^T.$$

The $H_{1:25}^{FG,3:4}$ denotes the two foreground audio channels, which may be represented by the third and fourth audio objects ($US_3$ and $US_4$) along with the corresponding V-vectors ($V_3$ and $V_4$).

Furthermore, the bitstream generation unit 42 may specify that the number of background channels specified in the third layer (which is also referred to as the "enhancement layer") is zero while the number of foreground channels specified in the third layer is two (i.e., $B_3$=0, $F_3$=2 in the example of FIG. 24). These two foreground audio channels are denoted as foreground audio channels 1024 and may be mathematically represented by the following equation:

$$H_{1:25}^{FG,5:6} = \sum_{i=5}^{6} US_i V_i^T.$$

The $H_{1:25}^{FG,5:6}$ denotes the two foreground audio channels 1024, which may be represented by the fifth and sixth audio objects ($US_5$ and $US_6$) along with the corresponding V-vectors ($V_5$ and $V_6$). However, the bitstream generation unit 42 may not necessarily signal this third layer background and foreground channel information when the total number of foreground and background channels are already known at the decoder (e.g., by way of additional syntax elements, such as totalNumBGchannels and totalNumFGchannels). The bitstream generation unit 42 may, however, not signal the third layer background and foreground channel information when the total number of foreground and background channels are already known at the decoder (e.g., by way of additional syntax elements, such as totalNumBGchannels and totalNumFGchannels).

The bitstream generation unit 42 may specify these $B_i$ and $F_i$ values as NumBGchannels[i] and NumFGchannels[i]. For the above example, the audio encoding device 20 may specify the NumBGchannels syntax element as {0, 0, 0} and the NumFGchannels syntax element as {2, 2, 2}. The audio encoding device 20 may also specify the foreground HOA channels 1020-1024 in the bitstream 21.

The audio decoding device 24 shown in the examples of FIGS. 2 and 4 may operate in a manner reciprocal to that of the audio encoding device 20 to parse, as described above with respect to the bitstream extraction unit 72 of FIG. 23, these syntax elements from the bitstream (e.g., as set forth in the above HOADecoderConfig syntax table). The audio decoding device 24 may also parse, again as described above with respect to the bitstream extraction unit 72 of FIG. 23, the corresponding foreground HOA audio channels 1020-1024 from the bitstream 21 in accordance with the parsed syntax elements and reconstruct HOA coefficients 1026 through summation of the foreground HOA audio channels 1020-1024.

Figure 25:
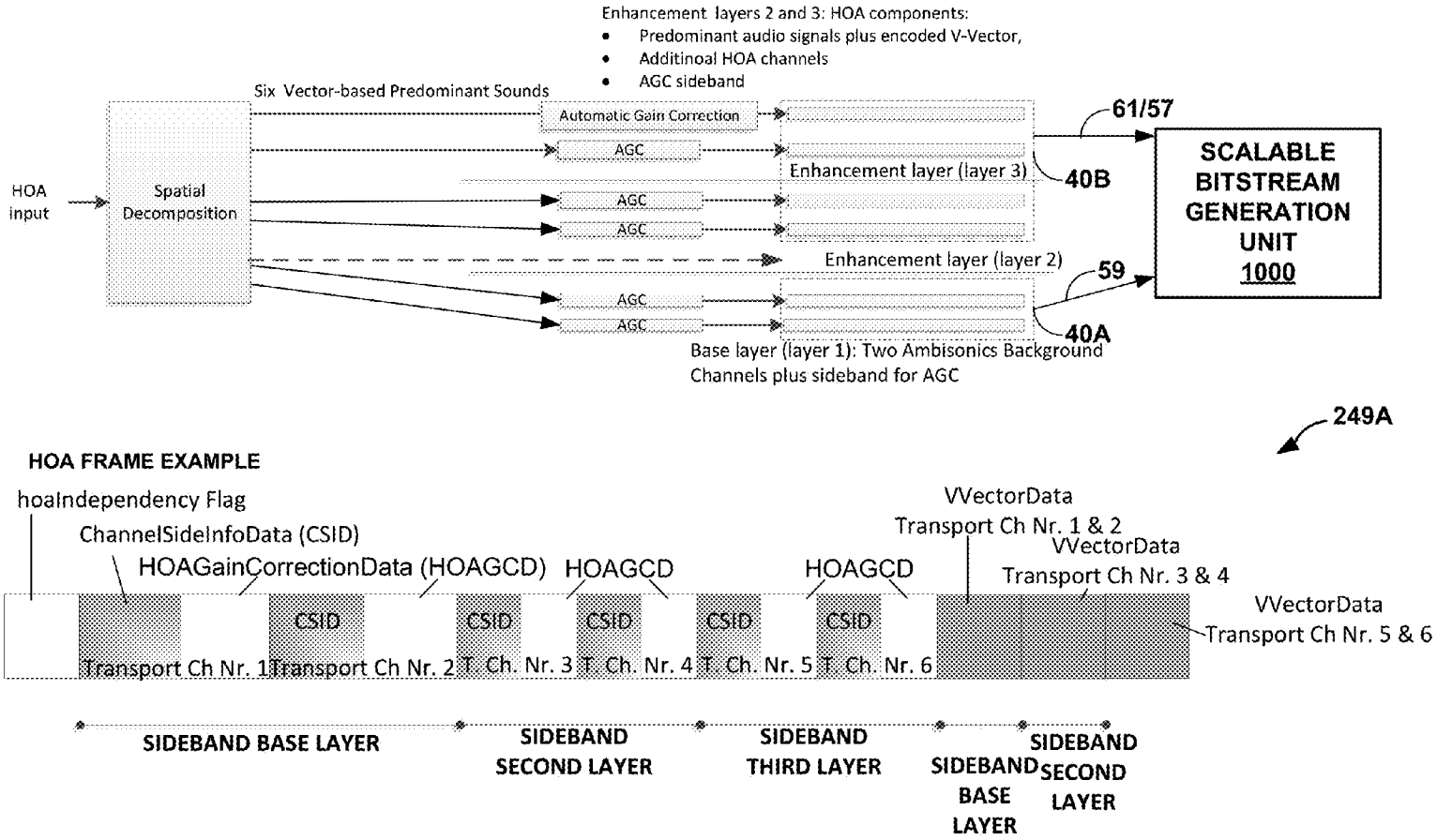
FIG. 25 is a conceptual diagram of an example where the syntax elements indicate that there are three layers with two encoded foreground signals specified in a base layer, two encoded foreground signals are specified in a first enhancement layer and two encoded foreground signals are specified in a second enhancement layer.

FIG. 25 is a conceptual diagram of an example where the syntax elements indicate that there are three layers with two encoded nFG signals specified in a base layer, two encoded nFG signals are specified in a first enhancement layer and two encoded nFG signals are specified in a second enhancement layer. The example of FIG. 25 shows the HOA frame as the scalable bitstream generation unit 1000 shown in the example of FIG. 22 may segment the frame to form the base layer including sideband HOA gain correction data for the encoded nFG signals 61A and 61B and two coded foreground V[k] vectors 57. The scalable bitstream generation unit 1000 may also segment the HOA frame to form an enhancement layer 21B that includes the two coded foreground V[k] vectors 57 and the HOA gain correction data for the encoded ambient nFG signals 61 and an enhancement layer 21C that includes the two additional coded foreground V[k] vectors 57 and the HOA gain correction data for the encoded ambient nFG signals 61.

As further shown in the example of FIG. 25, the psychoacoustic audio encoding unit 40 is shown as divided into separate instantiations of psychoacoustic audio encoder 40A, which may be referred to as base layer temporal encoders 40A, and psychoacoustic audio encoders 40B, which may be referred to as enhancement layer temporal encoders 40B. The base layer temporal encoders 40A represent two instantiations of psychoacoustic audio encoders that process the four components of the base layer. The enhancement layer temporal encoders 40B represent four instantiations of psychoacoustic audio encoders that process the two components of the enhancement layer.

Figure 26:
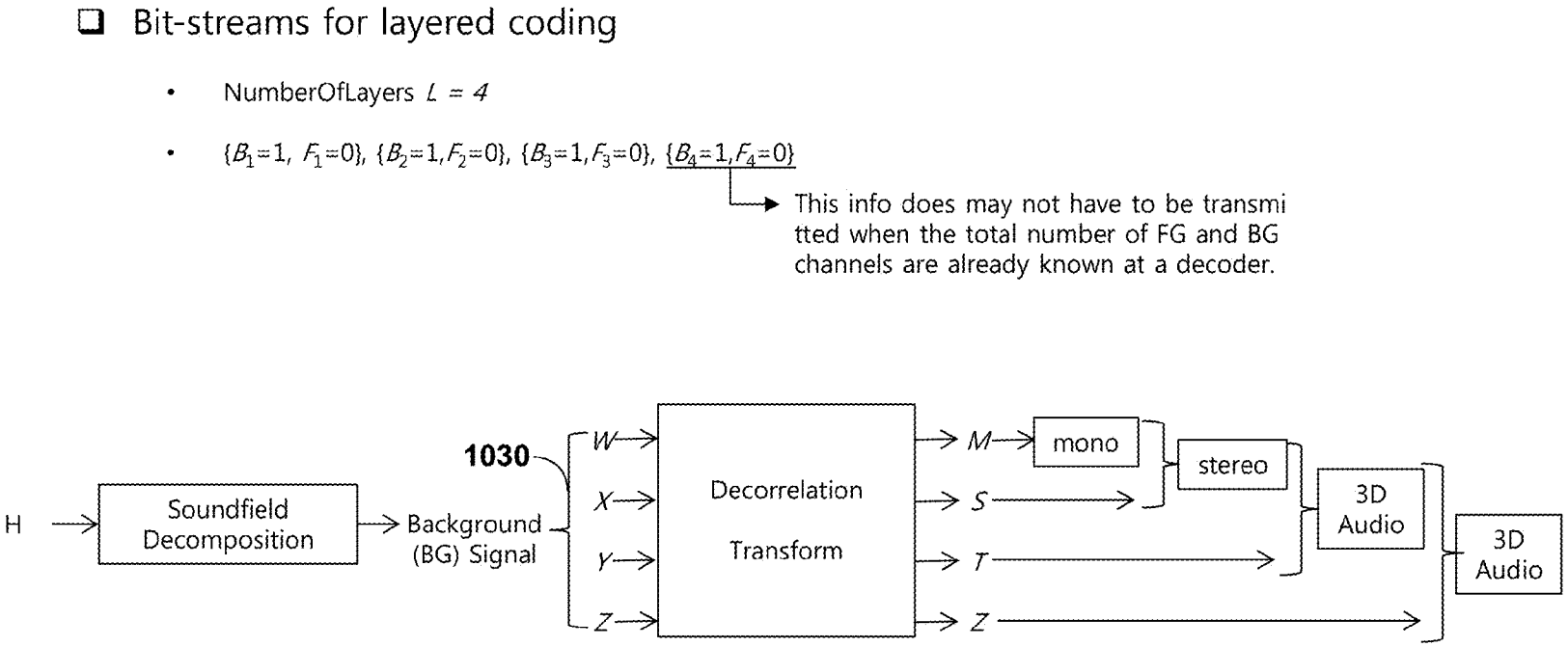
FIG. 26 is a diagram illustrating a third use case by which an audio encoding device may specify multiple layers in a multi-layer bitstream in accordance with the techniques described in this disclosure.

FIG. 26 is a diagram illustrating a third use case by which an audio encoding device may specify multiple layers in a multi-layer bitstream in accordance with the techniques described in this disclosure. For example, the audio encoding device 20 shown in the example of FIGS. 2 and 3 may specify the NumLayer (which is shown as "NumberOfLayers" for ease of understanding) syntax element to indicate the number of layers specified in the bitstream 21 is four. The audio encoding device 20 may further specify that the number of background channels specified in the first layer (which is also referred to as the "base layer") is one while the number of foreground channels specified in the first layer is zero (i.e., $B_1$=1, $F_1$=0 in the example of FIG. 26).

The audio encoding device 20 may further specify that the number of background channels specified in the second layer (which is also referred to as a "first enhancement layer") is one while the number of foreground channels specified in the second layer is zero (i.e., $B_2$=1, $F_2$=0 in the example of FIG. 26). The audio encoding device 20 may also specify that the number of background channels specified in the third layer (which is also referred to as a "second enhancement layer") is one while the number of foreground channels specified in the third layer is zero (i.e., $B_3$=1, $F_3$=0 in the example of FIG. 26). In addition, the audio encoding device 20 may specify that the number of background channels specified in the fourth layer (which is also referred to as the "enhancement layer") is one while the number of foreground channels specified in the third layer is zero (i.e., $B_4$=1, $F_4$=0 in the example of FIG. 26). However, the audio encoding device 20 may not necessarily signal the fourth layer background and foreground channel information when the total number of foreground and background channels are already known at the decoder (e.g., by way of additional syntax elements, such as totalNumBGchannels and totalNumFGchannels).

The audio encoding device 20 may specify these $B_i$ and $F_i$ values as NumBGchannels[i] and NumFGchannels[i]. For the above example, the audio encoding device 20 may specify the NumBGchannels syntax element as {1, 1, 1, 1} and the NumFGchannels syntax element as {0, 0, 0, 0}. The audio encoding device 20 may also specify the background HOA audio channels 1030 in the bitstream 21. In this respect, the techniques may allow for enhancement layers to specify ambient or, in other words, background HOA channels 1030, which may have been decorrelated prior to being specified in the base and enhancement layers of the bitstream 21 as described above with respect to the examples of FIGS. 7A-9B. However, again, the techniques set forth in this disclosure are not necessarily limited to decorrelation and may not provide for syntax elements or any other indications in the bitstream relevant to decorrelation as described above.

The audio decoding device 24 shown in the examples of FIGS. 2 and 4 may operate in a manner reciprocal to that of the audio encoding device 20 to parse these syntax elements from the bitstream (e.g., as set forth in the above HOADecoderConfig syntax table). The audio decoding device 24 may also parse the corresponding background HOA audio channels 1030 from the bitstream 21 in accordance with the parsed syntax elements.

As noted above, in some instances, the scalable bitstream 21 may include various layers that conform to the non-scalable bitstream 21. For example, the scalable bitstream 21 may include a base layer that conforms to non-scalable bitstream 21. In these instances, the non-scalable bitstream 21 may represent a sub-bitstream of scalable bitstream 21, where this non-scalable sub-bitstream 21 may be enhanced with additional layers of the scalable bitstream 21 (which are referred to as enhancement layers).

Figure 27:
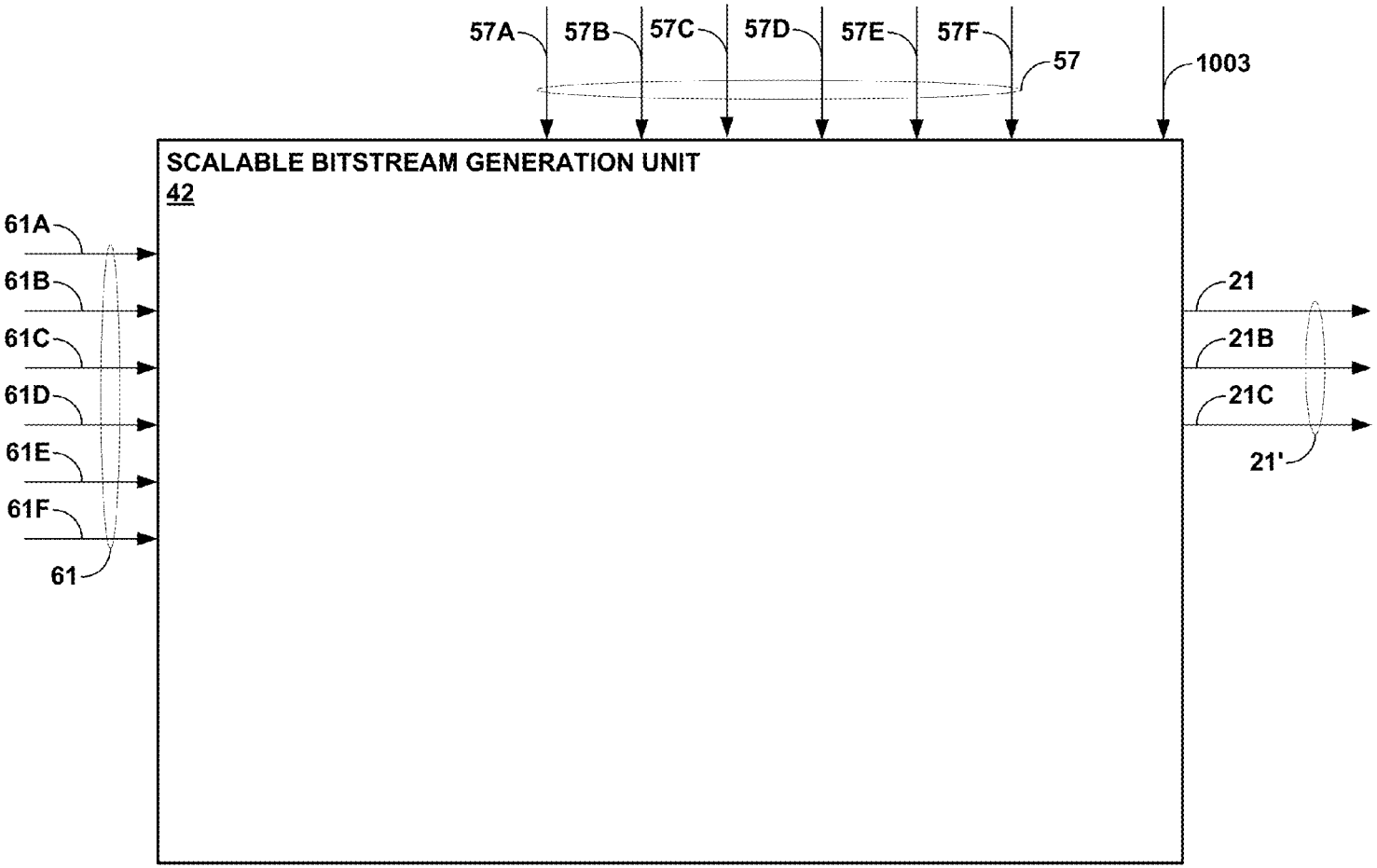
FIGS. 27 and 28 are block diagrams illustrating a scalable bitstream generation unit and a scalable bitstream extraction unit that may be configured to perform various aspects of the techniques described in this disclosure.
Figure 28:
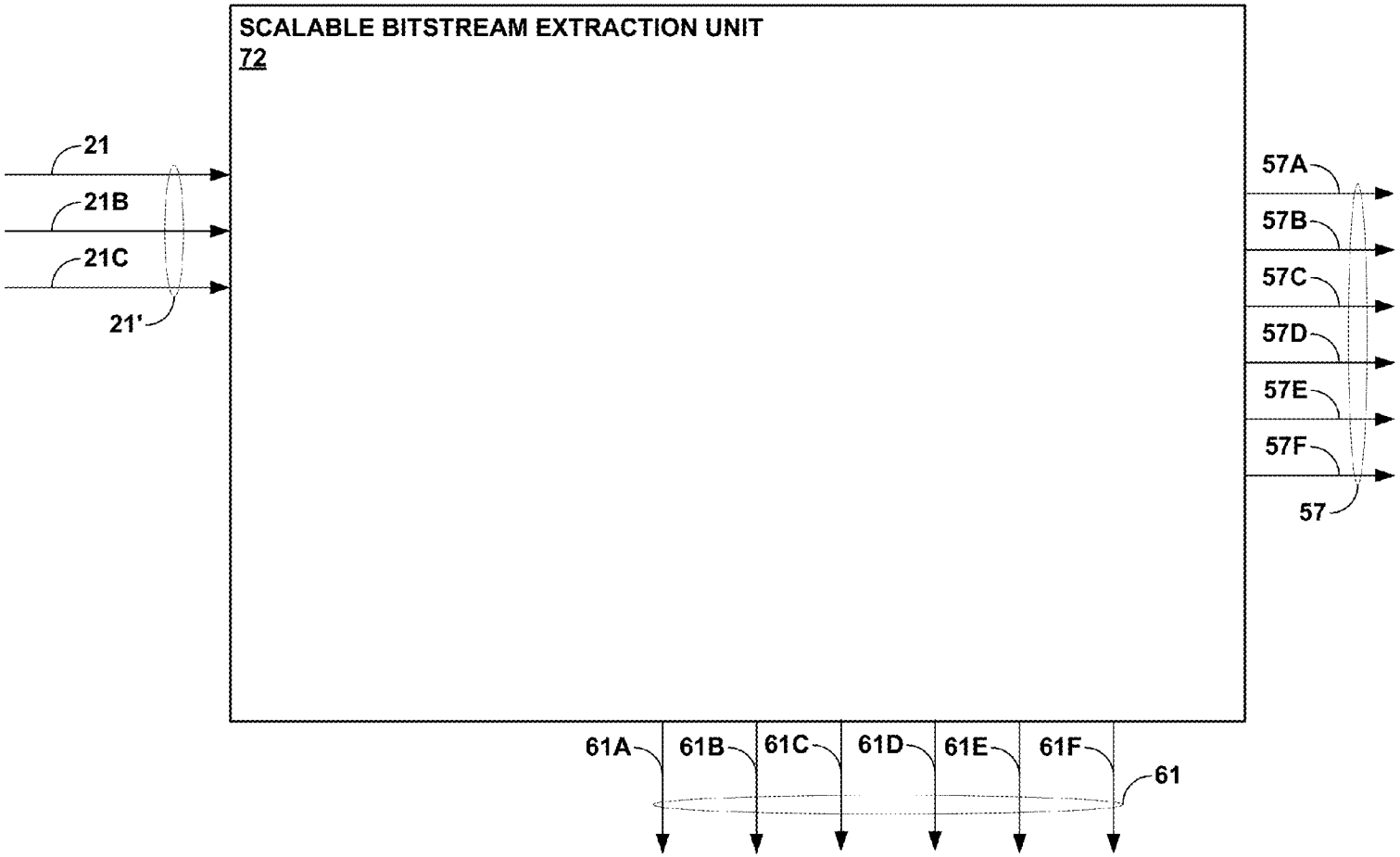

FIGS. 27 and 28 are block diagrams illustrating a scalable bitstream generation unit 42 and a scalable bitstream extraction unit 72 that may be configured to perform various aspects of the techniques described in this disclosure. In the example of FIG. 27, the scalable bitstream generation unit 42 may represent an example of the bitstream generation unit 42 described above with respect to the example of FIG. 3. The scalable bitstream generation unit 42 may output a base layer 21 that conforms (in terms of syntax and ability to be decoded by audio decoders that do not support scalable coding) to a non-scalable bitstream 21. The scalable bitstream generation unit 42 may operate in ways described above with respect to any of the foregoing bitstream generation units 42 except that the scalable bitstream generation unit 42 does not include a non-scalable bitstream generation unit 1002. Instead, the scalable bitstream generation unit 42 outputs a base layer 21 that conforms to a non-scalable bitstream and as such does not require a separate non-scalable bitstream generation unit 1000. In the example of FIG. 28, the scalable bitstream extraction unit 72 may operate reciprocally to the scalable bitstream generation unit 42.

Figure 29:
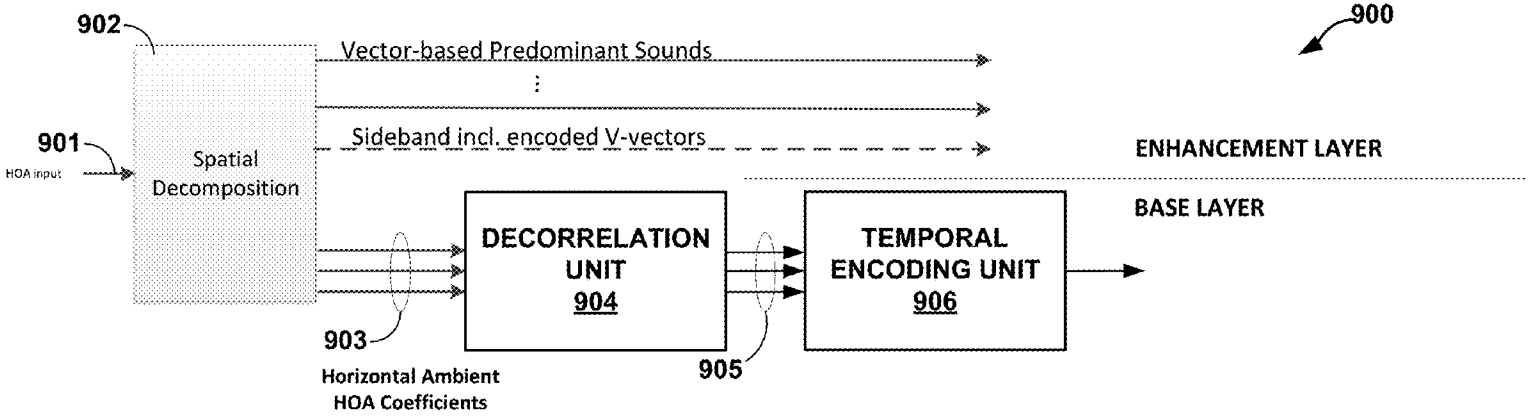
FIG. 29 represents a conceptual diagram representing an encoder that may be configured to operate in accordance with various aspects of the techniques described in this disclosure.

FIG. 29 represents a conceptual diagram representing an encoder 900 that may be configured to operate in accordance with various aspects of the techniques described in this disclosure. The encoder 900 may represent another example of the audio encoding device 20. The encoder 900 may include a spatial decomposition unit 902, a decorrelation unit 904 and a temporal encoding unit 906. The spatial decomposition unit 902 may represent a unit configured to output the vector-based predominant sounds (in the form of the audio objects noted above), the corresponding V-vectors associated with these vector-based predominant sounds and horizontal ambient HOA coefficients 903. The spatial decomposition unit 902 may differ from a directional based decomposition in that the V-vectors describe both the direction and the width of the corresponding one of the audio objects as each audio object moves over time within the soundfield.

The spatial decomposition unit 902 may include units 30-38 and 44-52 of the vector-based synthesis unit 27 shown in the example of FIG. 3 and generally operate in the manner described above with respect to unit 30-38 and 44-52. The spatial decomposition unit 902 may differ from the vector-based synthesis unit 27 in that the spatial decomposition unit 902 may not perform psychoacoustic encoding or otherwise include psychoacoustic coder unit 40 and may not include a bitstream generation unit 42. Moreover, in the scalable audio encoding context, the spatial decomposition unit 902 may pass through the horizontal ambient HOA coefficients 903 (meaning, in some examples, that these horizontal HOA coefficients may not be modified or otherwise adjusted and are parsed from HOA coefficients 901).

The horizontal ambient HOA coefficients 903 may refer to any of the HOA coefficients 901 (which may also be referred to as HOA audio data 901) that describe a horizontal component of the soundfield. For example, the horizontal ambient HOA coefficients 903 may include HOA coefficients associated with a spherical basis function having an order of zero and a sub-order of zero, higher order ambisonic coefficients corresponding to a spherical basis function having an order of one and a sub-order of negative one, and third higher order ambisonic coefficients corresponding to a spherical basis function having an order of one and a sub-order of one.

The decorrelation unit 904 represents a unit configured to perform decorrelation with respect to a first layer of two or more layers of the higher order ambisonic audio data 903 (where the ambient HOA coefficients 903 are one example of this HOA audio data) to obtain a decorrelated representation 905 of the first layer of the two or more layers of the higher order ambisonic audio data. Base layer 903 may be similar to any of the first layers, base layers or base sub-layers described above with respect to FIGS. 21-26. The decorrelation unit 904 may perform decorrelation using the above noted UHJ matrix or the mode matrix. The docorrelation unit 904 may also perform decorrelation using a transformation, such as rotation, in a manner similar to that described in U.S. application Ser. No. 14/192,829, entitled "TRANSFORMING SPHERICAL HARMONIC COEFFICIENTS," filed Feb. 27, 2014, except that the rotation is performed to obtain a decorrelated representation of the first layer rather than reduce the number of coefficients.

In other words, the decorrelation unit 904 may perform a rotation of the soundfield to align energy of the ambient HOA coefficients 903 along three different horizontal axes separated by 120 degrees (such as 0 azimuthal degrees/0 elevational degrees, 120 azimuthal degrees/0 elevational degrees, and 240 azimuthal degrees/0 elevational degrees). By aligning these energies with the three horizontal axes, the decorrelation unit 904 may attempt to decorrelate the energies from one another such that the decorrelation unit 904 may utilize a spatial transformation to effectively render three decorrelation audio channels 905. The decorrelation unit 904 may apply this spatial transformation so as to compute the spatial audio signals 905 at the azimuth angles of 0 degrees, 120 degrees and 240 degrees.

Although described with respect to azimuth angles of 0 degrees, 120 degrees and 240 degrees, the techniques may be applied with respect to any three azimuthal angles that evenly or nearly evenly divide the 360 azimuth degrees of the circle. For example, the techniques may also be performed with respect to a transformation that computes the spatial audio signals 905 at the azimuth angles of 60 degrees, 180 degrees, and 300 degrees. Moreover, although described with respect to three ambient HOA coefficients 901, the techniques may be performed more generally with respect to any horizontal HOA coefficients, including those as described above and any other horizontal HOA coefficients, such as those associated with a spherical basis function having an order of two and sub-order of two, a spherical basis function having an order of two and a sub-order of negative two, . . . , a spherical basis function having an order of X and a sub-order of X, and a spherical basis function having an order of X and a sub-order of negative X, where X may represent any number including 3, 4, 5, 6, etc.

As the number of horizontal HOA coefficients increases, the number of even or nearly even portions of the 360 degree circle may increase. For example, when the number of horizontal HOA coefficients increases to five, the decorrelation unit 904 may segment the circle into five even partitions (e.g., of approximately 72 degrees each). The number of horizontal HOA coefficients of X may, as another example, result in X even partitions with each partition having 360 degrees/X degrees.

The decorrelation unit 904 may, to identify the rotation information indicative of the amount by which to rotate the soundfield represented by the horizontal ambient HOA coefficients 903, perform a soundfield analysis, content-characteristics analysis, and/or spatial analysis. Based on one or more of these analyses, the decorrelation unit 904 may identify the rotation information (or other transformation information of which the rotation information is one example) as a number of degrees by which to horizontally rotate the soundfield, and rotate the soundfield, effectively obtaining a rotated representation (which is one example of the more general transformed representation) of the base layer of the higher order ambisonic audio data.

The decorrelation unit 904 may then apply a spatial transform to the rotated representation of the base layer 903 (which may also be referred to as a first layer 903 of two or more layers) of the higher order ambisonic audio data. The spatial transform may convert the rotated representation of the base layer of the two or more layers of the higher order ambisonic audio data from a spherical harmonic domain to a spatial domain to obtain a decorrelated representation of the first layer of the two or more layers of the higher order ambisonic audio data. The decorrelation representation of the first layer may include spatial audio signals 905 rendered at the three corresponding azimuth angles of 0 degrees, 120 degrees and 240 degrees, as noted above. The decorrelation unit 904 may then pass the horizontal ambient spatial audio signals 905 to the temporal encoding unit 906.

The temporal encoding unit 906 may represent a unit configured to perform psychoacoustic audio coding. The temporal encoding unit 906 may represent an AAC encoder or a unified speech and audio coder (USAC) to provide two examples. Temporal audio encoding units, such as the temporal encoding unit 906, may normally operate with respect to decorrelated audio data, such as the 6 channels of a 5.1 speaker setup, these 6 channels having been rendered to decorrelated channels. However, the horizontal ambient HOA coefficients 903 are additive in nature and thereby correlate in certain respect. Providing these horizontal ambient HOA coefficients 903 directly to the temporal encoding unit 906 without first performing some form of decorrelation may result in spatial noise unmasking in which sounds appear in locations that were not intended. These perceptual artifacts, such as the spatial noise unmasking, may be reduced by performing the transformation-based (or, more specifically, rotation-based in the example of FIG. 29) decorrelation described above.

Figure 30:
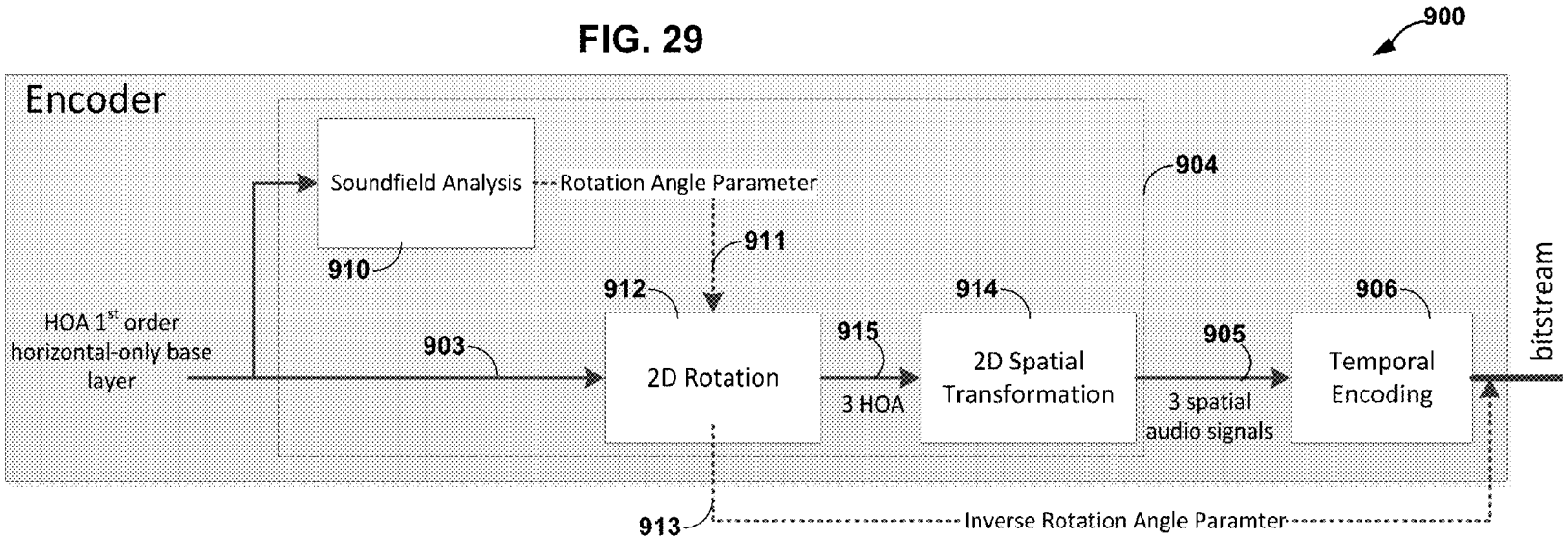
FIG. 30 is a diagram illustrating the encoder shown in the example of FIG. 27 in more detail.

FIG. 30 is a diagram illustrating the encoder 900 shown in the example of FIG. 27 in more detail. In the example of FIG. 30, encoder 900 may represent a base layer encoder 900 that encodes the HOA first order horizontal-only base layer 903 and does not show spatial decomposition unit 902 as this unit 902 does not perform, in this pass through example, meaningful operations other than provide the base layer 903 to a soundfield analysis unit 910 and a two-dimensional (2D) rotation unit 912 of the decorrelation unit 904.

That is, the decorrelation unit 904 includes the soundfield analysis unit 910 and the 2D rotation unit 912. The soundfield analysis unit 910 represents a unit configured to perform the soundfield analysis described above in more detail to obtain a rotation angle parameter 911. The rotation angle parameter 911 represents one example of transformation information in the form of rotation information. The 2D rotation unit 912 represents a unit configured to perform a horizontal rotation around the Z-axis of the soundfield based on the rotation angle parameter 911. This rotation is two-dimensional in that the rotation only involves a single axis of rotation and does not include any, in this example, elevational rotation. The 2D rotation unit 912 may obtain inverse rotation information 913 (by inverting, as one example, the rotation angle parameter 911 to obtain the inverse rotation angle parameter 913), which may be an example of more general inverse transformation information. The 2D rotation unit 912 may provide the inverse rotation angle parameter 913 such that the encoder 900 may specify the inverse rotation angle parameter 913 in the bitstream.

In other words, the 2D rotation unit 912 may, based on the soundfield analysis, rotate the 2D soundfield so that the predominant energy is potentially arriving from one of the spatial sampling points used in the 2D spatial transform module (0°, 120°, 240°). The 2D rotation unit 912 may, as one example, apply the following rotation matrix:

$$\begin{bmatrix} 1 & 0 & 0 \\ \cos(\phi) & 0 & \sin(\phi) \\ -\sin(\phi) & 0 & \cos(\phi) \end{bmatrix}$$

In some examples, the 2D rotation unit 912 may, to avoid frame artifacts, apply a smoothing (interpolation) function to ensure a smooth transition of the time-varying rotation angle. This smoothing function may comprise a linear smoothing function. However, other smoothing functions, including non-linear smoothing functions may be used. The 2D rotation unit 912 may, for example, use a spline smoothing function.

To illustrate, when the soundfield analysis unit 910 module indicates that the soundfield's dominant direction is at 70° azimuth within one analysis frame, the 2D rotation unit 912 may smoothly rotate the soundfield by $\phi=-70°$ so that the dominant direction is now 0°. As another possibility, the 2D rotation unit 912 may rotate the soundfield by $\phi=50°$, so that the dominant direction is now 120°. The 2D rotation unit 912 may then signal the applied rotation angle 913 as an additional sideband parameter within the bitstream, so that a decoder can apply the correct inverse rotation operation.

As further shown in the example of FIG. 30, the decorrelation unit 904 also includes a 2D spatial transformation unit 914. The 2D spatial transformation unit 914 represents a unit configured to convert the rotated representation of the base layer from the spherical harmonic domain to the spatial domain, effectively rendering the rotated base layer 915 to the three azimuth angles (e.g., 0, 120 and 240). The 2D spatial transformation unit 914 may multiply the coefficients of the rotated base layer 915 with the following transformation matrix, which assumes the HOA coefficient order '00+','11−','11+' and N3D normalization:

$$\begin{bmatrix} 1/3 & 0 & 0.384900179459750 \\ 1/3 & 1/3 & -0.192450089729875 \\ 1/3 & -1/3 & -0.192450089729875 \end{bmatrix}$$

The foregoing matrix computes the spatial audio signals 905 at the azimuth angles 0°, 120° and 240°, so that the circle of 360° is evenly divided in 3 portions. As noted above, other separations are possible, as long as each portion covers 120 degrees, e.g., computing the spatial signals at 60°, 180°, and 300°.

In this way, the techniques may provide for a device 900 configured to perform scalable higher order ambisonic audio data encoding. The device 900 may be configured to perform decorrelation with respect to a first layer 903 of two or more layers of the higher order ambisonic audio data to obtain a decorrelated representation 905 of the first layer of the two or more layers of the higher order ambisonic audio data.

In these and other instances, the first layer 903 of the two or more layers of the higher order ambisonic audio data comprises ambient higher order ambisonic coefficients corresponding to one or more spherical basis functions having an order equal to or less than one. In these and other instances, the first layer 903 of the two or more layers of the higher order ambisonic audio data comprises ambient higher order ambisonic coefficients corresponding only to spherical basis functions descriptive of horizontal aspects of the soundfield. In these and other instances, the ambient higher order ambisonic coefficients corresponding only to spherical basis functions descriptive of the horizontal aspects of the soundfield may comprise first ambient higher order ambisonic coefficients corresponding to a spherical basis function having an order of zero and a sub-order of zero, second higher order ambisonic coefficients corresponding to a spherical basis function having an order of one and a sub-order of negative one, and third higher order ambisonic coefficients corresponding to a spherical basis function having an order of one and a sub-order of one.

In these and other instances, the device 900 may be configured to perform a transformation (e.g., by way of the 2D rotation unit 912) with respect to the first layer 903 of the higher order ambisonic audio data.

In these and other instances, the device 900 may be configured to perform a rotation (e.g., by way of the 2D rotation unit 912) with respect to the first layer 903 of the higher order ambisonic audio data.

In these and other instances, the device 900 may be configured to apply a transformation (e.g., by way of the 2D rotation unit 912) with respect to the first layer 903 of the two or more layers of the higher order ambisonic audio data to obtain a transformed representation 915 of the first layer of the two or more layers of the higher order ambisonic audio data, and convert the transformed representation 915 of the first layer of the two or more layers of the higher order ambisonic audio data (e.g., by way of the 2D spatial transformation unit 914) from a spherical harmonic domain to a spatial domain to obtain a decorrelated representation 905 of the first layer of the two or more layers of the higher order ambisonic audio data.

In these and other instances, the device 900 may be configured to apply a rotation with respect to the first layer 903 of the two or more layers of the higher order ambisonic audio data to obtain a rotated representation 915 of the first layer of the two or more layers of the higher order ambisonic audio data, and convert the rotated representation 915 of the first layer of the two or more layers of the higher order ambisonic audio data from a spherical harmonic domain to a spatial domain to obtain a decorrelated representation 905 of the first layer of the two or more layers of the higher order ambisonic audio data.

In these and other instances, the device 900 may be configured to obtain transformation information 911, apply a transformation with respect to the first layer 903 of the two or more layers of the higher order ambisonic audio data based on the transformation information 911 to obtain a transformed representation 915 of the first layer of the two or more layers of the higher order ambisonic audio data, and convert the transformed representation 915 of the first layer of the two or more layers of the higher order ambisonic audio data from a spherical harmonic domain to a spatial domain to obtain a decorrelated representation 905 of the first layer of the two or more layers of the higher order ambisonic audio data.

In these and other instances, the device 900 may be configured to obtain rotation information 911, and apply a rotation with respect to the first layer 903 of the two or more layers of the higher order ambisonic audio data based on the rotation information 911 to obtain a rotated representation 915 of the first layer of the two or more layers of the higher order ambisonic audio data, and converting the rotated representation 915 of the first layer of the two or more layers of the higher order ambisonic audio data from a spherical harmonic domain to a spatial domain to obtain a decorrelated representation 905 of the first layer of the two or more layers of the higher order ambisonic audio data.

In these and other instances, the device 900 may be configured to apply a transformation with respect to the first layer 903 of the two or more layers of the higher order ambisonic audio data using at least in part a smoothing function to obtain a transformed representation 915 of the first layer of the two or more layers of the higher order ambisonic audio data, and convert the transformed representation 915 of the first layer of the two or more layers of the higher order ambisonic audio data from a spherical harmonic domain to a spatial domain to obtain a decorrelated representation 905 of the first layer of the two or more layers of the higher order ambisonic audio data.

In these and other instances, the device 900 may be configured to apply a rotation with respect to the first layer 903 of the two or more layers of the higher order ambisonic audio data using at least in part a smoothing function to obtain a rotated representation 915 of the first layer of the two or more layers of the higher order ambisonic audio data, and convert the rotated representation 915 of the first layer of the two or more layers of the higher order ambisonic audio data from a spherical harmonic domain to a spatial domain to obtain a decorrelated representation of the first layer of the two or more layers of the higher order ambisonic audio data.

In these and other instances, the device 900 may be configured to specify an indication of the smoothing function to be used when applying an inverse transformation or an inverse rotation.

In these and other instances, the device 900 may be further configured to apply a linear invertible transform to the higher order ambisonic audio data to obtain a V-vector, and specify the V-vector as a second layer of the two or more layers of the higher order ambisonic audio data, as described above with respect to FIG. 3.

In these and other instances, the device 900 may be further configured to obtain higher order ambisonic coefficients associated with a spherical basis function having an order of one and a sub-order of zero, and specify the higher order ambisonic coefficients as a second layer of the two or more layers of the higher order ambisonic audio data.

In these and other instances, the device 900 may be further configured to perform a temporal encoding with respect to the decorrelated representation of the first layer of the two or more layers of the higher order ambisonic audio data.

Figure 31:
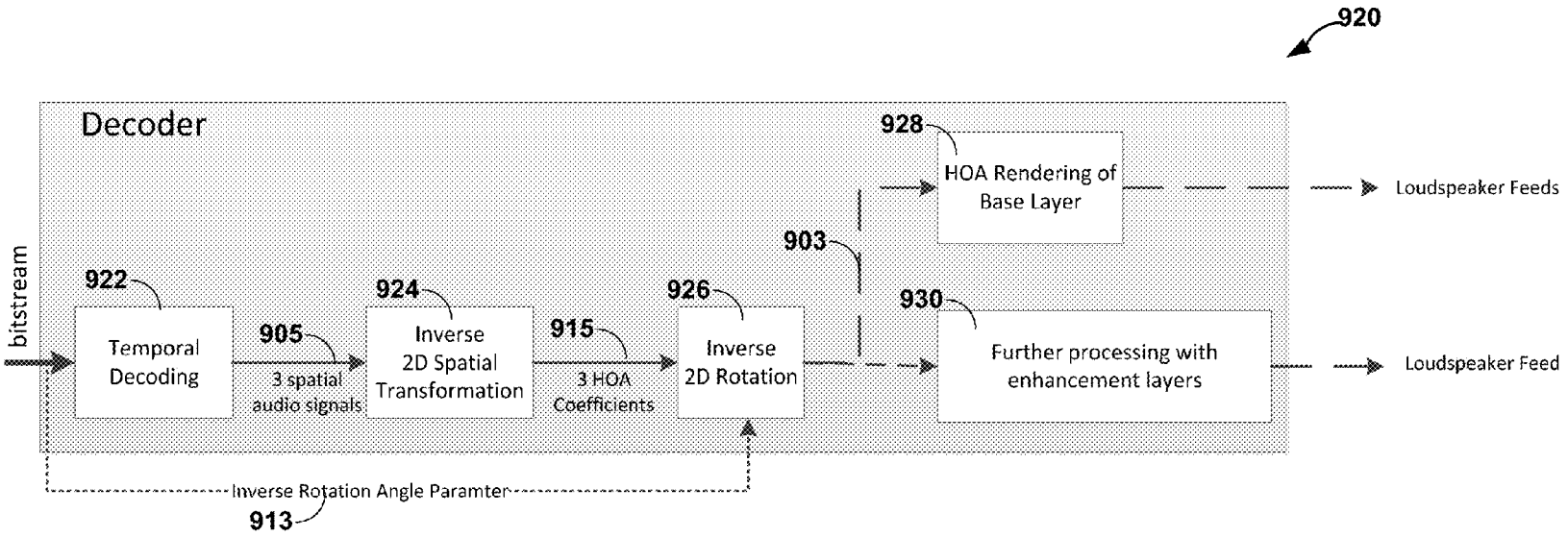
FIG. 31 is a block diagram illustrating an audio decoder that may be configured to operate in accordance with various aspects of the techniques described in this disclosure.

FIG. 31 is a block diagram illustrating an audio decoder 920 that may be configured to operate in accordance with various aspects of the techniques described in this disclosure. The decoder 920 may represent another example of the audio decoding device 24 shown in the example of FIG. 2 in terms of reconstructing the HOA coefficients, reconstructing V-vectors of the enhancement layers, performing temporal audio decoding (as performed by a temporal audio decoding unit 922), etc. However, decoder 920 differs in that the decoder 920 operates with respect to scalable coded higher order ambisonic audio data as specified in the bitstream.

As shown in the example of FIG. 31, the audio decoder 920 includes a temporal decoding unit 922, an inverse 2D spatial transformation unit 924, a base layer rendering unit 928 and an enhancement layer processing unit 930. The temporal decoding unit 922 may be configured to operate in a manner reciprocal to that of the temporal encoding unit 906. The inverse 2D spatial transformation unit 924 may represent a unit configured to operate in a manner reciprocal to that of the 2D spatial transformation unit 914.

In other words, the inverse 2D spatial transformation unit 924 may be configured to apply the below matrix to the spatial audio signals 905 to obtain the rotated horizontal ambient HOA coefficients 915 (which may also be referred to as "the rotated base layer 915"). The inverse 2D spatial transformation unit 924 may transform the 3 transmitted audio signals 905 back into the HOA domain using the following transformation matrix, which like the matrix above assumes the HOA coefficient order '00+','11−','11+' and N3D normalization:

$$\begin{bmatrix} 1.0 & 1.0 & 1.0 \\ 0.0 & 1.5 & -1.5 \\ 1.732050807568878 & -0.866025403784438 & -0.866025403784440 \end{bmatrix}$$

The foregoing matrix is the inverse of the transformation matrix used in the decoder.

The inverse 2D rotation unit 926 may be configured to operate in a manner reciprocal to that described above with respect to the 2D rotation unit 912. In this respect, the 2D rotation unit 912 may perform a rotation in accordance with the rotation matrix noted above based on the inverse rotation angle parameter 913 instead of the rotation angle parameter 911. In other words, the inverse rotation unit 926 may, based on the signaled rotation $\phi$, applied the following matrix, which again assumes the HOA coefficient order '00+','11−','11+' and N3D normalization:

$$\begin{bmatrix} 1 & 0 & 0 \\ \cos(\phi) & 0 & \sin(\phi) \\ -\sin(\phi) & 0 & \cos(\phi) \end{bmatrix}$$

The inverse 2D rotation unit 926 may use the same smoothing (interpolation) function used in the decoder to ensure a smooth transition for the time varying rotation angle, which may be signaled in the bitstream or configured a priori.

The base layer rendering unit 928 may represent a unit configured to renderer the horizontal-only ambient HOA coefficients of the base layer to loudspeaker feeds. The enhancement layer processing unit 930 may represent a unit configured to perform further processing of the base layer with any received enhancement layers (decoded via a separate enhancement layer decoding path that involves much of the decoding described above with respect to additional ambient HOA coefficients and the V-vectors along with the audio objects corresponding to the V-vectors) to render speaker feeds. The enhancement layer processing unit 930 may effectively augment the base layer to provide a higher resolution representation of the soundfield that may provide for a more immersive audio experience having sounds that potentially move realistically within the soundfield. The base layer may be similar to any of the first layers, base layers or base sub-layers described above with respect to FIGS. 11-13B. The enhancement layers may be similar to any of the second layers, enhancement layers, or enhancement sub-layers described above with respect to FIGS. 11-13B.

In this respect, the techniques provide for a device 920 configured to perform scalable higher order ambisonic audio data decoding. The device may be configured to obtain a decorrelated representation of a first layer of two or more layers of the higher order ambisonic audio data (e.g., spatial audio signals 905), the higher order ambisonic audio data descriptive of a soundfield. The decorrelated representation of the first layer is decorrelated by performing decorrelation with respect to the first layer of the higher order ambisonic audio data.

In some instances, the first layer of the two or more layers of the higher order ambisonic audio data comprises ambient higher order ambisonic coefficients corresponding to one or more spherical basis functions having an order equal to or less than one. In these and other instances, the first layer of the two or more layers of the higher order ambisonic audio data comprises ambient higher order ambisonic coefficients corresponding only to spherical basis functions descriptive of horizontal aspects of the soundfield. In these and other instances, the ambient higher order ambisonic coefficients corresponding only to spherical basis functions descriptive of the horizontal aspects of the soundfield comprises first ambient higher order ambisonic coefficients corresponding to a spherical basis function having an order of zero and a sub-order of zero, second higher order ambisonic coefficients corresponding to a spherical basis function having an order of one and a sub-order of negative one, and third higher order ambisonic coefficients corresponding to a spherical basis function having an order of one and a sub-order of one.

In these and other instances, the decorrelated representation of the first layer is decorrelated by performing a transformation with respect to the first layer of the higher order ambisonic audio data, as described above with respect to the encoder 900.

In these and other instances, the device 920 may be configured to perform a rotation (e.g., by inverse 2D rotation unit 926) with respect to the first layer of the higher order ambisonic audio data.

In these and other instances, the device 920 may be configured to recorrelate the decorrelated representation of the first layer of two or more layers of the higher order ambisonic audio data to obtain the first layer of the two or more layers of the higher order ambisonic audio data as described above for example with respect to inverse 2D spatial transformation unit 924 and inverse 2D rotation unit 926.

In these and other instances, the device 920 may be configured to convert the decorrelated representation 905 of the first layer of the two or more layers of the higher order ambisonic audio data from a spatial domain to a spherical harmonic domain to obtain a transformed representation 915 of the first layer of the two or more layers of the higher order ambisonic audio data, and apply an inverse transformation (e.g., as described above with respect to the inverse 2D rotation unit 926) with respect to the transformed representation 915 of the first layer of the two or more layers of the higher order ambisonic audio data to obtain the first layer of the two or more layers of the higher order ambisonic audio data.

In these and other instances, the device 920 may be configured to convert the decorrelated representation 905 of the first layer of the two or more layers of the higher order ambisonic audio data from a spatial domain to a spherical harmonic domain to obtain a transformed representation 915 of the first layer of the two or more layers of the higher order ambisonic audio data, and apply an inverse rotation with respect to the transformed representation 915 of the first layer of the two or more layers of the higher order ambisonic audio data to obtain the first layer of the two or more layers of the higher order ambisonic audio data.

In these and other instances, the device 920 may be configured to convert the decorrelated representation 905 of the first layer of the two or more layers of the higher order ambisonic audio data from a spatial domain to a spherical harmonic domain to obtain a transformed representation 915 of the first layer of the two or more layers of the higher order ambisonic audio data, obtain transformation information 913, and apply an inverse transformation with respect to the transformed representation 915 of the first layer of the two or more layers of the higher order ambisonic audio data based on the transformation information 913 to obtain the first layer of the two or more layers of the higher order ambisonic audio data.

In these and other instances, the device 920 may be configured to convert the decorrelated representation 905 of the first layer of the two or more layers of the higher order ambisonic audio data from a spatial domain to a spherical harmonic domain to obtain a transformed representation 915 of the first layer of the two or more layers of the higher order ambisonic audio data, obtain rotation information 913, and apply an inverse rotation with respect to the transformed representation 915 of the first layer of the two or more layers of the higher order ambisonic audio data based on the rotation information 913 to obtain the first layer of the two or more layers of the higher order ambisonic audio data.

In these and other instances, the device 920 may be configured to convert the decorrelated representation 905 of the first layer of the two or more layers of the higher order ambisonic audio data from a spatial domain to a spherical harmonic domain to obtain a transformed representation 915 of the first layer of the two or more layers of the higher order ambisonic audio data, and apply an inverse transformation with respect to the transformed representation 915 of the first layer of the two or more layers of the higher order ambisonic audio data using, at least in part, a smoothing function to obtain the first layer of the two or more layers of the higher order ambisonic audio data.

In these and other instances, the device 920 may be configured to convert the decorrelated representation 905 of the first layer of the two or more layers of the higher order ambisonic audio data from a spatial domain to a spherical harmonic domain to obtain a transformed representation 915 of the first layer of the two or more layers of the higher order ambisonic audio data, and apply an inverse rotation with respect to the transformed representation 915 of the first layer of the two or more layers of the higher order ambisonic audio data using, at least in part, a smoothing function to obtain the first layer of the two or more layers of the higher order ambisonic audio data.

In these and other instances, the device 920 may be further configured to obtain an indication of the smoothing function to be used when applying the inverse transformation or the inverse rotation.

In these and other instances, the device 920 may be further configured to obtain a representation of a second layer of the two or more layers of the higher order ambisonic audio data, where the representation of the second layer comprises vector-based predominant audio data, the vector-based predominant audio data comprises at least a predominant audio data and an encoded V-vector, and the encoded V-vector is decomposed from the higher order ambisonic audio data through application of a linear invertible transform, as described above with respect to the example of FIG. 3.

In these and other instances, the device 920 may be further configured to obtain a representation of a second layer of the two or more layers of the higher order ambisonic audio data, where the representation of the second layer comprises higher order ambisonic coefficients associated with a spherical basis function having an order of one and a sub-order of zero.

In this way, the techniques may enable a device to be configured to, or provide for an apparatus comprising means for performing, or a non-transitory computer-readable medium having stored thereon instructions that, when executed, cause one or more processors to perform the method set forth in the following clauses.

Clause 1A. A method of encoding a higher order ambisonic audio signal to generate a bitstream, the method comprising specifying an indication of a number of layers in the bitstream, and outputting the bitstream that includes the indicated number of the layers.

Clause 2A. The method of clause 1A, further comprising specifying an indication of a number of channels included in the bitstream.

Clause 3A. The method of clause 1A, wherein the indication of the number of layers comprises an indication of a number of layers in the bitstream for a previous frame, and wherein the method further comprises specifying, in the bitstream, an indication of whether a number of layers of the bitstream has changed for a current frame when compared to the number of layers of the bitstream for the previous frame, and specifying the indicated number of layers of the bitstream in the current frame.

Clause 4A. The device of clause 3A, wherein specifying the indicated number of layers comprises, when the indication indicates that the number of layers of the bitstream has not changed in the current frame when compared to the number of layers of the bitstream in the previous frame, specifying the indicated number of layers without specifying, in the bitstream, an indication of a current number of background components in one or more of the layers for the current frame to be equal to a previous number of background components in one or more of the layers of the previous frame.

Clause 5A. The method of clause 1A, wherein the layers are hierarchical such that a first layer, when combined with a second layer, provides a higher resolution representation of the higher order ambisonic audio signal.

Clause 6A. The method of clause 1A, wherein the layers of the bitstream comprise a base layer and an enhancement layer, and wherein the method further comprises applying a decorrelation transform with respect to one or more channels of the base layer to obtain a decorrelated representation of background components of the higher order ambisonic audio signal.

Clause 7A. The method of clause 6A, wherein the decorrelation transform comprises a UHJ transform.

Clause 8A. The method of clause 6A, wherein the decorrelation transform comprises a mode matrix transform.

Moreover, the techniques may enable a device to be configured to, or provide for an apparatus comprising means for performing, or a non-transitory computer-readable medium having stored thereon instructions that, when executed, cause one or more processors to perform the method set forth in the following clauses.

Clause 1B. A method of encoding a higher order ambisonic audio signal to generate a bitstream, the method comprising specifying, in the bitstream, an indication of a number of channels specified in one or more layers of the bitstream, and specifying the indicated number of the channels in the one or more layers of the bitstream.

Clause 2B. The method of clause 1B, further comprising specifying an indication of a total number of channels specified in the bitstream, wherein specifying the indicated number of channels comprises specifying the indicated total number of the channels in the one or more layers of the bitstream.

Clause 3B. The method of clause 1B, further comprising specifying an indication a type of one of the channels specified in the one or more layers in the bitstream, and specifying the indicated number of channels comprises specifying the indicated number of the indicated type of the one of the channels in the one or more layers of the bitstream.

Clause 4B. The method of clause 1B, further comprising specifying an indication a type of one of the channels specified in the one or more layers in the bitstream, the indication of the type of the one of the channels indicating that the one of the channels is a foreground channel, and wherein specifying the indicated number of channels comprises specifying the foreground channel in the one or more layers of the bitstream.

Clause 5B. The method of clause 1B, further comprising specifying an indication, in the bitstream, of a number of layers specified in the bitstream.

Clause 6B. The method of clause 1B, further comprising specifying an indication a type of one of the channels specified in the one or more layers in the bitstream, the indication of the type of the one of the channels indicating that the one of the channels is a background channel, wherein specifying the indicated number of the channels comprises specifying the background channel in the one or more layers of the bitstream.

Clause 7B. The method of clause 6B, wherein the one of the channels comprises a background higher order ambisonic coefficient.

Clause 1B. The method of clause 1B, wherein specifying the indication of the number of channels comprises specifying the indication of the number of channels based on a number of channels remaining in the bitstream after one of the layers is specified.

In this way, the techniques may enable a device to be configured to, or provide for an apparatus comprising means for performing, or a non-transitory computer-readable medium having stored thereon instructions that, when executed, cause one or more processors to perform the method set forth in the following clauses.

Clause 1C. A method of decoding a bitstream representative of a higher order ambisonic audio signal, the method comprising obtaining, from the bitstream, an indication of a number of layers specified in the bitstream, and obtaining the layers of the bitstream based on the indication of the number of layers.

Clause 2C. The method of clause 1C, further comprising obtaining an indication of a number of channels specified in the bitstream, and wherein obtaining the layers comprises obtaining the layers of the bitstream based on the indication of the number of layers and the indication of the number of channels.

Clause 3C. The method of clause 1C, further comprising obtaining an indication of a number of foreground channels specified in the bitstream for at least one of the layers, and wherein obtaining the layers comprises obtaining the foreground channels for the at least one of the layers of the bitstream based on the indication of the number of foreground channels.

Clause 4C. The method of clause 1C, further comprising obtaining an indication of a number of background channels specified in the bitstream for at least one of the layers, and wherein obtaining the layers comprises obtaining the background channels for the at least one of the layers of the bitstream based on the indication of the number of background channels.

Clause 5C. The method of clause 1C, wherein the indication of the number of the layers indicates that the number of layer is two, wherein the two layers comprise a base layer and an enhancement layer, and wherein obtaining the layers comprises obtaining an indication that a number of foreground channels is zero for the base layer and two for the enhancement layer.

Clause 6C. The method of clause 1C or 5C, wherein the indication of the number of the layers indicates that the number of layer is two, wherein the two layers comprise a base layer and an enhancement layer, and wherein the method further comprises obtaining an indication that a number of background channels is four for the base layer and zero for the enhancement layer.

Clause 7. The method of clause 1C, wherein the indication of the number of the layers indicates that the number of layer is three, wherein the three layers comprise a base layer, a first enhancement layer and a second enhancement layer, and wherein the method further comprises obtaining an indication that a number of foreground channels is zero for the base layer, two for the first enhancement layer and two for the third enhancement layer.

Clause 8C. The method of clause 1C or 7C, wherein the indication of the number of the layers indicates that the number of layer is three, wherein the three layers comprise a base layer, a first enhancement layer and a second enhancement layer, and wherein the method further comprises obtaining an indication that a number of background channels is two for the base layer, zero for the first enhancement layer and zero for the third enhancement layer.

Clause 9C. The method of clause 1C, wherein the indication of the number of the layers indicates that the number of layer is three, wherein the three layers comprise a base layer, a first enhancement layer and a second enhancement layer, and wherein the method further comprises obtaining an indication that a number of foreground channels is two for the base layer, two for a first enhancement layer and two for a third enhancement layer.

Clause 10C. The method of clause 1C or 9C, wherein the indication of the number of the layers indicates that the number of layer is three, wherein the three layers comprise a base layer, a first enhancement layer and a second enhancement layer, and wherein the method further comprises obtaining a background syntax element indicating that the number of background channels is zero for the base layer, zero for the first enhancement layer and zero for the third enhancement layer.

Clause 11C. The method of clause 1C, wherein the indication of the number of layers comprises an indication of a number of layers in a previous frame of the bitstream, and wherein the method further comprises obtaining an indication of whether a number of layers of the bitstream has changed in a current frame when compared to the number of layers of the bitstream in the previous frame, and obtaining the number of layers of the bitstream in the current frame based on the indication of whether the number of layers of the bitstream has changed in the current frame.

Clause 12C. The method of clause 11C, further comprising determining the number of layers of the bitstream in the current frame as the same as the number of layers of the bitstream in the previous frame when the indication indicates that the number of layers of the bitstream has not changed in the current frame when compared to the number of layers of the bitstream in the previous frame.

Clause 13C. The method of clause 11C, wherein method further comprises, when the indication indicates that the number of layers of the bitstream has not changed in the current frame when compared to the number of layers of the bitstream in the previous frame, obtain an indication of a current number of components in one or more of the layers for the current frame to be the same as a previous number of components in one or more of the layers of the previous frame.

Clause 14C. The method of clause 1C, wherein the indication of the number of layers indicates that three layers are specified in the bitstream, and wherein obtaining the layers comprises obtaining a first one of the layers of the bitstream indicative of background components of the higher order ambisonic audio signal that provide for stereo channel playback, obtaining a second one of the layers of the bitstream indicative of the background components of the higher order ambisonic audio signal that provide for three dimensional playback by three or more speakers arranged on one or more horizontal planes, and obtaining a third one of the layers of the bitstream indicative of foreground components of the higher order ambisonic audio signal.

Clause 15C. The method of clause 1C, wherein the indication of the number of layers indicates that three layers are specified in the bitstream, and wherein obtaining the layers comprises obtaining a first one of the layers of the bitstream indicative of background components of the higher order ambisonic audio signal that provide for mono channel playback, obtaining a second one of the layers of the bitstream indicative of the background components of the higher order ambisonic audio signal that provide for three dimensional playback by three or more speakers arranged on one or more horizontal planes, and obtaining a third one of the layers of the bitstream indicative of foreground components of the higher order ambisonic audio signal.

Clause 16C. The method of clause 1C, wherein the indication of the number of layers indicates that three layers are specified in the bitstream, and wherein obtaining the layers comprises obtaining a first one of the layers of the bitstream indicative of background components of the higher order ambisonic audio signal that provide for stereo channel playback, obtaining a second one of the layers of the bitstream indicative of the background components of the higher order ambisonic audio signal that provide for multi-channel playback by three or more speakers arranged on a single horizontal plane, obtaining a third one of the layers of the bitstream indicative of the background components of the higher order ambisonic audio signal that provide for three dimensional playback by three or more speakers arranged on two or more horizontal planes, and obtaining a fourth one of the layers of the bitstream indicative of foreground components of the higher order ambisonic audio signal.

Clause 17C. The method of clause 1C, wherein the indication of the number of layers indicates that three layers are specified in the bitstream, and wherein obtaining the layers comprises obtaining a first one of the layers of the bitstream indicative of background components of the higher order ambisonic audio signal that provide for mono channel playback, obtaining a second one of the layers of the bitstream indicative of the background components of the higher order ambisonic audio signal that provide for multi-channel playback by three or more speakers arranged on a single horizontal plane, and obtaining a third one of the layers of the bitstream indicative of the background components of the higher order ambisonic audio signal that provide for three dimensional playback by three or more speakers arranged on two or more horizontal planes, and obtaining a fourth one of the layers of the bitstream indicative of foreground components of the higher order ambisonic audio signal.

Clause 18C. The method of clause 1C, wherein the indication of the number of layers indicates that two layers are specified in the bitstream, and wherein obtaining the layers comprises obtaining a first one of the layers of the bitstream indicative of background components of the higher order ambisonic audio signal that provide for stereo channel playback, and obtaining a second one of the layers of the bitstream indicative of the background components of the higher order ambisonic audio signal that provide for horizontal multi-channel playback by three or more speakers arranged on a single horizontal plane.

Clause 19C. The method of clause 1C, further comprising obtaining an indication of a number of channels specified in the bitstream, wherein obtaining the layers comprises obtaining the layers of the bitstream based on the indication of the number of layers and the indication of the number of channels.

Clause 20C. The method of clause 1C, further comprising obtaining an indication of a number of foreground channels specified in the bitstream for at least one of the layers, wherein obtaining the layers comprises obtaining the foreground channels for the at least one of the layers of the bitstream based on the indication of the number of foreground channels.

Clause 21C. The method of clause 1C, further comprising obtaining an indication of a number of background channels specified in the bitstream for at least one of the layers, wherein obtaining the layers comprises obtaining the background channels for the at least one of the layers of the bitstream based on the indication of the number of background channels.

Clause 22C. The method of clause 1C, further comprising parsing an indication of a number of foreground channels specified in the bitstream for at least one of the layers based on a number of channels remaining in the bitstream after the at least one of the layers is obtained, wherein obtaining the layers comprises obtaining the foreground channels of the at least one of the layers based on the indication of the number of foreground channels.

Clause 23C. The method of clause 22C, wherein the number of channels remaining in the bitstream after the at least one of the layers is obtained is represented by a syntax element.

Clause 24C. The method of clause 1C, further comprising parsing an indication of a number of background channels specified in the bitstream for at least one of the layers based on a number of channels after the at least one of the layers is obtained, wherein obtaining the background channels comprises obtaining the background channels for the at least one of the layers from the bitstream based on the indication of the number of background channels.

Clause 25C. The method of clause 24C, wherein the number of channels remaining in the bitstream after the at least one of the layers is obtained is represented by a syntax element.

Clause 26C. The method of clause 1C, wherein the layers of the bitstream comprise a base layer and an enhancement layer, and wherein the method further comprises applying a correlation transform with respect to one or more channels of the base layer to obtain a correlated representation of background components of the higher order ambisonic audio signal.

Clause 27C. The method of clause 26C, wherein the correlation transform comprises an inverse UHJ transform.

Clause 28C. The method of clause 26C, wherein the correlation transform comprises an inverse mode matrix transform.

Clause 29C. The method of clause 1C, wherein a number of channels for each of the layers of the bitstream is fixed.

Moreover, the techniques may enable a device to be configured to, or provide for an apparatus comprising means for performing, or a non-transitory computer-readable medium having stored thereon instructions that, when executed, cause one or more processors to perform the method set forth in the following clauses.

Clause 1D. A method of decoding a bitstream representative of a higher order ambisonic audio signal, the method comprising obtaining, from the bitstream, an indication of a number of channels specified in one or more layers in the bitstream, and obtaining the channels specified in the one or more layers in the bitstream based on the indication of the number of channels.

Clause 2D. The method of clause 1D, further comprising obtaining an indication of a total number of channels specified in the bitstream, and wherein obtaining the channels comprises obtaining the channels specified in the one or more layers based on the indication of the number of channels specified in the one or more layers and the indication of the total number of channels.

Clause 3D. The method of clause 1D, further comprising obtaining an indication of a type of one of the channels specified in the one or more layers in the bitstream, and wherein obtaining the channels comprises obtaining the one of the channels based on the indication of the number of channels and the indication of the type of the one of the channels.

Clause 4D. The method of clause 1D, further comprising obtaining an indication a type of one of the channels specified in the one or more layers in the bitstream, the indication of the type of the one of the channels indicating that the one of the channels is a foreground channel, and wherein obtaining the channels comprises obtaining the one of the channels based on the indication of the number of channels and the indication that the type of the one of the channels is the foreground channel.

Clause 5D. The method of clause 1D, further comprising obtaining an indication of a number of layers specified in the bitstream, and wherein obtaining the channels comprises obtaining the one of the channels based on the indication of the number of channels and the indication of the number of layers.

Clause 6D. The method of clause 5D, wherein the indication of the number of layers comprises an indication of a number of layers in a previous frame of the bitstream, wherein the method further comprises obtaining an indication of whether the number of channels specified in one or more layers in the bitstream has changed in a current frame when compared to a number of channels specified in one or more layers in the bitstream of the previous frame, and wherein obtaining the channels comprises obtaining the one of the channels based on the indication of whether the number of channels specified in one or more layers in the bitstream has changed in the current frame.

Clause 7D. The method of clause 5D, further comprising determining the number of channels specified in the one or more layers of the bitstream in the current frame as the same as the number of channels specified in the one or more layers of the bitstream in the previous frame when the indication indicates that the number of channels specified in the one or more layers of the bitstream has not changed in the current frame when compared to the number of channels specified in the one or more layers of the bitstream in the previous frame.

Clause 8D. The method of clause 5D, wherein the one or more processors are further configured to, when the indication indicates that the number of channels specified in the one or more layers of the bitstream has not changed in the current frame when compared to the number of channels specified in the one or more layers of the bitstream in the previous frame, obtain an indication of a current number of channels in one or more of the layers for the current frame to be the same as a previous number of channels in one or more of the layers of the previous frame.

Clause 9D. The method of clause 1D, further comprising obtaining an indication of a type of one of the channels specified in the one or more layers in the bitstream, the indication of the type of the one of the channels indicating that the one of the channels is a background channel, wherein obtaining the channels comprises obtaining the one of the channels based on the indication of the number of layers and the indication that the type of the one of the channels is the background channel.

Clause 10D. The method of clause 9D, further comprising obtaining an indication a type of one of the channels specified in the one or more layers in the bitstream, the indication of the type of the one of the channels indicating that the one of the channels is a background channel, wherein obtaining the channels comprises obtaining the one of the channels based on the indication of the number of layers and the indication that the type of the one of the channels is the background channel.

Clause 11D. The method of clause 9D, wherein the one of the channels comprises a background higher order ambisonic coefficient.

Clause 12D. The method of clause 9D, wherein obtaining the indication of the type of the one of the channels comprises obtaining a syntax element indicative of the type of the one of the channels.

Clause 13D. The method of clause 1D, wherein obtaining the indication of the number of channels comprises obtaining the indication of the number of channels based on a number of channels remaining in the bitstream after one of the layers is obtained.

Clause 14D. The method of clause 1D, wherein the layers comprise a base layer.

Clause 15D. The method of clause 1D, wherein the layers comprises a base layer and one or more enhancement layers.

Clause 16D. The method of clause 1D, wherein a number of the one or more layers is fixed.

The foregoing techniques may be performed with respect to any number of different contexts and audio ecosystems. A number of example contexts are described below, although the techniques should be limited to the example contexts. One example audio ecosystem may include audio content, movie studios, music studios, gaming audio studios, channel based audio content, coding engines, game audio stems, game audio coding/rendering engines, and delivery systems.

The movie studios, the music studios, and the gaming audio studios may receive audio content. In some examples, the audio content may represent the output of an acquisition. The movie studios may output channel based audio content (e.g., in 2.0, 5.1, and 7.1) such as by using a digital audio workstation (DAW). The music studios may output channel based audio content (e.g., in 2.0, and 5.1) such as by using a DAW. In either case, the coding engines may receive and encode the channel based audio content based one or more codecs (e.g., AAC, AC3, Dolby True HD, Dolby Digital Plus, and DTS Master Audio) for output by the delivery systems. The gaming audio studios may output one or more game audio stems, such as by using a DAW. The game audio coding/rendering engines may code and or render the audio stems into channel based audio content for output by the delivery systems. Another example context in which the techniques may be performed comprises an audio ecosystem that may include broadcast recording audio objects, professional audio systems, consumer on-device capture, HOA audio format, on-device rendering, consumer audio, TV, and accessories, and car audio systems.

The broadcast recording audio objects, the professional audio systems, and the consumer on-device capture may all code their output using HOA audio format. In this way, the audio content may be coded using the HOA audio format into a single representation that may be played back using the on-device rendering, the consumer audio, TV, and accessories, and the car audio systems. In other words, the single representation of the audio content may be played back at a generic audio playback system (i.e., as opposed to requiring a particular configuration such as 5.1, 7.1, etc.), such as audio playback system 16.

Other examples of context in which the techniques may be performed include an audio ecosystem that may include acquisition elements, and playback elements. The acquisition elements may include wired and/or wireless acquisition devices (e.g., Eigen microphones), on-device surround sound capture, and mobile devices (e.g., smartphones and tablets). In some examples, wired and/or wireless acquisition devices may be coupled to mobile device via wired and/or wireless communication channel(s).

In accordance with one or more techniques of this disclosure, the mobile device may be used to acquire a soundfield. For instance, the mobile device may acquire a soundfield via the wired and/or wireless acquisition devices and/or the on-device surround sound capture (e.g., a plurality of microphones integrated into the mobile device). The mobile device may then code the acquired soundfield into the HOA coefficients for playback by one or more of the playback elements. For instance, a user of the mobile device may record (acquire a soundfield of) a live event (e.g., a meeting, a conference, a play, a concert, etc.), and code the recording into HOA coefficients.

The mobile device may also utilize one or more of the playback elements to playback the HOA coded soundfield. For instance, the mobile device may decode the HOA coded soundfield and output a signal to one or more of the playback elements that causes the one or more of the playback elements to recreate the soundfield. As one example, the mobile device may utilize the wireless and/or wireless communication channels to output the signal to one or more speakers (e.g., speaker arrays, sound bars, etc.). As another example, the mobile device may utilize docking solutions to output the signal to one or more docking stations and/or one or more docked speakers (e.g., sound systems in smart cars and/or homes). As another example, the mobile device may utilize headphone rendering to output the signal to a set of headphones, e.g., to create realistic binaural sound.

In some examples, a particular mobile device may both acquire a 3D soundfield and playback the same 3D soundfield at a later time. In some examples, the mobile device may acquire a 3D soundfield, encode the 3D soundfield into HOA, and transmit the encoded 3D soundfield to one or more other devices (e.g., other mobile devices and/or other non-mobile devices) for playback.

Yet another context in which the techniques may be performed includes an audio ecosystem that may include audio content, game studios, coded audio content, rendering engines, and delivery systems. In some examples, the game studios may include one or more DAWs which may support editing of HOA signals. For instance, the one or more DAWs may include HOA plugins and/or tools which may be configured to operate with (e.g., work with) one or more game audio systems. In some examples, the game studios may output new stem formats that support HOA. In any case, the game studios may output coded audio content to the rendering engines which may render a soundfield for playback by the delivery systems.

The techniques may also be performed with respect to exemplary audio acquisition devices. For example, the techniques may be performed with respect to an Eigen microphone which may include a plurality of microphones that are collectively configured to record a 3D soundfield. In some examples, the plurality of microphones of Eigen microphone may be located on the surface of a substantially spherical ball with a radius of approximately 4 cm. In some examples, the audio encoding device 20 may be integrated into the Eigen microphone so as to output a bitstream 21 directly from the microphone.

Another exemplary audio acquisition context may include a production truck which may be configured to receive a signal from one or more microphones, such as one or more Eigen microphones. The production truck may also include an audio encoder, such as audio encoder 20 of FIG. 3.

The mobile device may also, in some instances, include a plurality of microphones that are collectively configured to record a 3D soundfield. In other words, the plurality of microphone may have X, Y, Z diversity. In some examples, the mobile device may include a microphone which may be rotated to provide X, Y, Z diversity with respect to one or more other microphones of the mobile device. The mobile device may also include an audio encoder, such as audio encoder 20 of FIG. 3.

A ruggedized video capture device may further be configured to record a 3D soundfield. In some examples, the ruggedized video capture device may be attached to a helmet of a user engaged in an activity. For instance, the ruggedized video capture device may be attached to a helmet of a user whitewater rafting. In this way, the ruggedized video capture device may capture a 3D soundfield that represents the action all around the user (e.g., water crashing behind the user, another rafter speaking in front of the user, etc. . . ).

The techniques may also be performed with respect to an accessory enhanced mobile device, which may be configured to record a 3D soundfield. In some examples, the mobile device may be similar to the mobile devices discussed above, with the addition of one or more accessories. For instance, an Eigen microphone may be attached to the above noted mobile device to form an accessory enhanced mobile device. In this way, the accessory enhanced mobile device may capture a higher quality version of the 3D soundfield than just using sound capture components integral to the accessory enhanced mobile device.

Example audio playback devices that may perform various aspects of the techniques described in this disclosure are further discussed below. In accordance with one or more techniques of this disclosure, speakers and/or sound bars may be arranged in any arbitrary configuration while still playing back a 3D soundfield. Moreover, in some examples, headphone playback devices may be coupled to a decoder 24 via either a wired or a wireless connection. In accordance with one or more techniques of this disclosure, a single generic representation of a soundfield may be utilized to render the soundfield on any combination of the speakers, the sound bars, and the headphone playback devices.

A number of different example audio playback environments may also be suitable for performing various aspects of the techniques described in this disclosure. For instance, a 5.1 speaker playback environment, a 2.0 (e.g., stereo) speaker playback environment, a 9.1 speaker playback environment with full height front loudspeakers, a 22.2 speaker playback environment, a 16.0 speaker playback environment, an automotive speaker playback environment, and a mobile device with ear bud playback environment may be suitable environments for performing various aspects of the techniques described in this disclosure.

In accordance with one or more techniques of this disclosure, a single generic representation of a soundfield may be utilized to render the soundfield on any of the foregoing playback environments. Additionally, the techniques of this disclosure enable a rendered to render a soundfield from a generic representation for playback on the playback environments other than that described above. For instance, if design considerations prohibit proper placement of speakers according to a 7.1 speaker playback environment (e.g., if it is not possible to place a right surround speaker), the techniques of this disclosure enable a render to compensate with the other 6 speakers such that playback may be achieved on a 6.1 speaker playback environment.

Moreover, a user may watch a sports game while wearing headphones. In accordance with one or more techniques of this disclosure, the 3D soundfield of the sports game may be acquired (e.g., one or more Eigen microphones may be placed in and/or around the baseball stadium), HOA coefficients corresponding to the 3D soundfield may be obtained and transmitted to a decoder, the decoder may reconstruct the 3D soundfield based on the HOA coefficients and output the reconstructed 3D soundfield to a renderer, the renderer may obtain an indication as to the type of playback environment (e.g., headphones), and render the reconstructed 3D soundfield into signals that cause the headphones to output a representation of the 3D soundfield of the sports game.

In each of the various instances described above, it should be understood that the audio encoding device 20 may perform a method or otherwise comprise means to perform each step of the method for which the audio encoding device 20 is configured to perform In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio encoding device 20 has been configured to perform.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media. Data storage media may be any available media that can be accessed by one or more computers or one or more processors to retrieve instructions, code and/or data structures for implementation of the techniques described in this disclosure. A computer program product may include a computer-readable medium.

Likewise, in each of the various instances described above, it should be understood that the audio decoding device 24 may perform a method or otherwise comprise means to perform each step of the method for which the audio decoding device 24 is configured to perform. In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio decoding device 24 has been configured to perform.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

Various aspects of the techniques have been described. These and other aspects of the techniques are within the scope of the following claims.

The invention claimed is:

1. A device configured to decode a bitstream representative of a higher order ambisonic audio signal, the device comprising:

a memory configured to store the bitstream representative of the higher order ambisonic audio signal; and one or more processors configured to:

obtain an indication of a total number of channels specified in the bitstream;

obtain, from the bitstream, an indication of a number of channels specified in each of one or more layers in the bitstream; and obtain the channels specified in the one or more layers in the bitstream based on the indication of the number of channels specified in each of the one or more layers and the indication of the total number of channels specified in the bitstream.

2. The device of claim 1, wherein the one or more processors are further configured to obtain an indication of a type of one of the channels specified in the one or more layers in the bitstream, and wherein the one or more processors are configured to obtain the one of the channels based on the indication of the number of channels specified in each of the one or more layers, the indication of the total number of channels specified in the bitstream, and the indication of the type of the one of the channels.

3. The device of claim 1, wherein the one or more processors are further configured to obtain an indication of a type of one of the channels specified in the one or more layers in the bitstream, the indication of the type of the one of the channels indicating that the one of the channels is a foreground channel, and wherein the one or more processors are configured to obtain the one of the channels based on the indication of the number of channels specified in each of the one or more layers, the indication of the total number of channels specified in the bitstream, and the indication that the type of the one of the channels is the foreground channel.

4. The device of claim 1, wherein the processors are further configured to obtain an indication of a number of layers specified in the bitstream, and wherein the processors are configured to obtain the one of the channels based on the indication of the number of channels specified in each of the one or more layers, the indication of the total number of channels specified in the bitstream, and the indication of the number of layers.

5. The device of claim 4, wherein the indication of the number of layers comprises an indication of a number of layers in a previous frame of the bitstream, wherein the one or more processors are further configured to obtain an indication of whether the number of channels specified in one or more layers in the bitstream has changed in a current frame when compared to a number of channels specified in one or more layers in the bitstream of the previous frame, and wherein the processors are configured to obtain the one of the channels based on the indication of whether the number of channels specified in one or more layers in the bitstream has changed in the current frame.

6. The device of claim 4, wherein the one or more processors are further configured to determine the number of channels specified in the one or more layers of the bitstream in the current frame as the same as the number of channels specified in the one or more layers of the bitstream in the previous frame when the indication indicates that the number of channels specified in the one or more layers of the bitstream has not changed in the current frame when compared to the number of channels specified in the one or more layers of the bitstream in the previous frame.

7. The device of claim 4, wherein the one or more processors are further configured to, when the indication indicates that the number of channels specified in the one or more layers of the bitstream has not changed in the current frame when compared to the number of channels specified in the one or more layers of the bitstream in the previous frame, obtain an indication of a current number of channels in one or more of the layers for the current frame to be the same as a previous number of channels in one or more of the layers of the previous frame.

8. The device of claim 1, further comprising a loudspeaker configured to reproduce a soundfield based on the higher order ambisonic audio signal.

9. A method of decoding a bitstream representative of a higher order ambisonic audio signal, the method comprising:

obtaining an indication of a total number of channels specified in the bitstream;

obtaining, from the bitstream representative of the higher order ambisonic audio signal, an indication of a number of channels specified in each of one or more layers in the bitstream; and obtaining the channels specified in the one or more layers in the bitstream based on the indication of the number of channels specified in each of the one or more layers and the indication of the total number of channels specified in the bitstream.

10. The method of claim 9, further comprising obtaining an indication of a type of one of the channels specified in the one or more layers in the bitstream, the indication of the type of the one of the channels indicating that the one of the channels is a background channel, wherein obtaining the channels comprises obtaining the one of the channels based on the indication of the number of channels specified in each of the one or more layers, the indication of the total number of channels specified in the bitstream, and the indication that the type of the one of the channels is the background channel.

11. The method of claim 10, further comprising obtaining an indication of a type of one of the channels specified in the one or more layers in the bitstream, the indication of the type of the one of the channels indicating that the one of the channels is a background channel, wherein obtaining the channels comprises obtaining the one of the channels based on the indication of the number of layers specified in each of the one or more layers, the indication of the total number of channels specified in the bitstream, and the indication that the type of the one of the channels is the background channel.

12. The method of claim 10, wherein the one of the channels comprises a background higher order ambisonic coefficient.

13. The method of claims 10, wherein obtaining the indication of the type of the one of the channels comprises obtaining a syntax element indicative of the type of the one of the channels.

14. The method of claim 9, wherein obtaining the indication of the number of channels comprises obtaining the indication of the number of channels based on a number of channels remaining in the bitstream after one of the layers is obtained.

15. The method of claim 9, wherein the layers comprise a base layer.

16. The method of claim 9, wherein the layers comprises a base layer and one or more enhancement layers.

17. The method of claim 9, wherein a number of the one or more layers is fixed.

18. A device configured to decode a bitstream representative of a higher order ambisonic audio signal, the device comprising:

means for obtaining an indication of a total number of channels specified in the bitstream;

means for obtaining, from the bitstream representative of the higher order ambisonic audio signal, an indication of a number of channels specified in each of one or more layers of the bitstream; and means for obtaining the channels specified in the one or more layers in the bitstream based on the indication of the number of channels specified in each of the one or more layers and the indication of the total number of channels specified in the bitstream.

19. A non-transitory computer-readable storage medium having stored thereon instructions that, when executed, cause one or more processors to:

obtain, from a bitstream representative of a higher order ambisonic audio signal, an indication of a total number of channels specified in the bitstream;

obtain, from the bitstream, an indication of a number of channels specified in each of one or more layers of the bitstream; and obtain the channels specified in the one or more layers of the bitstream based on the indication of the number of channels specified in each of the one or more layers and the indication of the total number of channels specified in the bitstream.

20. A device configured to encode a higher order ambisonic audio signal to generate a bitstream, the device comprising:

one or more processors configured to:

obtain an indication of a total number of channels specified in the bitstream;

specify, in the bitstream, an indication of a number of channels specified in each of one or more layers of the bitstream; and specify the indicated total number of the channels in the bitstream such that each of the one or more layers includes the indicated number of channels specified in the respective layer; and a memory configured to store the bitstream.

21. The device of claim 20, wherein the one or more processors are further configured to specify an indication of a type of one of the channels specified in the one or more layers in the bitstream, and wherein the one or more processors are configured to specify the indicated number of the indicated type of the one of the channels in the one or more layers of the bitstream.

22. The device of claim 20, wherein the one or more processors are further configured to specify an indication of a type of one of the channels specified in the one or more layers in the bitstream, the indication of the type of the one of the channels indicating that the one of the channels is a foreground channel, and wherein the one or more processors are configured to specify the foreground channel in the one or more layers of the bitstream.

23. The device of claim 20, wherein the one or more processors are further configured to specify an indication, in the bitstream, of a number of layers specified in the bitstream.

24. The device of claim 20, further comprising a microphone configured to capture the higher order ambisonic audio signal.

25. A method of encoding a higher order ambisonic audio signal to generate a bitstream, the method comprising:

obtain an indication of a total number of channels specified in the bitstream, specifying, in the bitstream, an indication of a number of channels specified in each of one or more layers of the bitstream; and specifying the indicated total number of the channels in the bitstream such that each of the one or more layers includes the indicated number of channels specified in the respective layer.

26. The method of claim 25, further comprising specifying an indication of a type of one of the channels specified in the one or more layers in the bitstream, the indication of the type of the one of the channels indicating that the one of the channels is a background channel, wherein specifying the indicated number of the channels comprises specifying the background channel in the one or more layers of the bitstream.

27. The method of claim 26, wherein the one of the channels comprises a background higher order ambisonic coefficient.

28. The method of claim 25, wherein specifying the indication of the number of channels comprises specifying the indication of the number of channels based on a number of channels remaining in the bitstream after one of the layers is specified.

* * * * *